US010378235B1

(12) United States Patent
Volin

(10) Patent No.: US 10,378,235 B1
(45) Date of Patent: Aug. 13, 2019

(54) ARTHRITIC-ASSISTING ONE-PERSON-DEPLOYING CANOPY

(71) Applicant: Dee Volin, Gresham, OR (US)

(72) Inventor: Dee Volin, Gresham, OR (US)

( * ) Notice: Subject to any disclaimer, the term of this patent is extended or adjusted under 35 U.S.C. 154(b) by 0 days.

(21) Appl. No.: 16/361,107

(22) Filed: Mar. 21, 2019

(51) Int. Cl.

| | |
|---|---|
| ***E04H 15/50*** | (2006.01) |
| ***E04H 15/02*** | (2006.01) |
| ***E04H 15/32*** | (2006.01) |
| ***E04H 15/60*** | (2006.01) |
| ***E04H 15/54*** | (2006.01) |

(52) U.S. Cl.
CPC ..... *E04H 15/50* (2013.01); *E04H 15/02* (2013.01); *E04H 15/322* (2013.01); *E04H 15/54* (2013.01); *E04H 15/60* (2013.01)

(58) Field of Classification Search
CPC ..... E04H 15/50; E04H 15/54
See application file for complete search history.

(56) References Cited

U.S. PATENT DOCUMENTS

| | | | | |
|---|---|---|---|---|
| 2,151,908 | A | 3/1939 | Gottlieb | |
| 2,265,479 | A | 12/1941 | Goodman | |
| 3,085,586 | A | 4/1963 | McDonough | |
| 3,199,518 | A | 8/1965 | Glidewell | |
| 4,779,635 | A | 10/1988 | Lynch | |
| 4,885,891 | A | 12/1989 | Lynch | |
| 4,947,884 | A * | 8/1990 | Lynch | E04H 15/50 135/145 |
| 5,035,253 | A | 7/1991 | Bortles | |
| 5,244,001 | A | 9/1993 | Lynch | |
| 5,511,572 | A | 4/1996 | Carter | |
| 5,638,853 | A | 6/1997 | Tsai | |
| 6,141,934 | A | 11/2000 | Zeigler | |
| 6,283,136 | B1 | 9/2001 | Chen | |
| 6,666,223 | B2 * | 12/2003 | Price | E04H 15/50 135/114 |
| 6,772,780 | B2 * | 8/2004 | Price | E04H 15/50 135/128 |
| 7,168,439 | B2 * | 1/2007 | Patel | E04H 15/50 135/131 |

(Continued)

*Primary Examiner* — Noah Chandler Hawk

(57) ABSTRACT

An arthritic-assisting one-person-deploying canopy includes: an adjustable ring canopy, a central intersector, foldable top trusses attached to the central intersect and the adjustable ring canopy, top-truss connectors bolted to the foldable top trusses, foldable corner trusses bolted to the foldable top trusses, foldable side trusses, four upper corner intersectors bolted to the foldable top trusses and the foldable side trusses, four upper posts attached to the four upper corner intersectors, four lower corner intersectors slid on the four upper posts and bolted to the foldable corner trusses and the foldable side trusses, four arthritic-a hooks, four lower posts inserted inside the four upper posts, post-height-adjusting holes drilled in the four upper posts and the four lower posts, an adjustable central canopy, a central post attached to the central intersector, a central-post hole formed in the central post, a central-innersurface-locking spring inserted inside the central post, an arthritic-assisting self-centering spring-loaded housing-locking hook riveted inside the central post, and an arthritic-assisting central-one-push-locking adjustable housing slidably locked on and unlocked from the central post.

20 Claims, 57 Drawing Sheets

(56) References Cited

U.S. PATENT DOCUMENTS

| | | | | |
|---|---|---|---|---|
| 7,178,542 | B2 | 2/2007 | Carter | |
| 7,624,747 | B2 * | 12/2009 | Carter | E04H 15/50 135/135 |
| 7,836,907 | B2 | 11/2010 | Carter | |
| D670,003 | S | 10/2012 | Lovley, II | |
| 8,418,711 | B2 | 4/2013 | Park | |
| 8,776,815 | B2 | 7/2014 | Park | |
| 9,234,366 | B2 * | 1/2016 | Mallookis | E04H 15/50 |
| 9,528,292 | B1 | 12/2016 | Lovley, II | |
| 9,556,639 | B2 | 1/2017 | Hunt | |
| D785,201 | S | 4/2017 | Hassman | |
| 9,683,387 | B2 | 6/2017 | Lovley, II | |
| 9,926,720 | B2 * | 3/2018 | Huang | E04H 15/322 |
| 9,995,057 | B2 * | 6/2018 | Wu | E04H 15/46 |
| 2003/0164185 | A1 * | 9/2003 | Price | E04H 15/50 135/131 |
| 2006/0266401 | A1 | 11/2006 | Wu | |
| 2010/0006131 | A1 * | 1/2010 | Liu | E04H 15/50 135/143 |
| 2011/0308559 | A1 | 12/2011 | Ma | |
| 2014/0030012 | A1 * | 1/2014 | Lee | F16B 7/105 403/326 |
| 2015/0107637 | A1 * | 4/2015 | Lamke | E04H 15/50 135/120.1 |
| 2015/0247339 | A1 * | 9/2015 | Lee | E04H 15/50 135/145 |
| 2016/0060896 | A1 * | 3/2016 | Toohey | E04H 15/32 135/120.1 |

* cited by examiner

ARTHRITIC-ASSISTING ONE-PERSON-DEPLOYING CANOPY

1. FIELD OF THE INVENTION

The present invention relates to a collapsible popup, which is cheap to produce, is easy to ship as one unit, requires no assembly, and can be quickly and easily be unfolded. Particularly, the present invention relates to an arthritic-assisting one-person-deploying adjustable-central-canopy adjustable-ring-canopy rollable central-one-push-locking popup, which comprises:

1) Arthritic-assisting post-centering tick-preventing water-discharging wind-and-smoke-redirecting adjustable-ring-canopy system,
2) Arthritic-assisting central-innersurface-locking wind-and-smoke-redirecting adjustable-central-canopy system, and
3) Arthritic-assisting multi-function hook-pulley-axle-wheel caster system.

2. DESCRIPTION OF THE PRIOR ART

A number of collapsible popups have been introduced.

U.S. Pat. No. 2,151,908, issued 1939 Mar. 28, to Max E. Gottlieb, relates to chapel tents and particularly to the collapsible of folding type which is used at cemeteries during funeral services. An object of this invention is to provide a shelter tent suitable for the purposes mentioned which will fold up compactly to as to be easily transported and yet be sturdy enough to withstand all sorts of inclement weather without the aid of auxiliary and troublesome anchors.

U.S. Pat. No. 2,265,479, issued 1941 Dec. 9, to Dwight Goodman, relates primarily to chapel tents, but is also obviously useful in temporary shelters for concessions, and as a display tent or the like. An object of the invention resides in the provision of a tent frame which may be readily folded in a compact manner for transportation, and yet which is sufficiently strong to remain in set-up condition despite all sorts of inclement weather.

U.S. Pat. No. 3,085,586, issued 1963 Apr. 16, to Elon D. McDonough, refers to a portable structure of the type employing a foldable frame and a flexible covering for the frame. An object of this invention is to provide a foldable structure which is adapted to form an enclosure for large areas, which structure is of economical and light weight construction and which can be readily collapsed and disassembled for compact storage and transportation.

U.S. Pat. No. 3,199,518, issued 1965 Aug. 10, to Herman A. Glidewell, describes a collapsible and foldable frame which may be employed as a shelter when suitable covering material is placed thereover. The device is primarily intended as a collapsible frame over which camouflage material can be placed to provide a hunting blind, but could, of course, be employed as a frame over which any desired covering material (such as tarpaulin) could be placed to provide protection against the weather.

U.S. Pat. No. 4,779,635, issued 1988 Oct. 25, to James P. Lynch, demonstrates a canopy structure which is provided and includes a framework unit and a flexible covering. The framework unit is formed by a plurality of upright corner members and a plurality of roof support members that are pivotally connected at the top ends of the corner members and, in an erected position, extend upwardly and inwardly to a central apex where they are pivotally connected to one another.

U.S. Pat. No. 4,885,891, issued 1989 Dec. 12, to James P. Lynch, relates to an extendible scissors truss such as may be utilized in a collapsible canopy structure wherein the extendible scissors truss has members pivotally connected to form truss cells. The reinforcement member has first and second end portions joined by a linking portion to form a Z-like configuration.

U.S. Pat. No. 5,035,253, issued 1991 Jul. 30, to Allan D. Bortles, demonstrates a rain runoff awning for collecting runoff from a tent canopy. Fabric is stretched between and secured to outwardly extending arms which are attached to the canopy frame. The fabric forms a gutter or trough along an edge of the canopy for receiving runoff from the canopy and directing the runoff away from entrance and exit areas of the canopy.

U.S. Pat. No. 5,244,001, issued 1993 Sep. 14, to James P. Lynch, describes an expandable framework structure which can be folded for storage and expanded for use, especially as a canopy when a covering is placed on top of the framework. The framework includes a plurality of upright supports and a plurality of edge scissor assemblies that interconnect adjacent ones of the upright supports.

U.S. Pat. No. 5,511,572, issued 1996 Apr. 30, to Mark C. Carter, describes a collapsible shelter which includes a truss and canopy framework that permits a flexible, collapsible canopy to be moved between a raised position and a lowered position. The collapsible shelter includes at least three legs supporting flexible poles removably mounted to the tops of the legs and forming the framework of the canopy. X-shaped truss pairs of link members are connected to each of the legs on each side of the shelter between adjacent legs.

U.S. Pat. No. 5,638,853, issued 1997 Jun. 17, to Tony M. L. Tsai, demonstrates a tent structure which includes four poles interconnected by four scissors-type linkages forming a square structure and four intermediate pivot connecting members. Each pole comprises a fixed connector and a sliding connector.

U.S. Pat. No. 6,141,934, issued 2000 Nov. 7, to Theodore R. Zeigler, depicts a folding frame system which includes a roof assembly including at least three pivotably attached strut pairs, adjacent pairs of the at least three pivotably attached strut pairs defining at least three corners of the roof assembly. The roof assembly is movable between a roof assembly closed position in which struts of the at least three strut pairs are disposed parallel to each other and a roof assembly open position in which struts of the at least three strut pairs are locked in non-parallel positions and ends of the struts of each strut pair of the at least three strut pairs define a rectangle.

U.S. Pat. No. 6,283,136, issued 2001 Sep. 4, to Fengchun Chen, refers to a collapsible tent which comprises top connecting means at the top of the tent; a plurality of upright legs; a slider slideably received on each upright leg; upper roof support bars pivotally connected to the top connecting means; lower roof support bars which each are connected at one end to its respective upper roof support bar and at the other end to a top of its respective upright leg.

U.S. Pat. No. 7,178,542, issued 2007 Feb. 20, to Mark C. Carter, demonstrates a lightweight erectable canopy shelters which include a plurality of legs connected together by an extendible perimeter assembly of link members. In one embodiment, the roof structure is formed by a pole members pivotally mounted to the upper ends of the legs so as to extend across the shelter, and movable between a lowered position and a raised, upwardly arching position.

U.S. Pat. No. 7,836,907, issued 2010 Nov. 23, to Mark C. Carter, refers to a quickly erectable dome shelter which includes an extendible perimeter truss assembly with link members connected between adjacent legs, a central truss assembly of link members, and a roof framework, including pairs of curved upper and lower peak truss members, that is movable between a lowered, collapsed configuration and a raised, upwardly arching position.

U.S. Pat. No. 8,418,711, issued 2013 Apr. 16, to Bumjun Park, demonstrates a collapsible canopy support which includes beams for supporting a canopy with each beam having a plurality of elongated beam segments coupled together to form the beam. A segment coupler provides for pivotally coupling a first beam segment to a second beam segment. A segment locking assembly is adapted for selectively securing the first beam segment relative to the second beam segment.

U.S. Pat. No. 8,776,815, issued 2014 Jul. 15, to Bumjun Park, relates to a collapsible shelter assembly which includes legs, a truss system, a cover, cover supporting rods and mounting brackets. Each of the legs has an upper and a lower end. The truss system is configured to link each pair of legs together and define a base perimeter.

U.S. Pat. No. 9,528,292, issued 2016 Dec. 27, to Jack B. Lovley, II, refers to a canopy which includes a frame assembly having a perimeter frame portion, a central frame portion and multiple legs. The frame assembly also includes one or more overhang frame portions, each of which can include a main overhang frame member and a strut. Each overhang frame portion can extend diagonally from the associated corner of the frame assembly.

U.S. Pat. No. 9,556,639, issued 2017 Jan. 31, to David Lewis Hunt, refers to a portable shelter framing system which is disclosed herein. The portable shelter framing system includes a plurality of corner support members; a plurality of crossbeam members, each of the crossbeam members configured to be connected between a pair of the plurality of corner support members without the use of tools.

U.S. Pat. No. 9,683,387, issued 2017 Jun. 20, to Jack B Lovley, II, relates to a canopy shelter link point for increased structural integrity particularly when subject to bending forces about the link point. The canopy shelter link point can include an increased overlap distance between two cross members, reduced spacing between adjacent cross members, and/or extension features located about an end of the cross members to reduce the misalignment angle between two cross members.

U.S. Pat. No. D670003, issued 2012 Oct. 30, to Jack B Lovley, II, depicts an ornamental design for a canopy.

U.S. Pat. No. D785201, issued 2017 Apr. 25, to Ellen Hassman, depicts an ornamental design for a gazebo canopy.

U.S. Publication No. 20060266401, published 2006 Nov. 30, to Weidan Wu, relates to a tarpaulin shelter with collapsible doorframes, including doorframes, the lower end of which is connected to the base and the upper end is connected with corner joint and cross beam, characterized in that the doorframe includes at least three upright poles, in which at least a set of x-scissor member are arranged between the middle upright pole and each side upright pole, said scissor is composed of two cross rods of which the middle portions are mutually hinged together.

U.S. Publication No. 20110308559, published 2011 Dec. 22, to Oliver Ma, relates to a shelter that includes a slider and a strut mechanism mounted on support posts of the shelter that automatically actuate and extend from the side of the support posts when the shelter is expanded from its collapsed state. The strut mechanism provides support for an eave that extends outside from all or a portion of the perimeter of the shelter defined by the corners of the support posts.

DISADVANTAGES OF THE PRIOR ART

The prior art have failed to solve many problems associated with central-lock popup, as follows:

1) No prior art mention or disclose any central-lock popup, having adjustable ring canopy 102 and adjustable central canopy 122.

Therefore, the prior art of central-lock popup:

a) Can not provide shade to occupants,
to prevent sunburn;

b) Can not be adjusted up and down to increase airflow into and out of the arthritic-assisting one-person-deploying adjustable-central-canopy adjustable-ring-canopy rollable central-one-push-locking popup,
to keep occupants cool;

c) Can not help with airflow out of the arthritic-assisting one-person-deploying adjustable-central-canopy adjustable-ring-canopy rollable central-one-push-locking popup,
to assist in smoke exiting the arthritic-assisting one-person-deploying adjustable-central-canopy adjustable-ring-canopy rollable central-one-push-locking popup; and d) Can not provide rain protection,
to keep occupants dry.

2) No prior art mention or disclose any central-lock popup, having arthritic-assisting central-one-push-locking adjustable housing 127.

Therefore, the prior art of central-lock popup:

a) Can not snap lock central post 123 to the rest of the canopy structure,
to increase overall strength of the arthritic-assisting one-person-deploying adjustable-central-canopy adjus- table-ring-canopy rollable central-one-push-locking popup;

b) Can not lock canopy together,
to prevent the arthritic-assisting one-person-deploying adjustable-central-canopy adjustable-ring-canopy rollable central-one-push-locking popup from collapsing; and c) Can not decrease the total number of locking points,
to make setup easier.

3) No prior art mention or disclose any central-lock popup, having oversized shock-absorbing locking-wheels 140.

Therefore, the prior art of central-lock popup:

a) Can not be used as pulleys to thread ropes 136,
to tighten canopies;

b) Can not be used to roll the arthritic-assisting one-person-deploying adjustable-central-canopy adjustable-ring-canopy rollable central-one-push-locking popup along the ground when in collapsed configuration,
to make transportation easier;

c) Can not be used to assist in moving arthritic-assisting one-person-deploying adjustable-central-canopy adjustable-ring-canopy rollable central-one-push-locking popup when fully erected, to help with relocating the arthritic-assisting one-person-deploying adjustable-central-canopy adjustable-ring-canopy rollable central-one-push-locking popup; and d) Can not be used to roll the arthritic-assisting one-person-deploying adjustable-central-canopy adjustable-ring-canopy rollable central-one-push-locking popup on rough and/or uneven terrain to help with relocating the arthritic-assisting one-person-deploying adjustable-central-canopy adjustable-ring-canopy rollable central-one-push-locking popup in more locations.

4) No prior art mention or disclose any central-lock popup, having tick-preventing downward teeth 115.

Therefore, the prior art of central-lock popup:

a) Can not prevent ticks from getting inside four upper posts 112 and four lower posts 119, to protect occupants from disease;

b) Can not help protect from weather elements getting up inside four upper posts 112 and four lower posts 119, to help prevent against rust and increase the lifetime of the arthritic-assisting one-person-deploying adjustable-central-canopy adjustable-ring-canopy rollable central-one-push-locking popup;

c) Can not assist in water drainage, to help prevent rusting; and d) Can not provide additional structure to four sleeves 114*a*, to increase strength of four upper posts 112 and four lower posts 119.

5) No prior art mention or disclose any central-lock popup, having post-centering clamps 114*b*.

Therefore, the prior art of central-lock popup:

a) Can not center four lower posts 119 within four upper posts 112, to help with assembly and disassembly;

b) Can not help keep ticks from entering into four upper posts 112 and four lower posts 119, to protect occupants;

c) Can not provide addition strength and stability to four upper posts 112 and four lower posts 119, to keep occupants safe and increase the arthritic-assisting one-person-deploying adjustable-central-canopy adjustable-ring-canopy rollable central-one-push-locking popup's lifetime; and d) Can not keep four upper posts 112 and four lower posts 119 from binding to help with adjusting the arthritic-assisting one-person-deploying adjustable-central-canopy adjustable-ring-canopy rollable central-one-push-locking popup up and down.

6) No prior art mention or disclose any central-lock popup, having central post 123.

Therefore, the prior art of central-lock popup:

a) Can not provide lateral strength to the arthritic-assisting one-person-deploying adjustable-central-canopy adjustable-ring-canopy rollable central-one-push-locking popup, to keep arthritic-assisting one-person-deploying adjustable-central-canopy adjustable-ring-canopy rollable central-one-push-locking popup from radially twisting;

b) Can not lock canopy structure together, to prevent canopy from collapsing; and c) Can not decrease the total number of overall locking points, to make setup easier.

7) No prior art mention or disclose any central-lock popup, having arthritic-assisting self-centering spring-loaded housing-locking hook 126.

Therefore, the prior art of central-lock popup:

a) Can not automatically guide central post 123 into arthritic-assisting central-one-push-locking adjustable housing 127, to help with setup;

b) Can not automatically lock and center arthritic-assisting self-centering spring-loaded housing-locking hook 126 to arthritic-assisting central-one-push-locking adjustable housing 127, to help strengthen popup to withstand twisting and accidental collapsing;

c) Can not automatically depress arthritic-assisting self-centering spring-loaded housing-locking hook 126, to make locking central post 123 easier; and d) Can not automatically provide less friction between arthritic-assisting central-one-push-locking adjustable housing 127 and central post 123, to make setup and adjustment easier.

8) No prior art mention or disclose any central-lock popup, having water-discharging grooves 116.

Therefore, the prior art of central-lock popup:

a) Can not allow water to drain from four upper posts 112 and four lower posts 119, to prevent four upper posts 112 and four lower posts 119 from rusting;

b) Can not prevent water from getting into posts, to help prolong the life of the arthritic-assisting one-person-deploying adjustable-central-canopy adjustable-ring-canopy rollable central-one-push-locking popup;

c) Can not help protect against insects, to help protect occupants; and d) Can not provide addition structure to four sleeves 114*a*, to increase strength of four upper posts 112 and four lower posts 119.

9) No prior art mention or disclose any central-lock popup, having arthritic-assisting post-height-adjusting spring-loaded rope-loop hooks 117.

Therefore, the prior art of central-lock popup:

a) Can not lock and release four post-height-adjusting nipples 118, to adjust height of the arthritic-assisting one-person-deploying adjustable-central-canopy adjustable-ring-canopy rollable central-one-push-locking popup;

b) Can not be used as a hook for rope loop ends 137, to provide options of setup; and c) Can not be used with those who have arthritis to allow pressing without the need to bend fingers, to make setup for those with arthritis less painful.

10) No prior art mention or disclose any central-lock popup, having four sleeves 114*a*.

Therefore, the prior art of central-lock popup:

a) Can not prevent four upper posts 112 and four lower posts 119 from scratching each other to prevent premature wear or rusting;

b) Can not minimize friction between four upper posts 112 and four lower posts 119,
to make raising and lowing easier;
c) Can not protect exposed joints of four upper posts 112 and four lower posts 119,
to prevent rusting and increase lifetime; and
d) Can not join four upper posts 112 and four lower posts 119 together
to provide additional strength and support for posts.

11) No prior art mention or disclose any central-lock popup, having
rope-guiding holes 135.
Therefore, the prior art of central-lock popup:
a) Can not be used to thread ropes 136 through,
to use with either pulley axle or hooks;
b) Can not be used to guide ropes 136 diagonally across arthritic-assisting pulley-axles 139,
to prevent tangling;
c) Can not be used as a rope pulley,
to be used with arthritic-assisting pulley-axles 139 and ropes 136; and
d) Can not be used as a tie-off location for ropes 136,
to increase customization options for ropes 136 and arthritic-assisting pulley-axles 139.

12) No prior art mention or disclose any central-lock popup, having
arthritic-assisting wheel-locking spring-loaded rope-loop hooks.
Therefore, the prior art of central-lock popup:
a) Can not hook canopy ropes 136 on arthritic-assisting wheel-locking spring-loaded rope-loop hooks 134*a*
to lock ropes 136 and all canopies to keep them from slipping when the popup is set up on a slope;
b) Can not lock oversized shock-absorbing locking-wheels 140,
to help keep canopy from moving
when the popup is set up on a slope;
c) Can not unlock oversized shock-absorbing locking-wheels 140,
to help with moving the canopy when desired; and
d) Can not unlock oversized shock-absorbing locking-wheels 140,
to help with moving the canopy when the canopy is collapsed.

13) No prior art mention or disclose any central-lock popup, having
arthritic-assisting pulley-axles 139.
Therefore, the prior art of central-lock popup:
a) Can not act as a pulley for rope
to lock ropes 136 and all canopies to keep them from slipping;
b) Can not act as a pulley for rope 136,
to decrease the amount of strength needed to erect the canopy; and
c) Can not be used as an axle for oversized shock-absorbing locking-wheels 140,
to allow the oversized shock-absorbing locking-wheels 140 to roll.

14) No prior art mention or disclose any central-lock popup, having
pivoting threaded caster pins 133.
Therefore, the prior art of central-lock popup:
a) Can not allow arthritic-assisting multi-function locking hook-pulley-axle-wheel caster system 132 to rotate on a horizontal axis
to allow moving the canopy on its oversized shock-absorbing locking-wheels 140;
b) Can not allow arthritic-assisting multi-function locking hook-pulley-axle-wheel caster system 132 to rotate freely,
to help with erecting the popup;
c) Can not be used as a foot step,
to help with setup and to drive four lower posts 119 into the ground; and
d) Can not hook ropes 136 on arthritic-assisting wheel-locking spring-loaded rope-loop hooks 134*a* from four lower posts 119,
to strengthen structure and keep four lower posts 119 from bending out.

15) No prior art mention or disclose any central-lock popup, having
arthritic-assisting tapered wedge button 130.
Therefore, the prior art of central-lock popup:
a) Can not release arthritic-assisting self-centering spring-loaded housing-locking hook 126
to unlock arthritic-assisting central-one-push-locking adjustable housing 127
to allow the canopy to be collapsed; and
b) Can not allow persons with arthritis the ability to disengage the arthritic-assisting self-centering spring-loaded housing-locking hook 126 without the use of fingers
to help those with arthritis to collapse canopy with less pain.

16) No prior art mention or disclose any central-lock popup, having
an arthritic-assisting one-person-deploying adjustable-central-canopy adjustable-ring-canopy rollable central-one-push-locking popup.
Therefore, the prior art of central-lock popup:
a) Can not be quick and easy to move just like a luggage with four swiveling wheels;
b) Can not have a quick and easy one-push-lock set up;
c) Can not be securely locked by four wheel locks on four swiveling wheels, respectively;
d) Can not quickly and easily be erected up by one person;
e) Can not quickly and easily be folded down by one person; and
f) Can not quickly and easily be rolled away in any direction by one person
g) Can not quickly and easily be rotated 360 degrees by one person.

OBJECTS AND ADVANTAGES OF THE INVENTION

The present invention substantially departs from the conventional concepts and designs of the prior art. In doing so, the present invention provides an arthritic-assisting one-person-deploying adjustable-central-canopy adjustable-ring-canopy rollable central-one-push-locking popup, having many unique and significant features, functions, and advantages, which overcome all the disadvantages of the prior art, as follows:

1) It is an object of the new invention to provide an arthritic-assisting one-person-deploying adjustable-central-canopy adjustable-ring-canopy rollable central-one-push-locking popup, having
adjustable ring canopy 102 and
adjustable central canopy 122.
Therefore, the arthritic-assisting one-person-deploying adjustable-central-canopy adjustable-ring-canopy rollable central-one-push-locking popup:

a) Can provide shade to occupants,
to prevent sunburn;

b) Can be adjusted up and down to increase airflow into and out of the arthritic-assisting one-person-deploying adjustable-central-canopy adjustable-ring-canopy rollable central-one-push-locking popup,
to keep occupants cool;

c) Can help with airflow out of the arthritic-assisting one-person-deploying adjustable-central-canopy adjustable-ring-canopy rollable central-one-push-locking popup,
to assist in smoke exiting the arthritic-assisting one-person-deploying adjustable-central-canopy adjustable-ring-canopy rollable central-one-push-locking popup; and d) Can provide rain protection,
to keep occupants dry.

2) It is another object of the new invention to provide an arthritic-assisting one-person-deploying adjustable-central-canopy adjustable-ring-canopy rollable central-one-push-locking popup, having
arthritic-assisting central-one-push-locking adjustable housing 127.

Therefore, the one-person-deploying adjustable-central-canopy adjustable-ring-canopy single-central-innersurface-arthritic-assisting rollable one-touch popup:

a) Can snap lock central post 123 to the rest of the canopy structure,
to increase overall strength of the arthritic-assisting one-person-deploying adjustable-central-canopy adjustable-ring-canopy rollable central-one-push-locking popup;

b) Can lock canopy together,
to prevent the arthritic-assisting one-person-deploying adjustable-central-canopy adjustable-ring-canopy rollable central-one-push-locking popup from collapsing; and c) Can decrease the total number of locking points,
to make setup easier.

3) It is another object of the new invention to provide an arthritic-assisting one-person-deploying adjustable-central-canopy adjustable-ring-canopy rollable central-one-push-locking popup, having
oversized shock-absorbing locking-wheels 140.

Therefore, the arthritic-assisting one-person-deploying adjustable-central-canopy adjustable-ring-canopy rollable central-one-push-locking popup:

a) Can be used as pulleys to thread ropes 136,
to tighten canopies;

b) Can be used to roll the arthritic-assisting one-person-deploying adjustable-central-canopy adjustable-ring-canopy rollable central-one-push-locking popup along the ground when in collapsed configuration,
to make transportation easier;

c) Can be used to assist in moving arthritic-assisting one-person-deploying adjustable-central-canopy adjustable-ring-canopy rollable central-one-push-locking popup when fully erected,
to help with relocating the arthritic-assisting one-person-deploying adjustable-central-canopy adjustable-ring-canopy rollable central-one-push-locking popup; and d) Can be used to roll the arthritic-assisting one-person-deploying adjustable-central-canopy adjustable-ring-canopy rollable central-one-push-locking popup on rough and/or uneven terrain
to help with relocating the arthritic-assisting one-person-deploying adjustable-central-canopy adjustable-ring-canopy rollable central-one-push-locking popup in more locations.

4) It is a further object of the new invention to provide an arthritic-assisting one-person-deploying adjustable-central-canopy adjustable-ring-canopy rollable central-one-push-locking popup, having
tick-preventing downward teeth 115.

Therefore, the arthritic-assisting one-person-deploying adjustable-central-canopy adjustable-ring-canopy rollable central-one-push-locking popup:

a) Can prevent ticks from getting inside four upper posts 112 and four lower posts 119,
to protect occupants from disease;

b) Can help protect from weather elements getting up inside four upper posts 112 and four lower posts 119,
to help prevent against rust and increase the lifetime of the arthritic-assisting one-person-deploying adjustable-central-canopy adjustable-ring-canopy rollable central-one-push-locking popup; c) Can assist in water drainage,
to help prevent rusting; and d) Can provide additional structure to four sleeves 114*a*,
to increase strength of four upper posts 112 and four lower posts 119.

5) It is an even further object of the new invention to provide an arthritic-assisting one-person-deploying adjustable-central-canopy adjustable-ring-canopy rollable central-one-push-locking popup, having
post-centering clamps 114*b*.

Therefore, the arthritic-assisting one-person-deploying adjustable-central-canopy adjustable-ring-canopy rollable central-one-push-locking popup:

a) Can center four lower posts 119 within four upper posts 112,
to help with assembly and disassembly;

b) Can help keep ticks from entering into four upper posts 112 and four lower posts 119,
to protect occupants;

c) Can provide addition strength and stability to four upper posts 112 and four lower posts 119,
to keep occupants safe and increase the arthritic-assisting one-person-deploying adjustable-central-canopy adjustable-ring-canopy rollable central-one-push-locking popup's lifetime; and d) Can keep four upper posts 112 and four lower posts 119 from binding
to help with adjusting the arthritic-assisting one-person-deploying adjustable-central-canopy adjustable-ring-canopy rollable central-one-push-locking popup up and down.

6) It is another object of the new invention to provide an arthritic-assisting one-person-deploying adjustable-central-canopy adjustable-ring-canopy rollable central-one-push-locking popup, having
central post 123.

Therefore, the arthritic-assisting one-person-deploying adjustable-central-canopy adjustable-ring-canopy rollable central-one-push-locking popup:

a) Can provide lateral strength to the arthritic-assisting one-person-deploying adjustable-central-canopy adjustable-ring-canopy rollable central-one-push-locking popup, to keep arthritic-assisting one-person-deploying adjustable-central-canopy adjustable-ring-canopy rollable central-one-push-locking popup from radially twisting;

b) Can lock canopy structure together,
to prevent canopy from collapsing; and c) Can decrease the total number of overall locking points,
to make setup easier.

7) It is yet another object of the new invention to provide an arthritic-assisting one-person-deploying adjustable-central-canopy adjustable-ring-canopy rollable central-one-push-locking popup, having
arthritic-assisting self-centering spring-loaded housing-locking hook 126.

Therefore, the arthritic-assisting one-person-deploying adjustable-central-canopy adjustable-ring-canopy rollable central-one-push-locking popup:

a) Can automatically guide central post 123 into arthritic-assisting central-one-push-locking adjustable housing 127,
to help with setup;

b) Can automatically lock and center arthritic-assisting self-centering spring-loaded housing-locking hook 126 to arthritic-assisting central-one-push-locking adjustable housing 127,
to help strengthen popup to withstand twisting and accidental collapsing;

c) Can automatically depress arthritic-assisting self-centering spring-loaded housing-locking hook 126,
to make locking central post 123 easier; and d) Can automatically provide less friction between arthritic-assisting central-one-push-locking adjustable housing 127 and central post 123,
to make setup and adjustment easier.

8) It is still yet another object of the new invention to provide an arthritic-assisting one-person-deploying adjustable-central-canopy adjustable-ring-canopy rollable central-one-push-locking popup, having
water-discharging grooves 116.

Therefore, the arthritic-assisting one-person-deploying adjustable-central-canopy adjustable-ring-canopy rollable central-one-push-locking popup:

a) Can allow water to drain from four upper posts 112 and four lower posts 119,
to prevent four upper posts 112 and four lower posts 119 from rusting;

b) Can prevent water from getting into posts,
to help prolong the life of the arthritic-assisting one-person-deploying adjustable-central-canopy adjustable-ring-canopy rollable central-one-push-locking popup;

c) Can help protect against insects,
to help protect occupants; and d) Can provide addition structure to four sleeves 114*a*,
to increase strength of four upper posts 112 and four lower posts 119.

9) It is still yet an even further object of the new invention to provide an arthritic-assisting one-person-deploying adjustable-central-canopy adjustable-ring-canopy rollable central-one-push-locking popup, having
arthritic-assisting post-height-adjusting spring-loaded rope-loop hooks 117.

Therefore, the arthritic-assisting one-person-deploying adjustable-central-canopy adjustable-ring-canopy rollable central-one-push-locking popup:

a) Can lock and release four post-height-adjusting nipples 118,
to adjust height of the arthritic-assisting one-person-deploying adjustable-central-canopy adjustable-ring-canopy rollable central-one-push-locking popup;

b) Can be used as a hook for rope loop ends 137,
to provide options of setup; and c) Can be used with those who have arthritis to allow pressing without the need to bend fingers,
to make setup for those with arthritis less painful.

10) It is still yet an even further object of the new invention to provide an arthritic-assisting one-person-deploying adjustable-central-canopy adjustable-ring-canopy rollable central-one-push-locking popup, having
four sleeves 114*a*.

Therefore, the arthritic-assisting one-person-deploying adjustable-central-canopy adjustable-ring-canopy rollable central-one-push-locking popup:

a) Can prevent four upper posts 112 and four lower posts 119 from scratching each other
to prevent premature wear or rusting;

b) Can minimize friction between four upper posts 112 and four lower posts 119,
to make raising and lowing easier;

c) Can protect exposed joints of four upper posts 112 and four lower posts 119,
to prevent rusting and increase lifetime; and d) Can join four upper posts 112 and four lower posts 119 together
to provide additional strength and support for posts.

11) It is still yet an even further object of the new invention to provide an arthritic-assisting one-person-deploying adjustable-central-canopy adjustable-ring-canopy rollable central-one-push-locking popup, having
rope-guiding holes 135.

Therefore, the arthritic-assisting one-person-deploying adjustable-central-canopy adjustable-ring-canopy rollable central-one-push-locking popup:

a) Can be used to thread ropes 136 through,
to use with either pulley axle or hooks;

b) Can be used to guide ropes 136 diagonally across arthritic-assisting pulley-axles 139,
to prevent tangling;

c) Can be used as a rope pulley,
to be used with arthritic-assisting pulley-axles 139 and ropes 136; and d) Can be used as a tie-off location for ropes 136,
to increase customization options for ropes 136 and arthritic-assisting pulley-axles 139.

12) It is still yet an even further object of the new invention to provide an arthritic-assisting one-person-deploying adjustable-central-canopy adjustable-ring-canopy rollable central-one-push-locking popup, having
arthritic-assisting wheel-locking spring-loaded rope-loop hooks.

Therefore, the arthritic-assisting one-person-deploying adjustable-central-canopy adjustable-ring-canopy rollable central-one-push-locking popup:

a) Can hook canopy ropes 136 on arthritic-assisting wheel-locking spring-loaded rope-loop hooks 134*a*
to lock ropes 136 and all canopies to keep them from slipping when the popup is set up on a slope;

b) Can lock oversized shock-absorbing locking-wheels 140,
to help keep canopy from moving
when the popup is set up on a slope;

c) Can unlock oversized shock-absorbing locking-wheels 140,
to help with moving the canopy when desired; and
d) Can unlock oversized shock-absorbing locking-wheels 140,
to help with moving the canopy when the canopy is collapsed.

13) It is still yet an even further object of the new invention to provide an arthritic-assisting one-person-deploying adjustable-central-canopy adjustable-ring-canopy rollable central-one-push-locking popup, having arthritic-assisting pulley-axles 139.
Therefore, the arthritic-assisting one-person-deploying adjustable-central-canopy adjustable-ring-canopy rollable central-one-push-locking popup:
a) Can act as a pulley for rope
to lock ropes 136 and all canopies to keep them from slipping;
b) Can act as a pulley for rope 136,
to decrease the amount of strength needed to erect the canopy; and
c) Can be used as an axle for oversized shock-absorbing locking-wheels 140,
to allow the oversized shock-absorbing locking-wheels 140 to roll.

14) It is still yet an even further object of the new invention to provide an arthritic-assisting one-person-deploying adjustable-central-canopy adjustable-ring-canopy rollable central-one-push-locking popup, having pivoting threaded caster pins 133.
Therefore, the arthritic-assisting one-person-deploying adjustable-central-canopy adjustable-ring-canopy rollable central-one-push-locking popup:
a) Can allow arthritic-assisting multi-function locking hook-pulley-axle-wheel caster system 132 to rotate on a horizontal axis
to allow moving the canopy on its oversized shock-absorbing locking-wheels 140;
b) Can allow arthritic-assisting multi-function locking hook-pulley-axle-wheel caster system 132 to rotate freely,
to help with erecting the popup;
c) Can be used as a foot step,
to help with setup and to drive four lower posts 119 into the ground; and
d) Can hook ropes 136 on arthritic-assisting wheel-locking spring-loaded rope-loop hooks 134*a* from four lower posts 119,
to strengthen structure and keep four lower posts 119 from bending out.

15) It is still yet an even further object of the new invention to provide an arthritic-assisting one-person-deploying adjustable-central-canopy adjustable-ring-canopy rollable central-one-push-locking popup, having arthritic-assisting tapered wedge button 130.
Therefore, the arthritic-assisting one-person-deploying adjustable-central-canopy adjustable-ring-canopy rollable central-one-push-locking popup:
a) Can release arthritic-assisting self-centering spring-loaded housing-locking hook 126
to unlock arthritic-assisting central-one-push-locking adjustable housing 127
to allow the canopy to be collapsed; and
b) Can allow persons with arthritis the ability to disengage the arthritic-assisting self-centering spring-loaded housing-locking hook 126 without the use of fingers
to help those with arthritis to collapse canopy with less pain.

16) It is still yet an even further object of the new invention to provide an arthritic-assisting one-person-deploying adjustable-central-canopy adjustable-ring-canopy rollable central-one-push-locking popup
Therefore, the arthritic-assisting one-person-deploying adjustable-central-canopy adjustable-ring-canopy rollable central-one-push-locking popup:
a) Can be quick and easy to move just like a luggage with four swiveling wheels;
b) Can have a quick and easy one-push-lock set up;
c) Can be securely locked by four wheel locks on four swiveling wheels, respectively;
d) Can quickly and easily be erected up by one person;
e) Can quickly and easily be folded down by one person; and
f) Can quickly and easily be rolled away in any direction by one person
g) Can quickly and easily be rotated 360 degrees by one person.

Other objects and advantages of the present invention will become apparent from a consideration of the accompanying drawings and ensuing description.

SUMMARY OF THE INVENTION

An arthritic-assisting one-person-deploying adjustable-central-canopy adjustable-ring-canopy rollable central-one-push-locking popup comprises: an adjustable ring canopy, a central intersector, a plurality of foldable top trusses are respectively and pivotably bolted to the central intersector, and are respectively attached to the adjustable ring canopy, a plurality of top-truss connectors respectively and pivotably are bolted to the foldable top trusses, a plurality of foldable corner trusses respectively and pivotably are bolted to the foldable top trusses, a plurality of foldable side trusses, four upper corner intersectors respectively and pivotably are bolted to the foldable top trusses, and respectively and pivotably are bolted to the foldable side trusses, four upper posts respectively are attached to the four upper corner intersectors, four lower corner intersectors respectively are slid on the four upper posts, respectively bolted to the foldable corner trusses, respectively bolted to the foldable side trusses, and the intersector holes respectively are molded in the four lower corner intersectors, four sleeves respectively are slid on the upper-post bottom ends of the four upper posts, four arthritic-assisting post-height-adjusting spring-loaded rope-loop hooks respectively and pivotably are attached to the four sleeves, four post-height-adjusting nipples respectively are molded to the arthritic-assisting post-height-adjusting spring-loaded rope-loop hooks, four lower posts respectively and slidably are inserted inside the four upper posts, a plurality of post-height-adjusting holes respectively are drilled in the four upper posts and the four lower posts, an adjustable central canopy, a central post is attached to the central intersector, a central-post hole is formed in the central post, a central-innersurface-locking spring is inserted inside the central post, an arthritic-assisting self-centering spring-loaded housing-locking hook is pivotably riveted inside the central post, an arthritic-assisting central-one-push-locking adjustable housing is adjustably and slidably locked on and unlocked from the central post for snap-locking on and off the arthritic-assisting self-centering spring-loaded housing-locking hook when the arthritic-assisting central-one-push-locking adjustable housing slides up and down the central post and for locking and unlocking the central post to and from the arthritic-assisting central-one-push-locking adjustable housing and for locking and unlocking the popup after the popup is folded or unfolded, and for allowing the popup to be folded and unfolded by a single person when the arthritic-assisting central-one-push-locking adjustable housing is pushed upward to push the four upper posts outward to lock the four upper posts in position, a lead-in funnel is molded to the housing end of the arthritic-assisting central-one-push-locking adjustable housing, a button tunnel is molded from the outer surface to the inner surface of the arthritic-assisting central-one-push-locking adjustable housing, an arthritic-assisting tapered wedge button is snapped into the button tunnel is for pushing the arthritic-assisting self-centering spring-loaded housing-locking hook out of the button tunnel and for allowing an arthritic the ability to push to disengage the arthritic-assisting self-centering spring-loaded housing-locking hook from the central post without the need to fold his fingers, a plurality of foldable adjustable central trusses respectively and pivotably are bolted to the foldable top trusses, respectively and pivotably are bolted to the arthritic-assisting central-one-push-locking adjustable housing, and respectively are attached to the adjustable central canopy, a plurality of pivoting threaded caster pins respectively and threadedly are attached into the lower-post bottom ends of the four lower posts, a plurality of wheel-locking hooks respectively and pivotably are connected to the pulley-axel-and-locking-wheel braces, a plurality of pulley-axel-and-locking-wheel braces, the wheel-locking hooks respectively and pivotably are connected to the pulley-axel-and-locking-wheel braces, the pulley-axel-and-locking-wheel braces respectively are attached to the pivoting threaded caster pins for allowing an arthritic to move the popup in any direction when the popup is collapsed or deployed without the need to fold his fingers, a plurality of wheel gears, a plurality of peg springs, a plurality of gear-locking pegs, a plurality of arthritic-assisting pulley-axles respectively and rotatably are attached to and between the pulley-axel-and-locking-wheel braces for functioning as pulley to wrap the ropes thereon to reduce rope-pulling forces needed to pull on the ropes to stretch the adjustable ring canopy and for functioning as an axle to rotatably attach the shock-absorbing locking-wheels thereon, a plurality of shock-absorbing locking-wheels respectively and rotatably are attached to the arthritic-assisting pulley-axles for functioning as wheel to allow the popup to be rolled along the ground or a surface for transportation and storage and for functioning as wheel to allow the popup to be rolled along a sandy surface and for functioning as wheel to allow the popup to be rolled upon rough or uneven terrain. The wheel gears respectively are molded to the shock-absorbing locking-wheels for locking the gear-locking pegs in between, the peg springs, respectively are slid on the gear-locking pegs for pushing the gear-locking pegs away from the wheel gears, the gear-locking pegs respectively and pivotably are attached to the pulley-axle-and-locking-wheel braces for pushing in between the wheel gears to lock the wheel gears in place, the arthritic-assisting wheel-locking spring-loaded rope-loop hooks for locking the shock-absorbing locking-wheels to prevent the shock-absorbing locking-wheels from rolling when desired.

BRIEF DESCRIPTION OF THE DRAWINGS

FIG. 1H and FIG. 1I illustrate perspective and cross-sectional views of the arthritic-assisting central-one-push-locking adjustable housing, arthritic-assisting self-centering spring-loaded housing-locking hook, and other related components.

DETAILED DESCRIPTION OF THE INVENTION

Figure 1A:
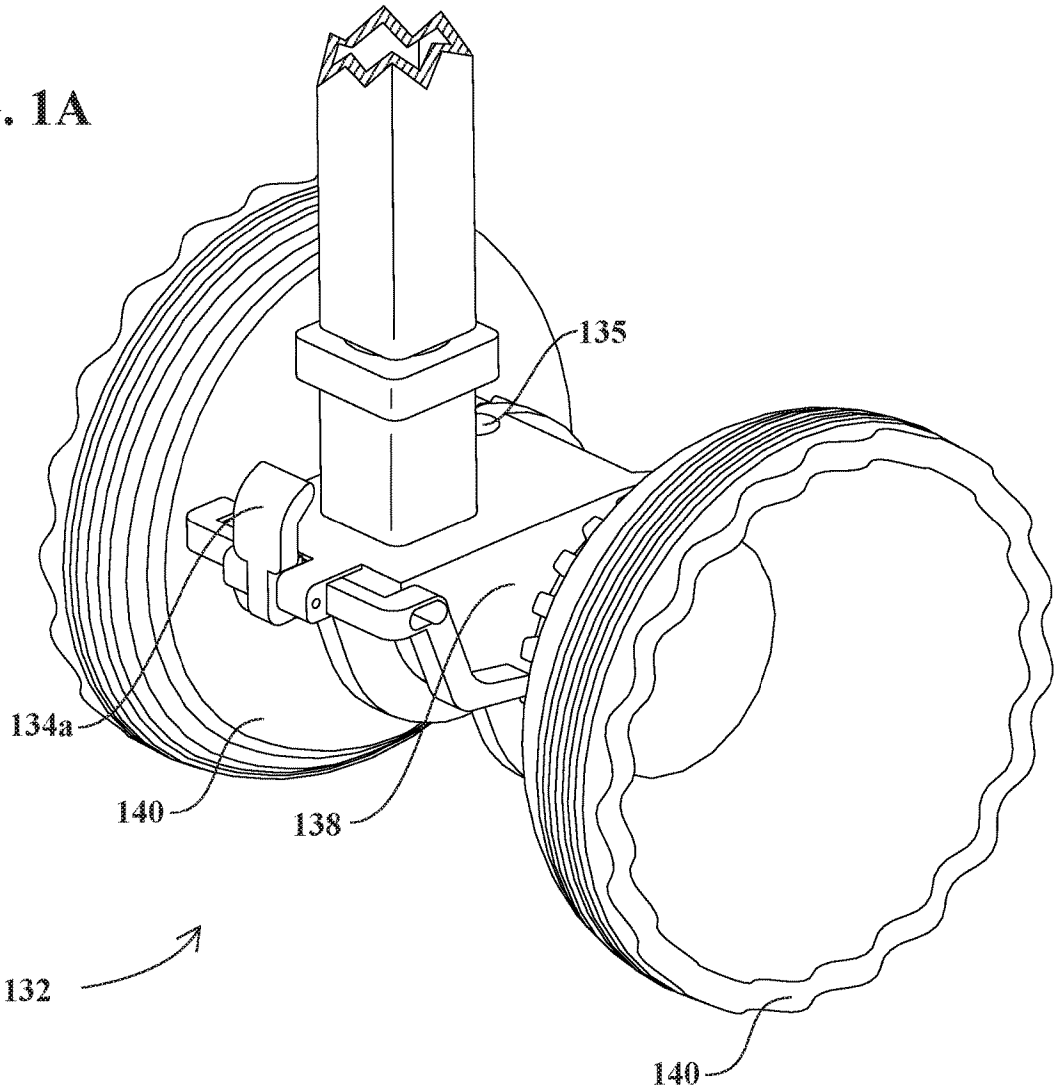
FIG. 1A, FIG. 1B, FIG. 1C, FIG. 1D, and FIG. 1E illustrate front, back, top and perspective views of the assembly of the arthritic-assisting multi-function hook-pulley-axel-wheel caster system.
Figure 1B:
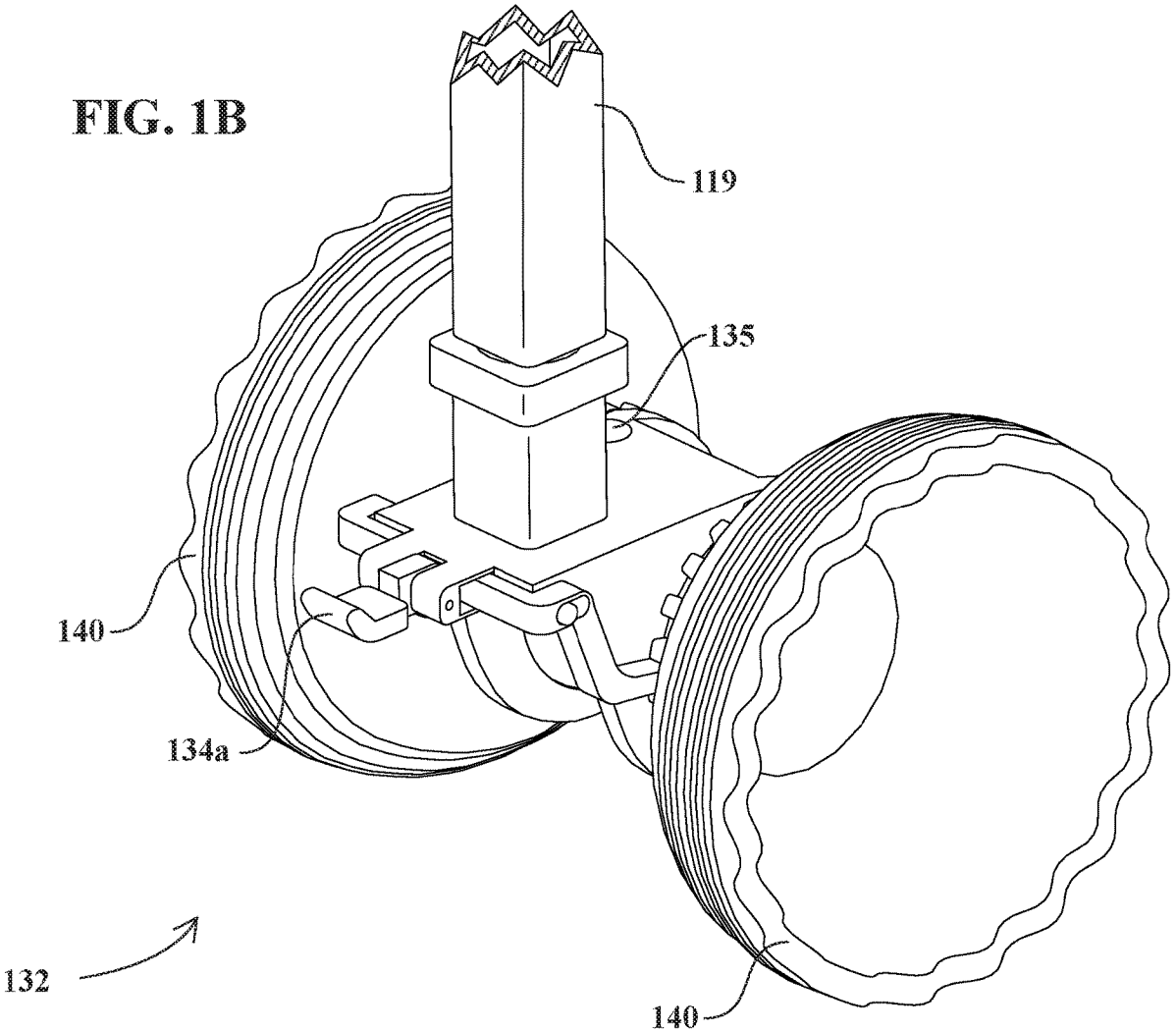
Figure 1D:
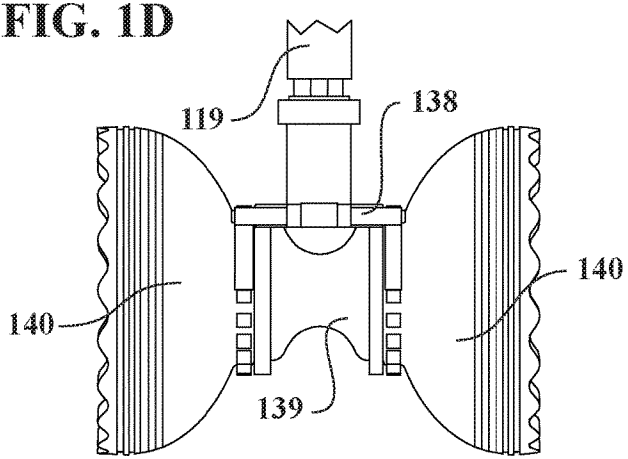
Figure 1C:
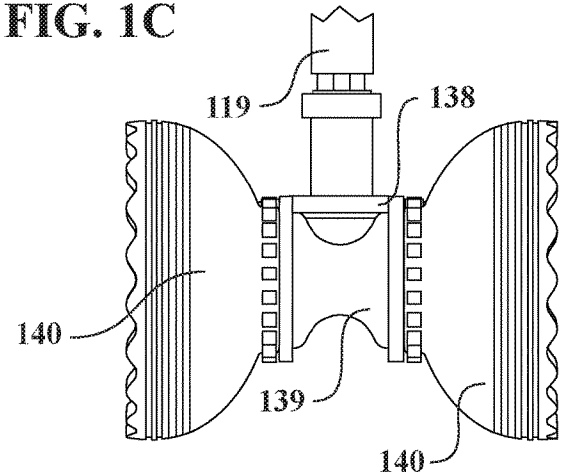
Figure 1E:
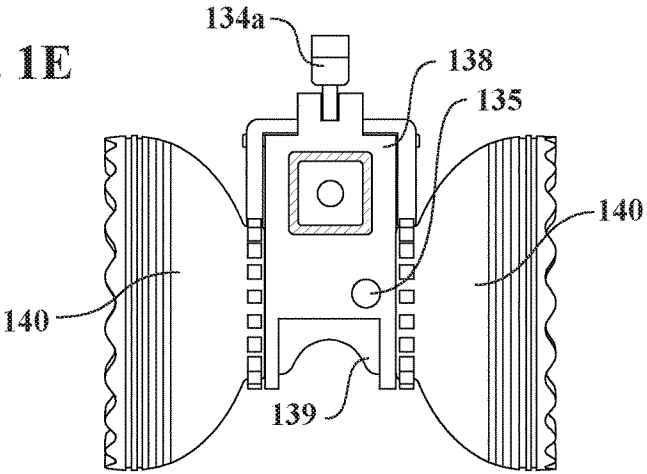
Figure 1F:
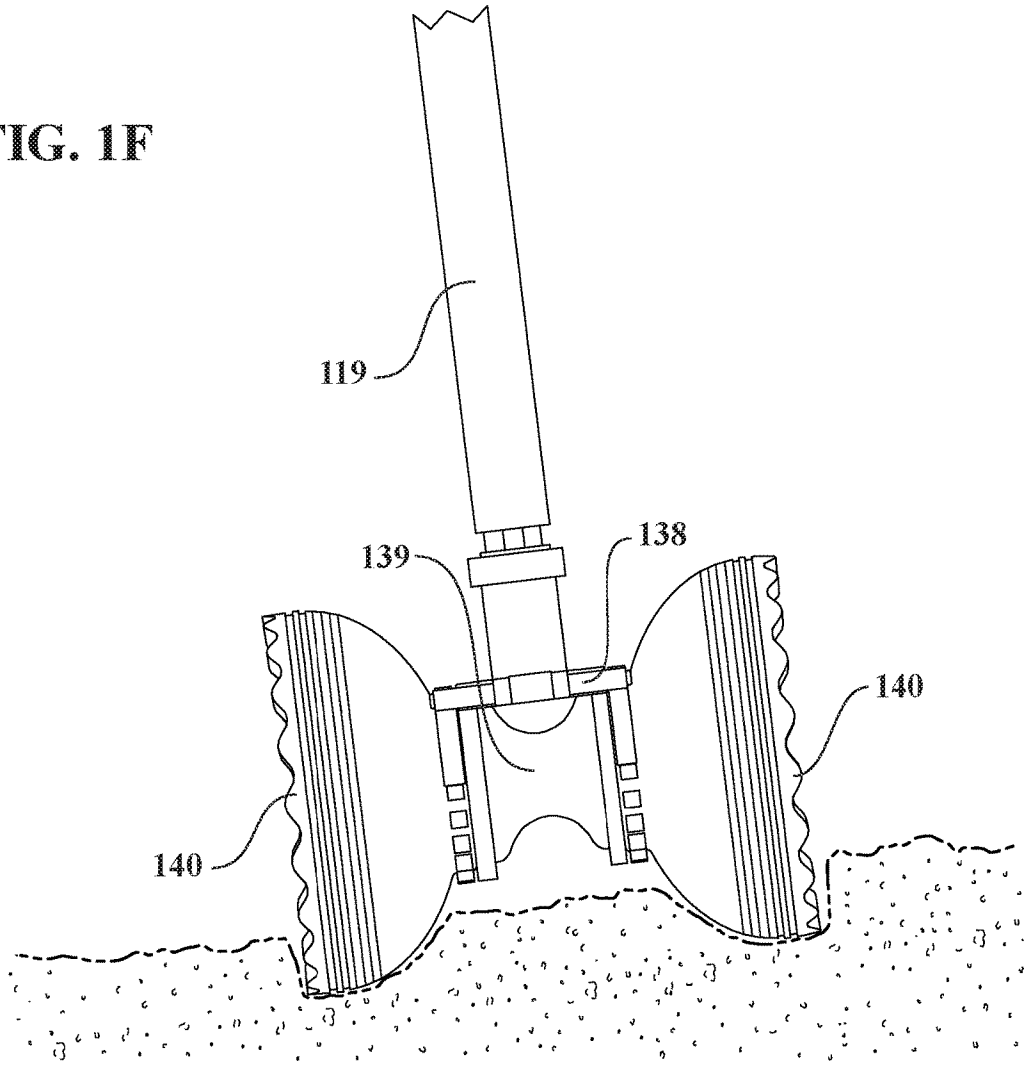
FIG. 1F and FIG. 1G illustrate front views demonstrating the assembly of the arthritic-assisting one-person-deploying adjustable-central-canopy adjustable-ring-canopy rollable central-one-push-locking popup can be used on uneven or rough terrain.
Figure 1G:
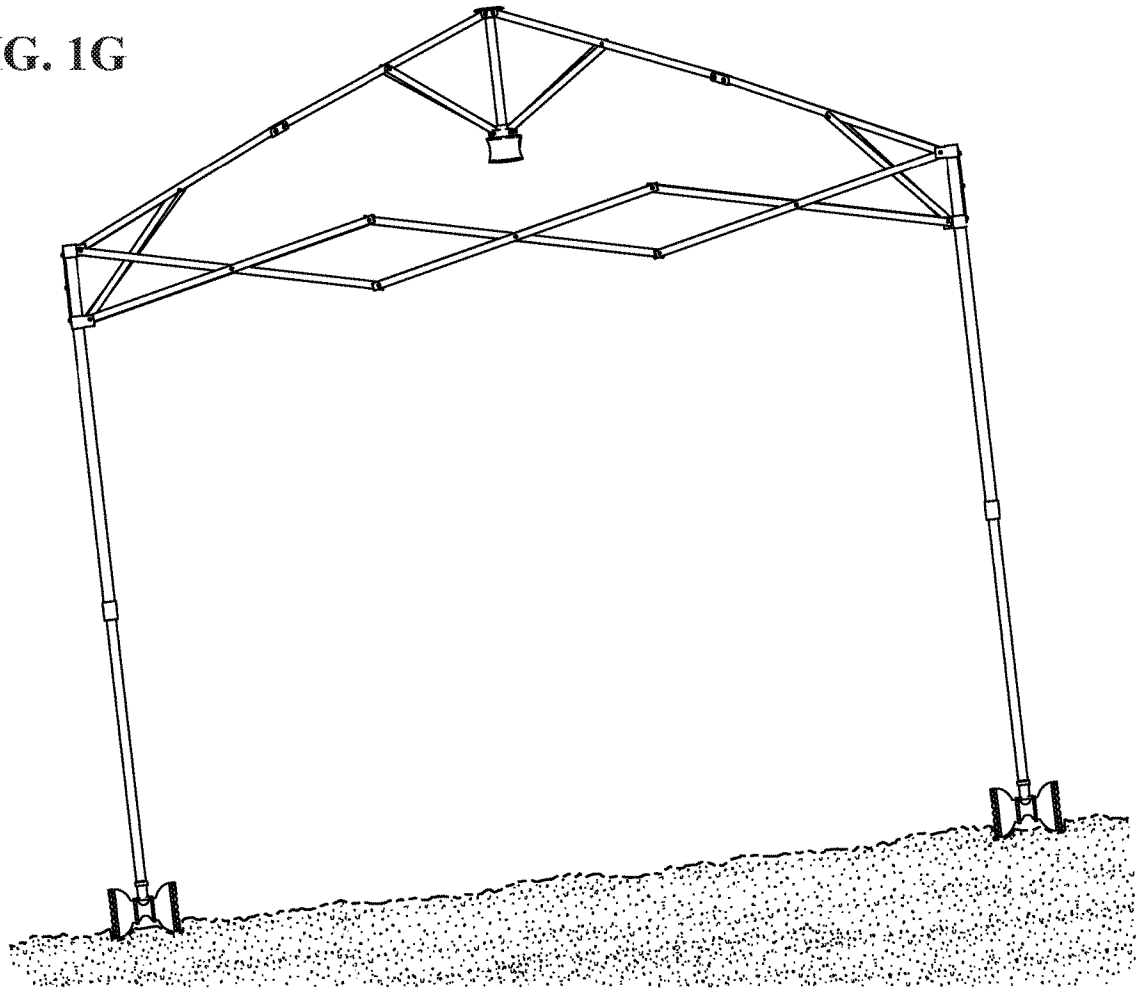
Figure 1H:
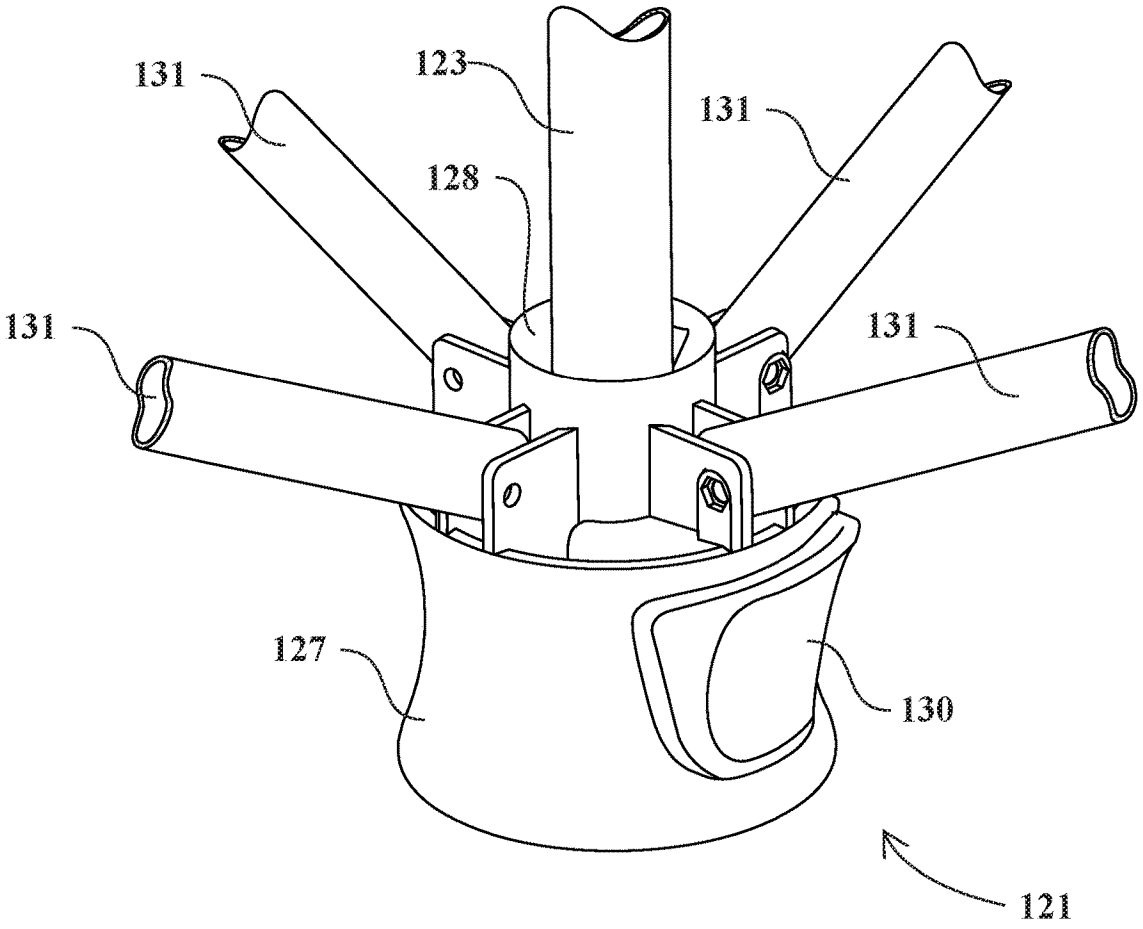
Figure 11:
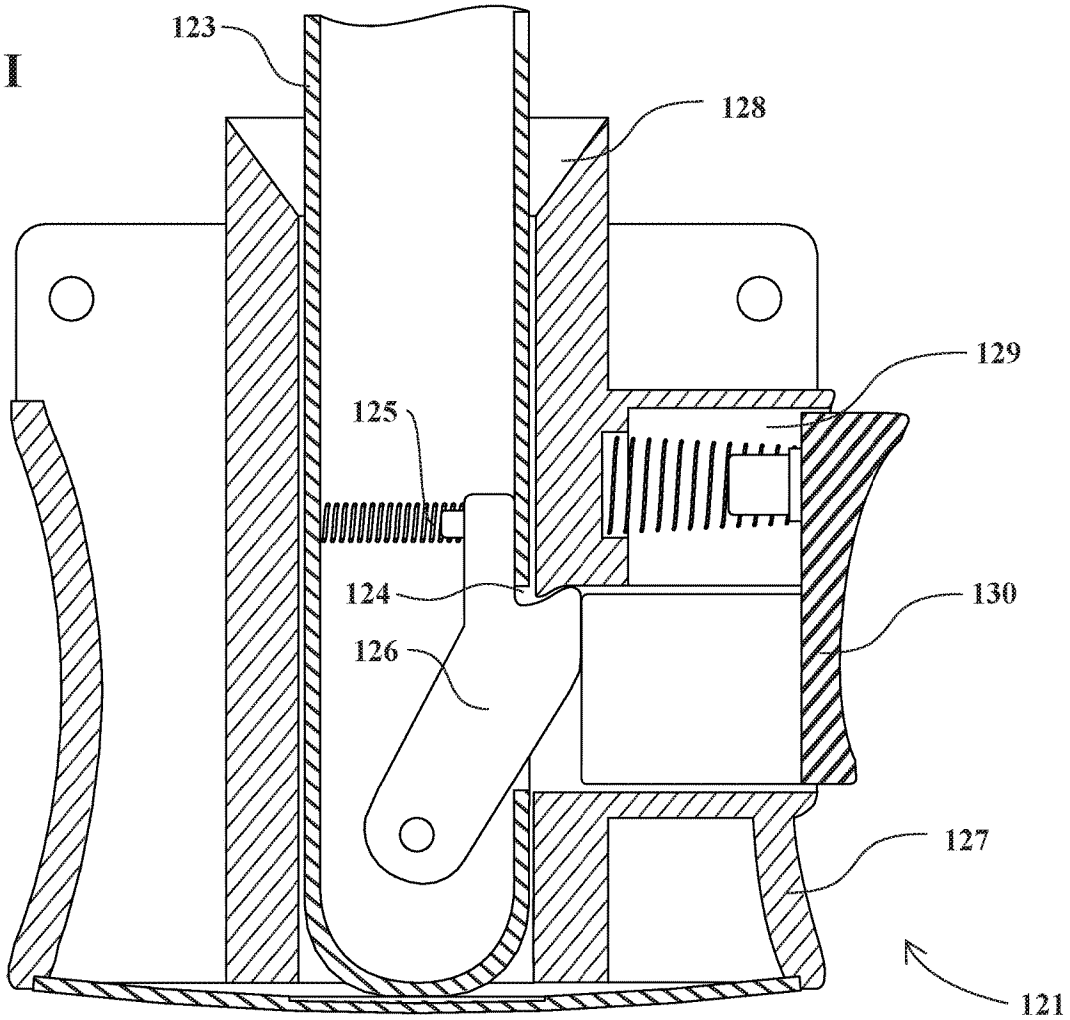
FIG. 10A, FIG. 10B, FIG. 11A, FIG. 11B, and FIG. 11C illustrate front, back, top and perspective views of the assembly of the arthritic-assisting multi-function locking hook-pulley-axle-wheel caster system.
Figure 1J:
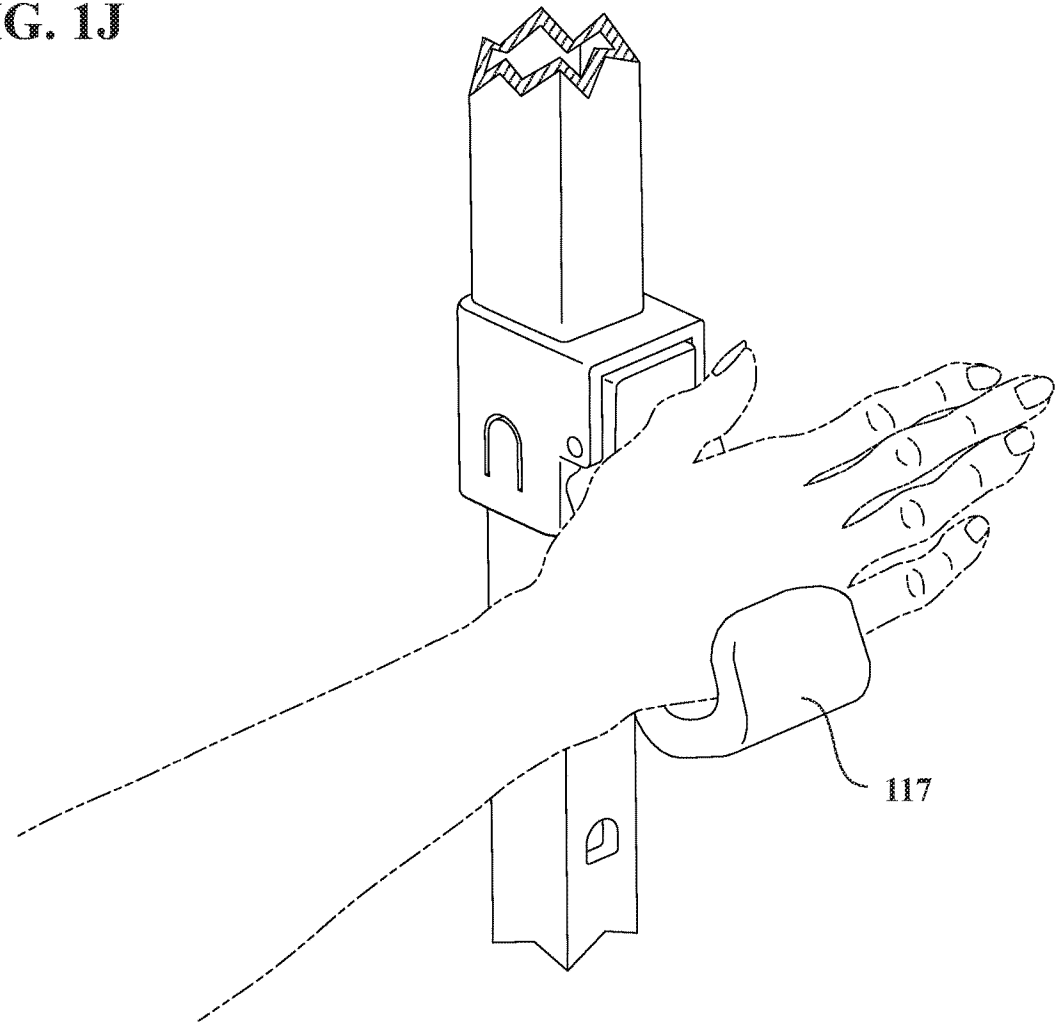
FIG. 1J illustrates a perspective view of how an arthritic individual can operate the arthritic-assisting post-height-adjusting spring-loaded rope-loop hooks.
Figure 1K:
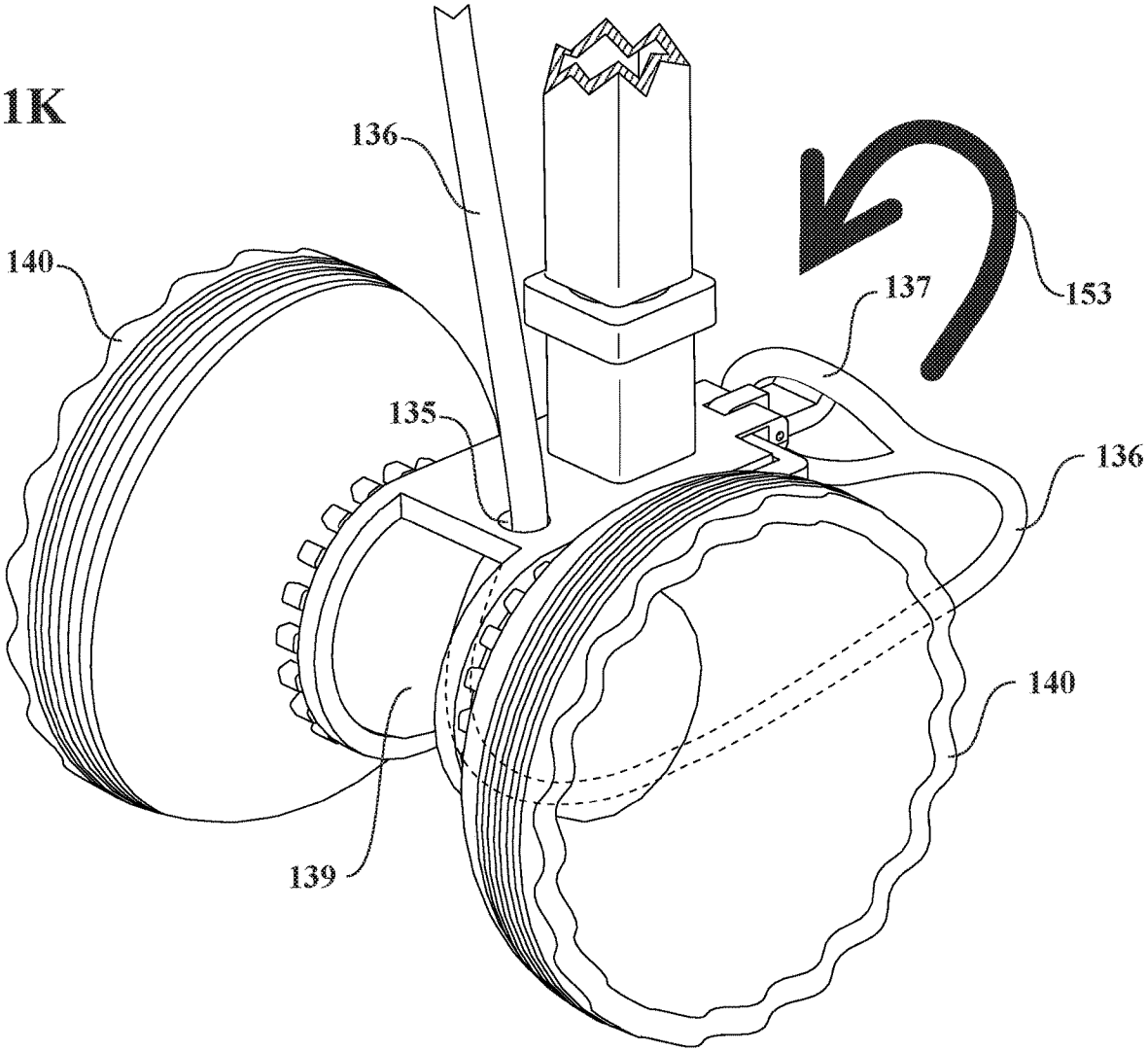
FIG. 1K and FIG. 1L illustrate perspective views demonstrating how ropes and rope loop ends are attached to arthritic-assisting wheel-locking spring-loaded rope-loop hooks and arthritic-assisting post-height-adjusting spring-loaded rope-loop hooks, respectively.
Figure 1L:
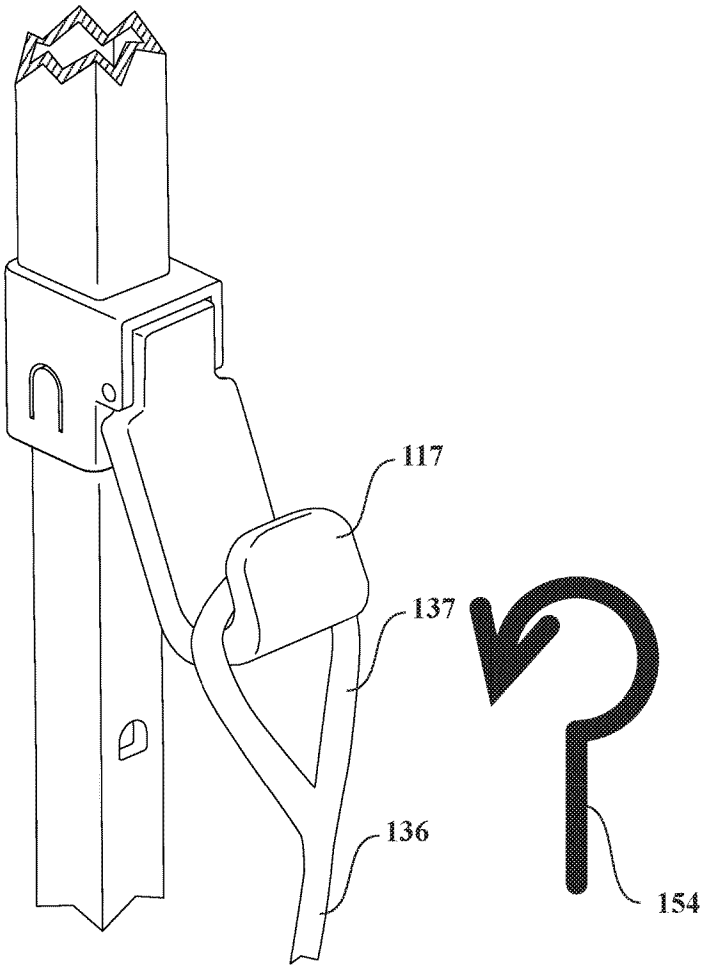
Figure 1M:
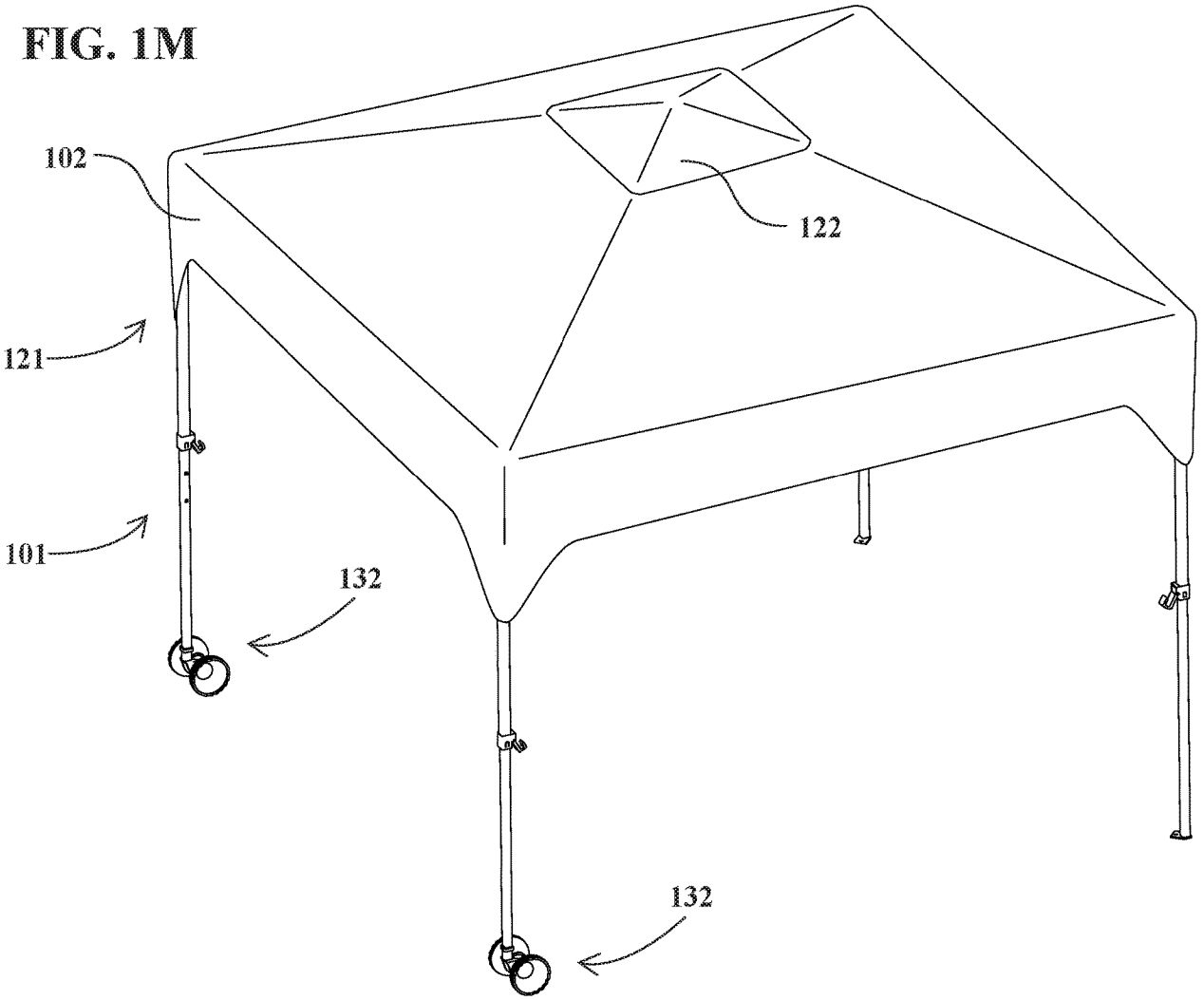
FIG. 1M, FIG. 1N, FIG. 2A, FIG. 2B, FIG. 3A, FIG. 3B, and FIG. 4 illustrate front and perspective views of the arthritic-assisting one-person-deploying adjustable-central-canopy adjustable-ring-canopy rollable central-one-push-locking popup.
Figure 1N:
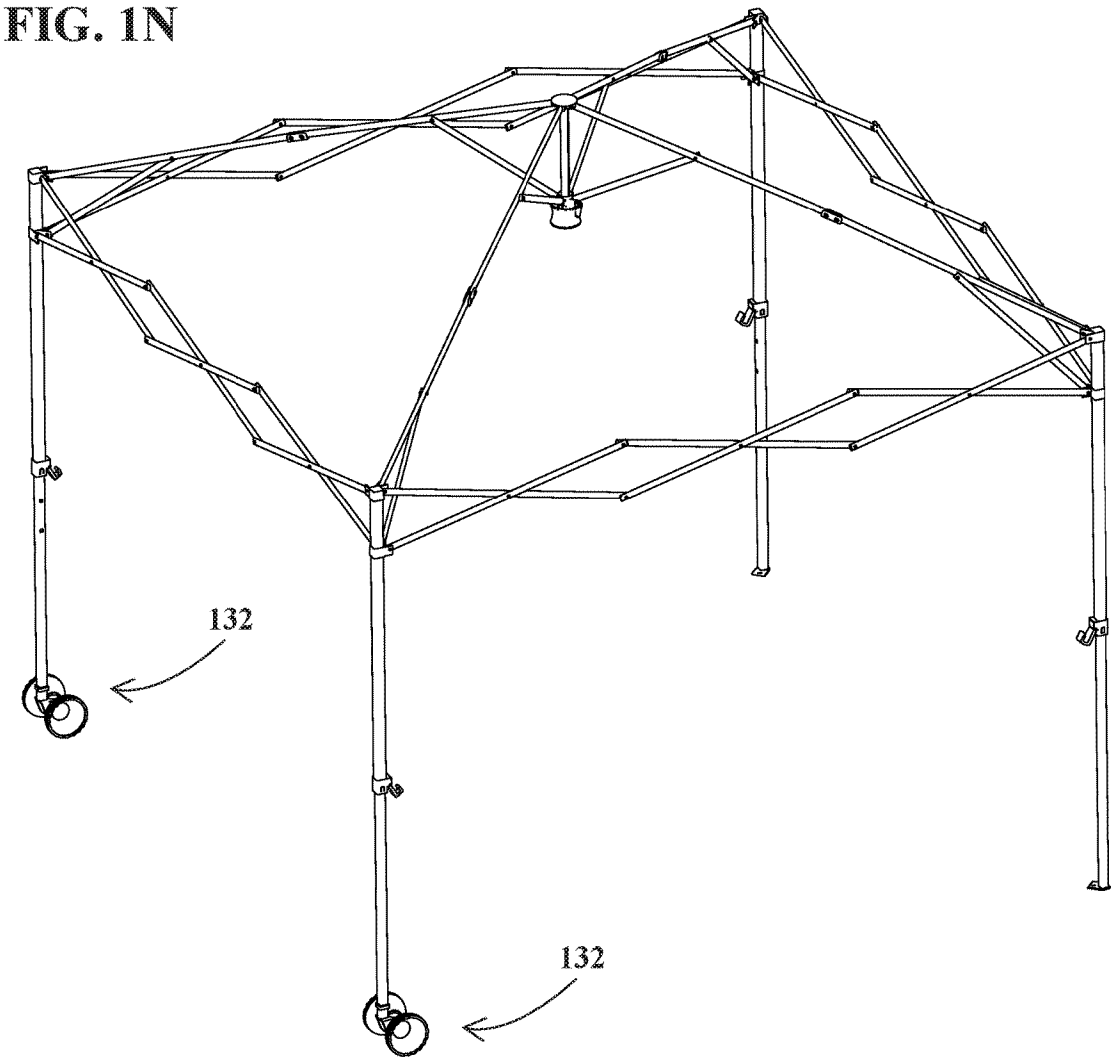
Figure 2A:
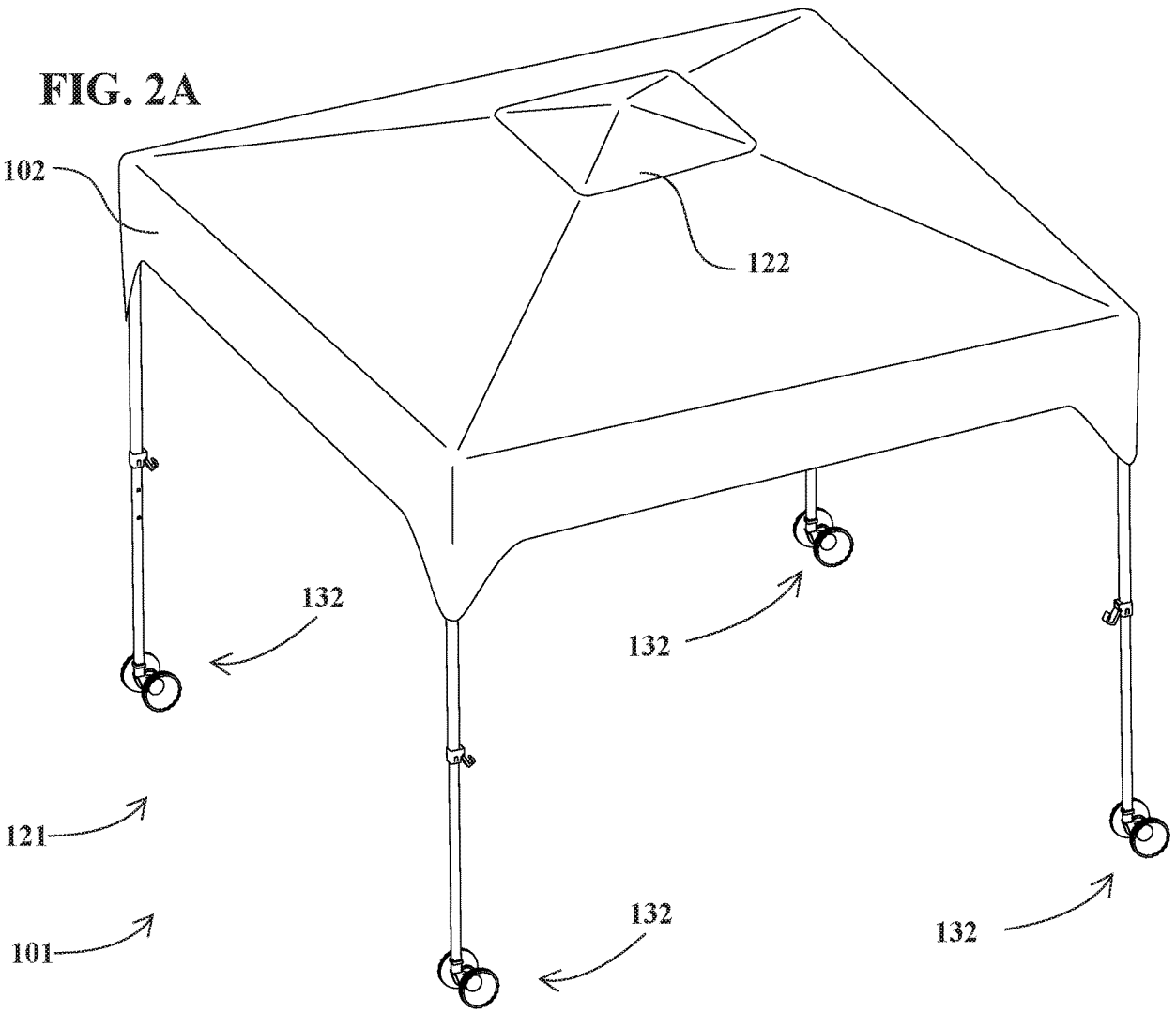
Figure 2B:
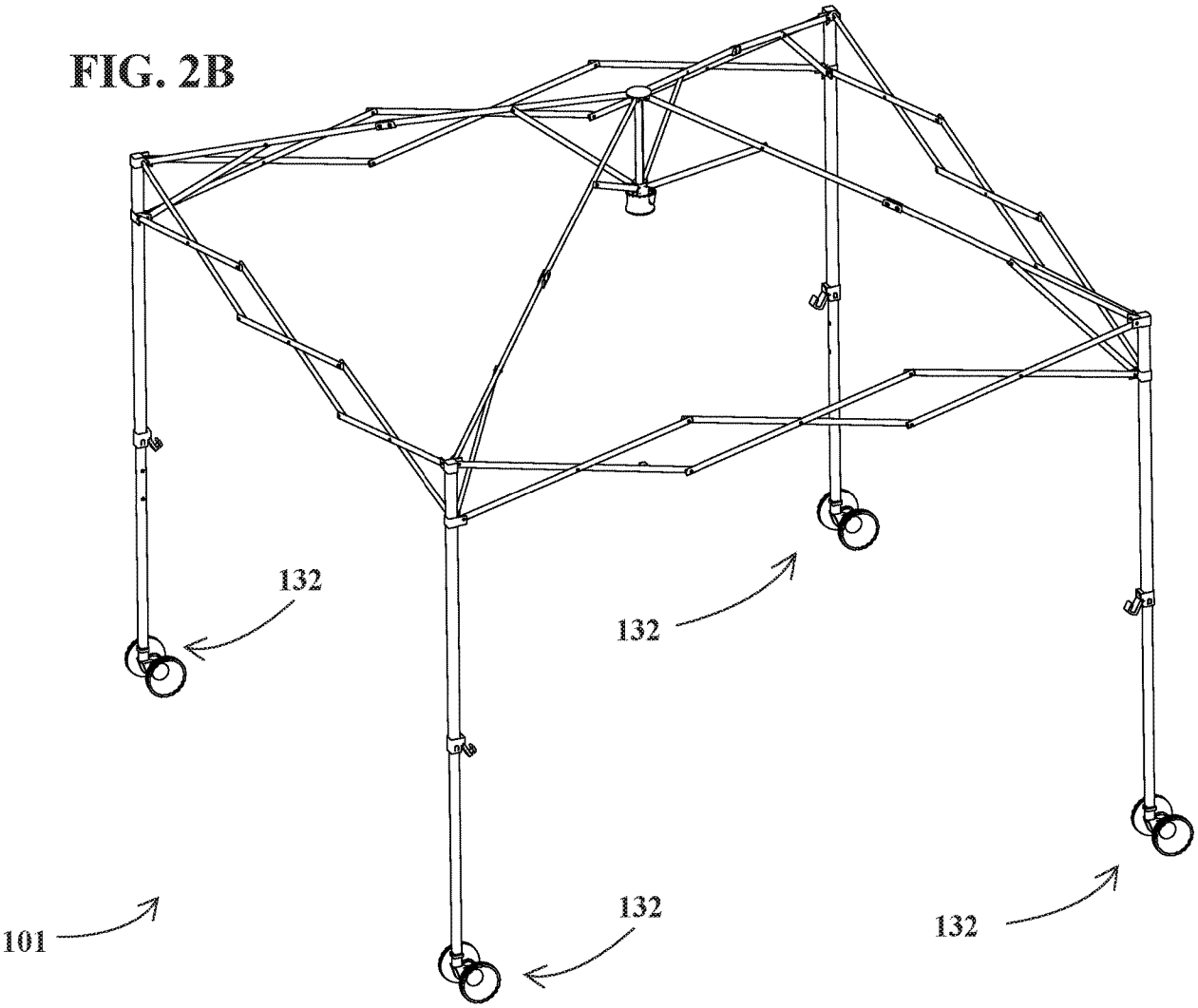
Figure 3A:
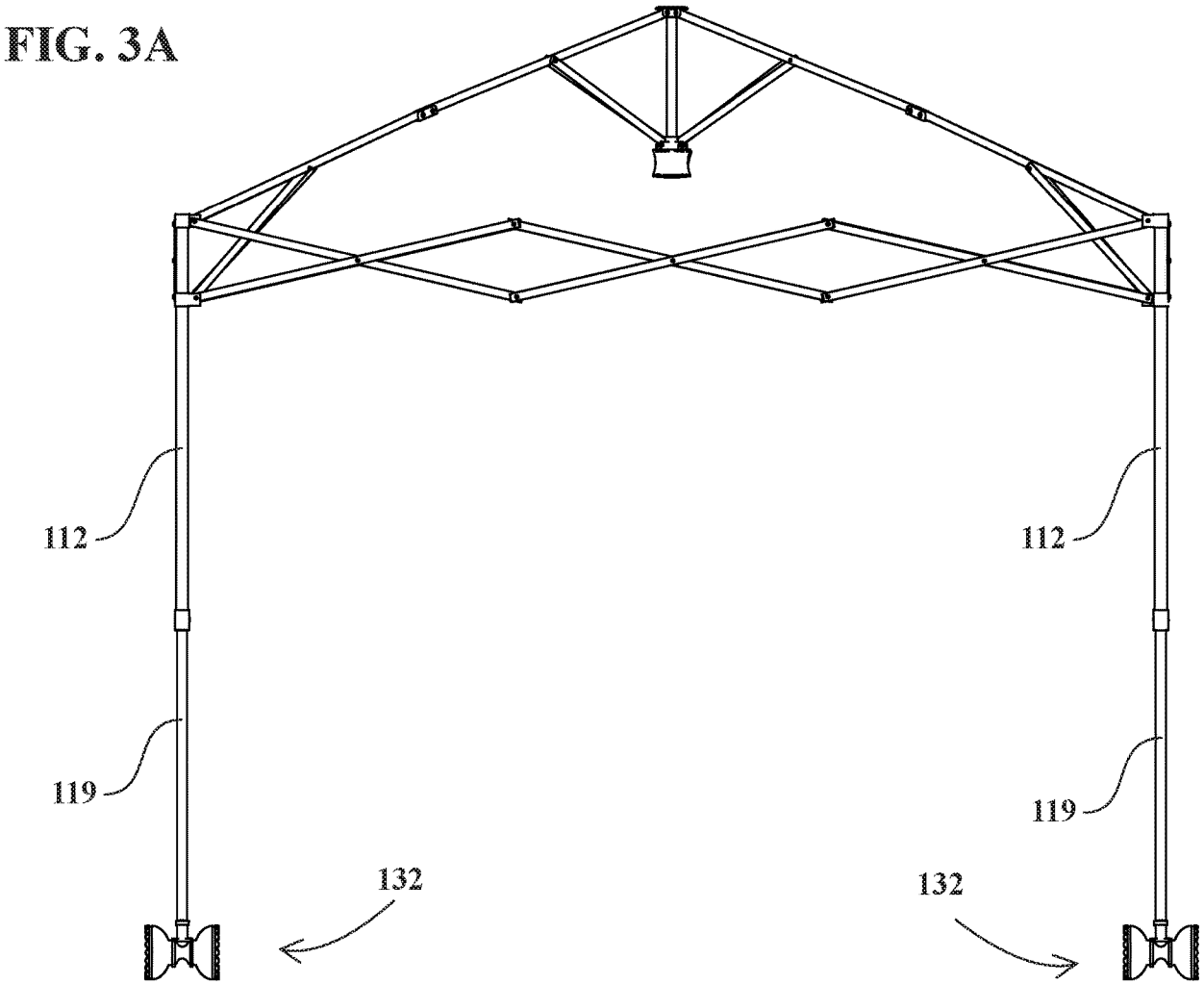
Figure 3B:
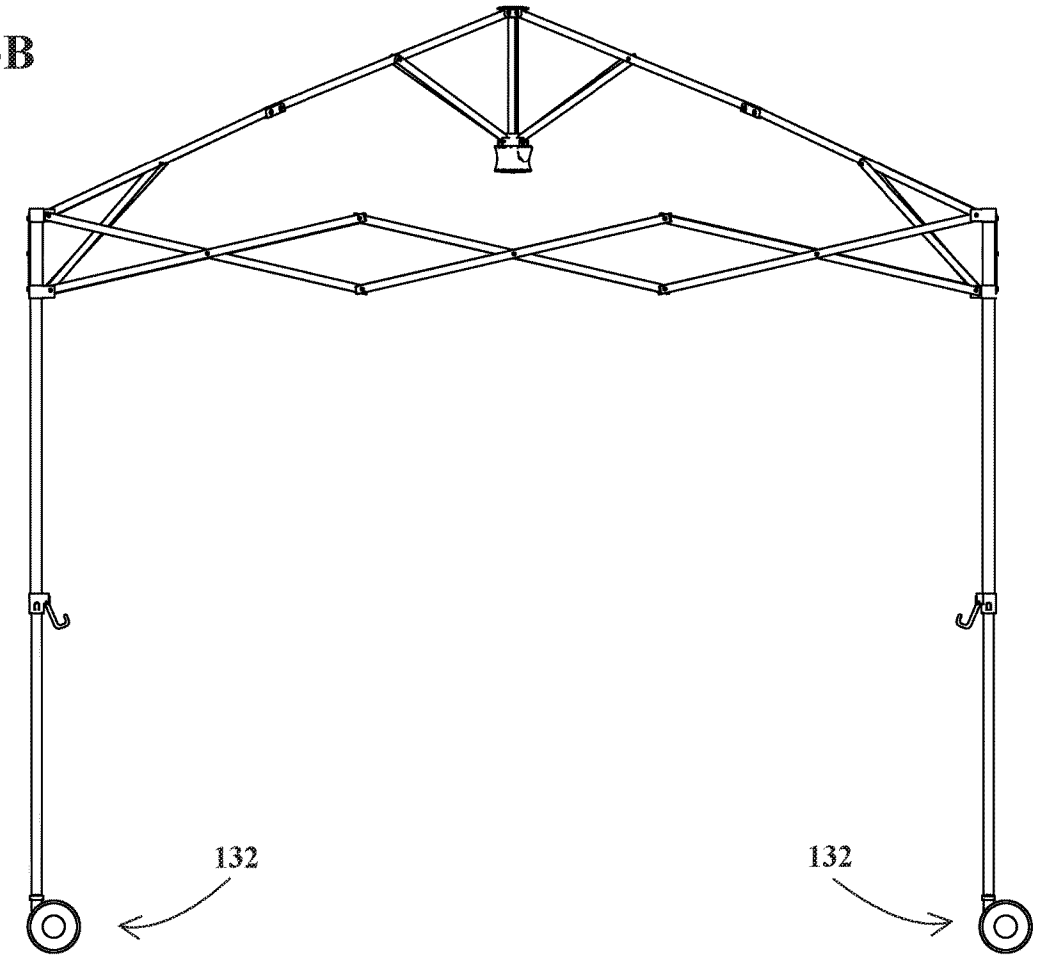
Figure 4:
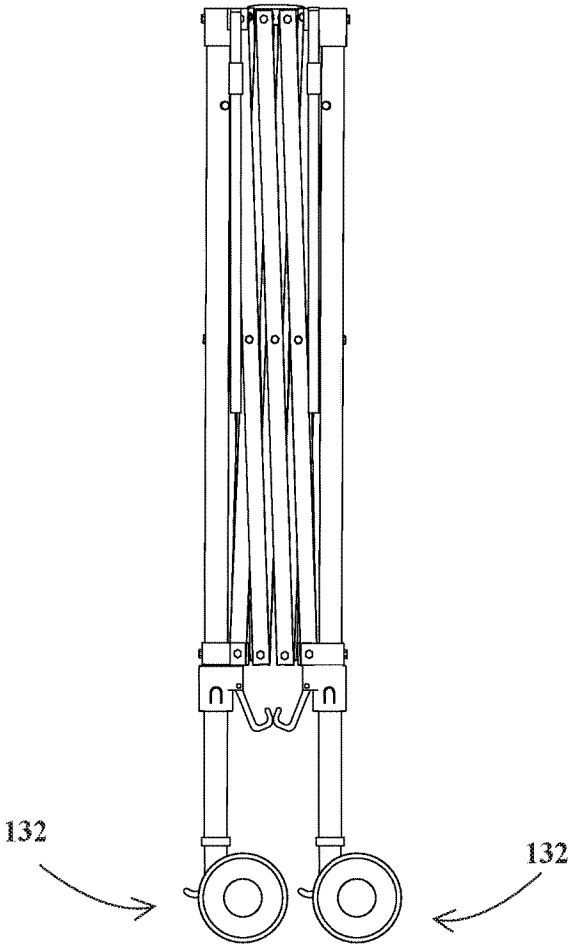
Figure 5A:
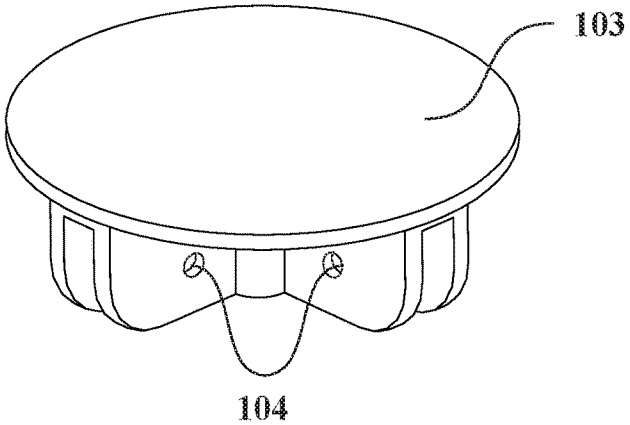
FIG. 5A, FIG. 5B, FIG. 5C, FIG. 6A, FIG. 6B, FIG. 6C, and FIG. 7 illustrate front and perspective views of various components used to assemble frame of the arthritic-assisting one-person-deploying adjustable-central-canopy adjustable-ring-canopy rollable central-one-push-locking popup.
Figure 5B:
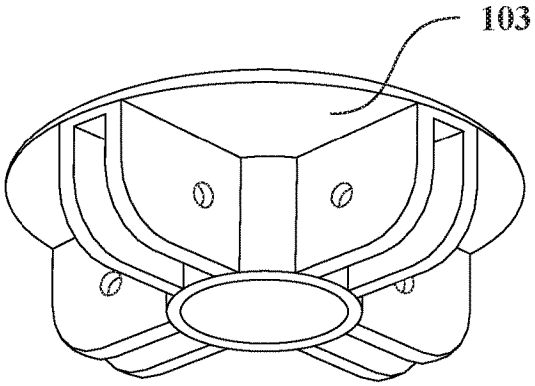
Figure 5C:
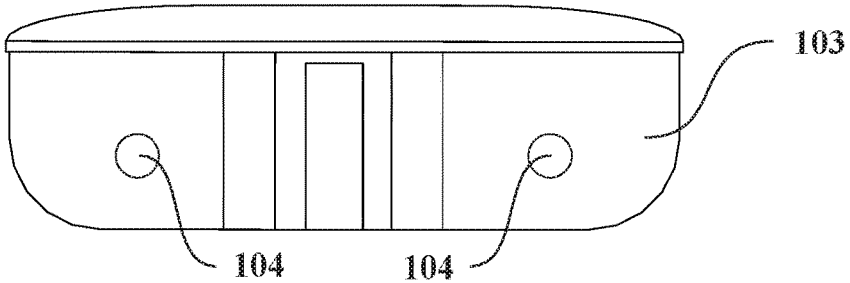
Figure 6A:
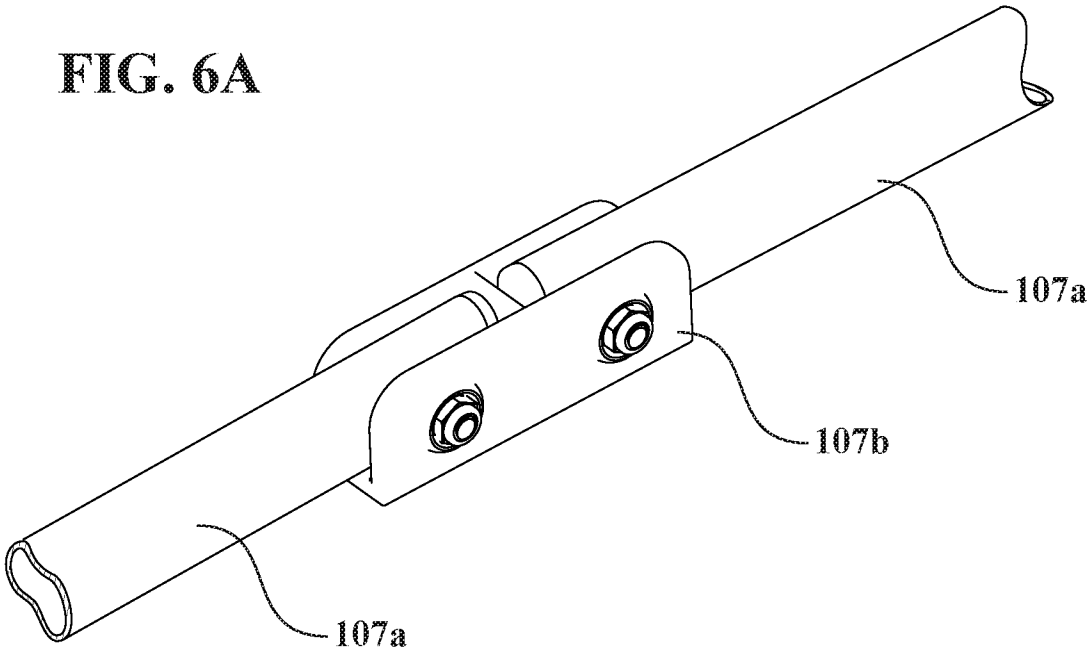
Figure 6B:
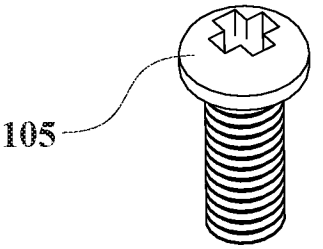
Figure 6C:
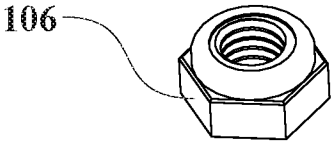
Figure 7:
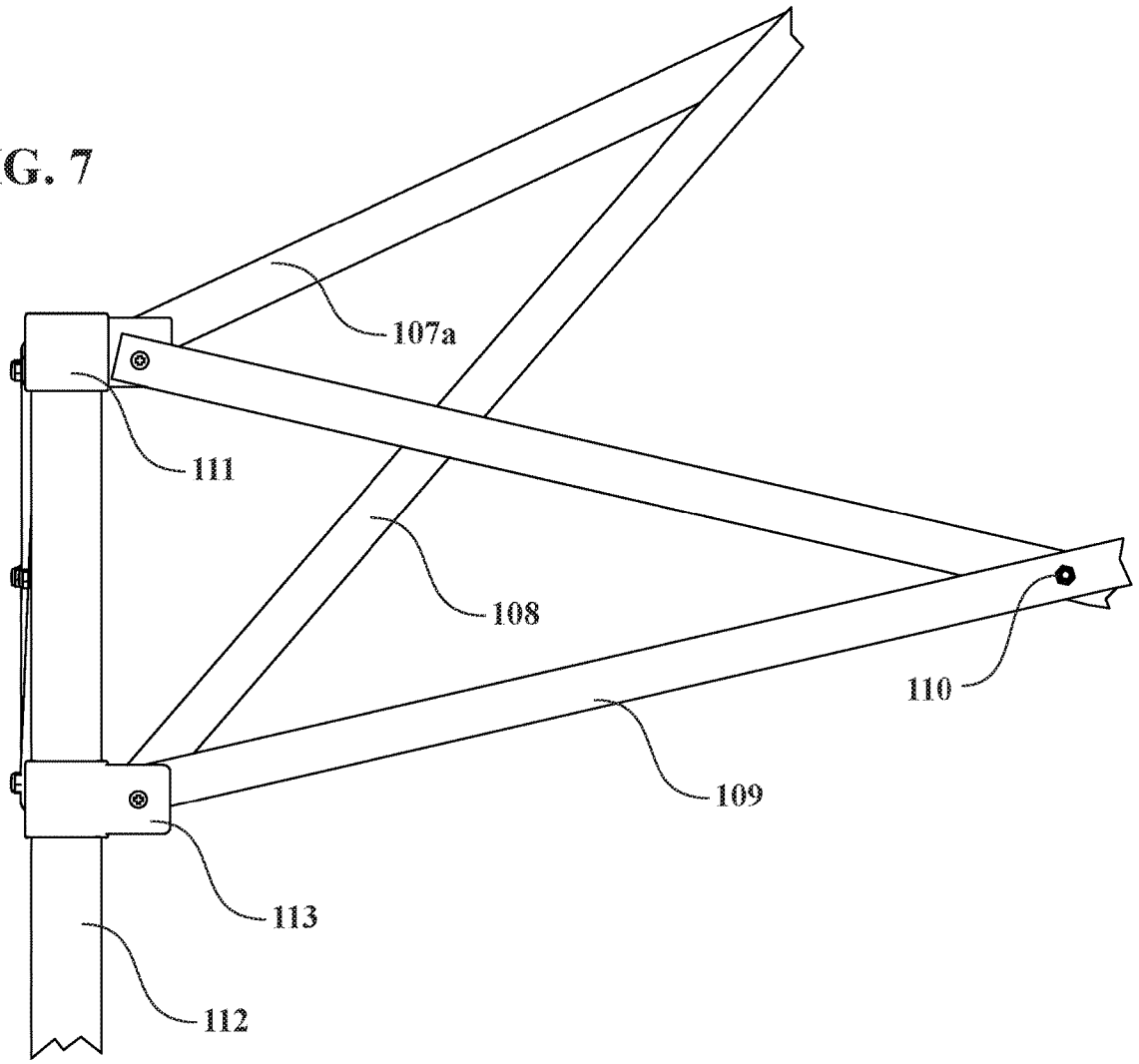
Figure 8A:
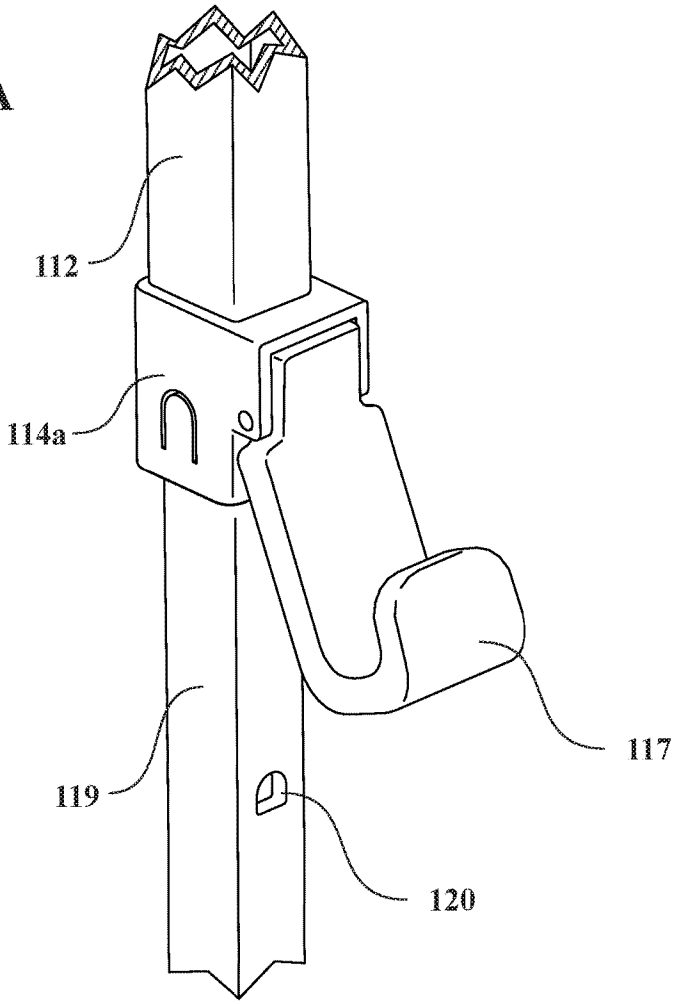
FIG. 8A, FIG. 8B, and FIG. 8C illustrate front, side and perspective views of arthritic-assisting post-height-adjusting spring-loaded rope-loop hooks.
Figure 8C:
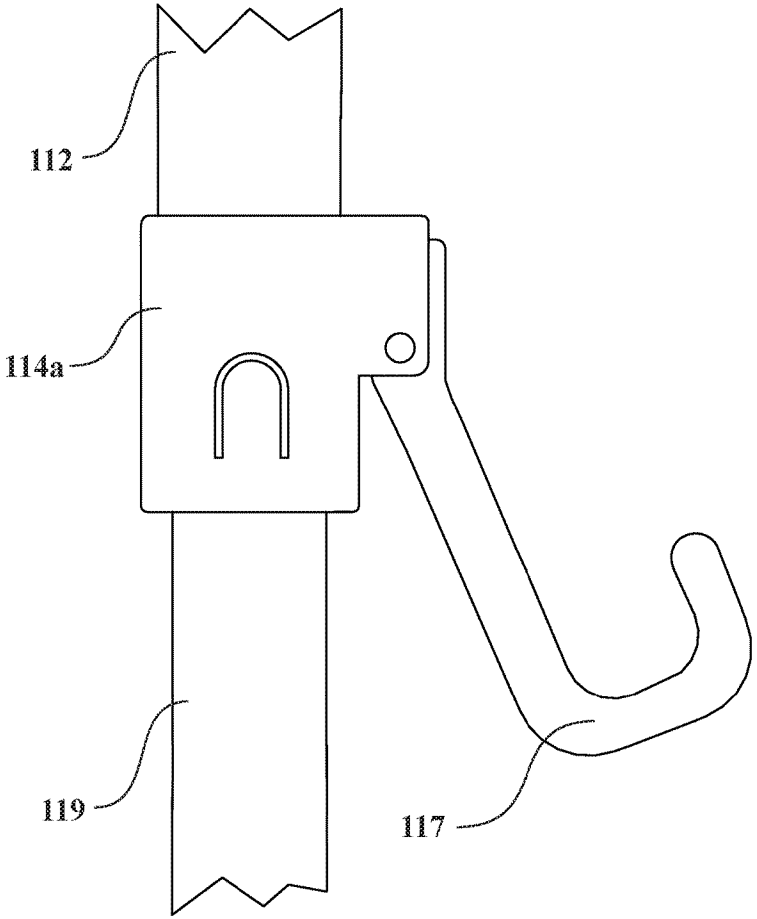
Figure 8B:
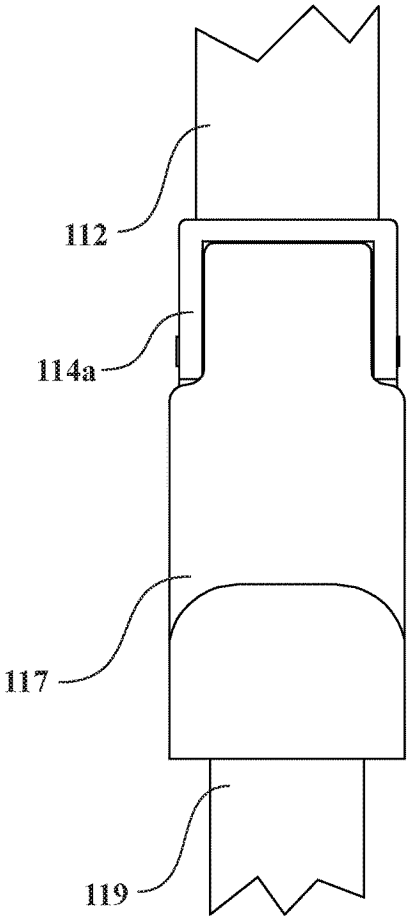
Figure 8D:
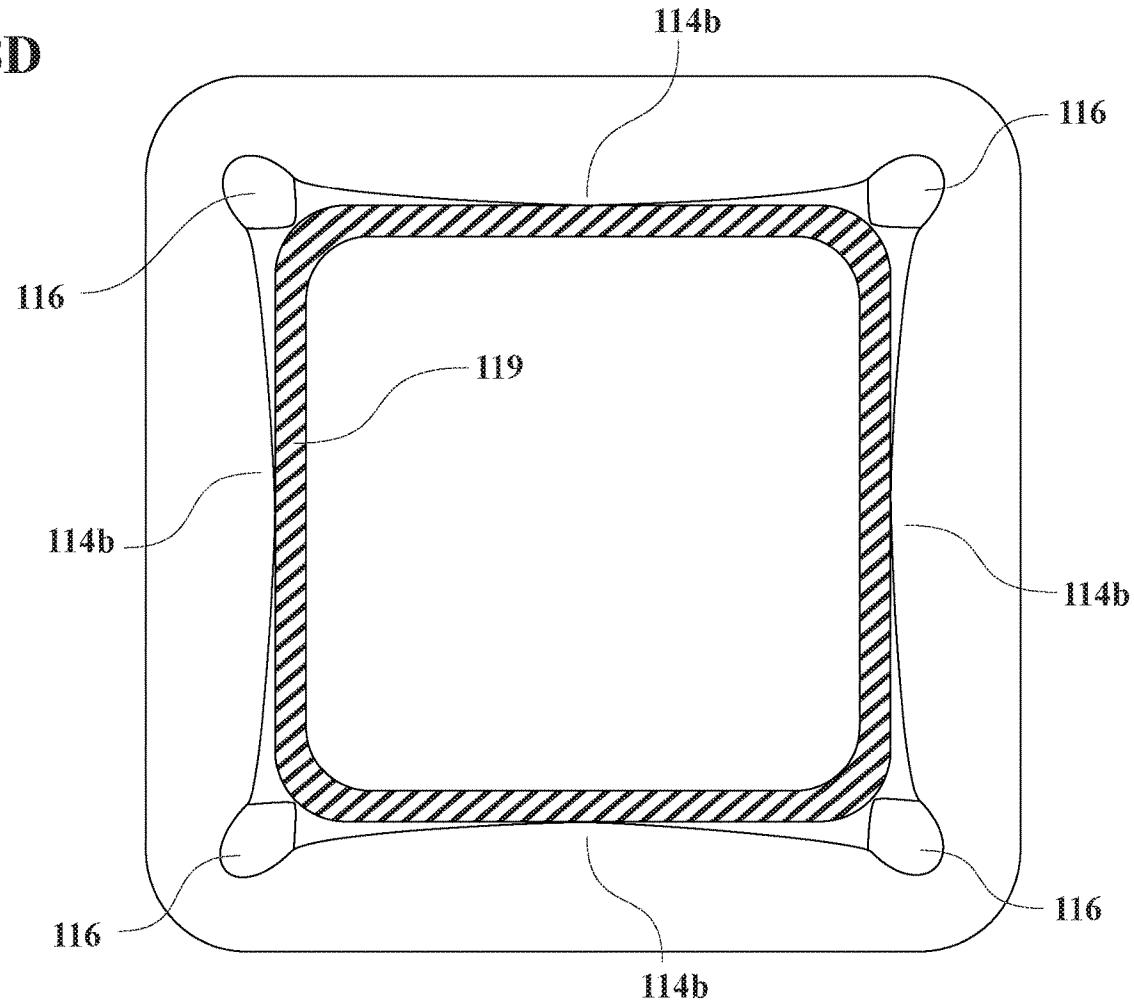
FIG. 8D and FIG. 8E illustrate a bottom view of four sleeves, post-centering clamps, tick-preventing downward teeth, and water-discharging grooves.
Figure 8E:
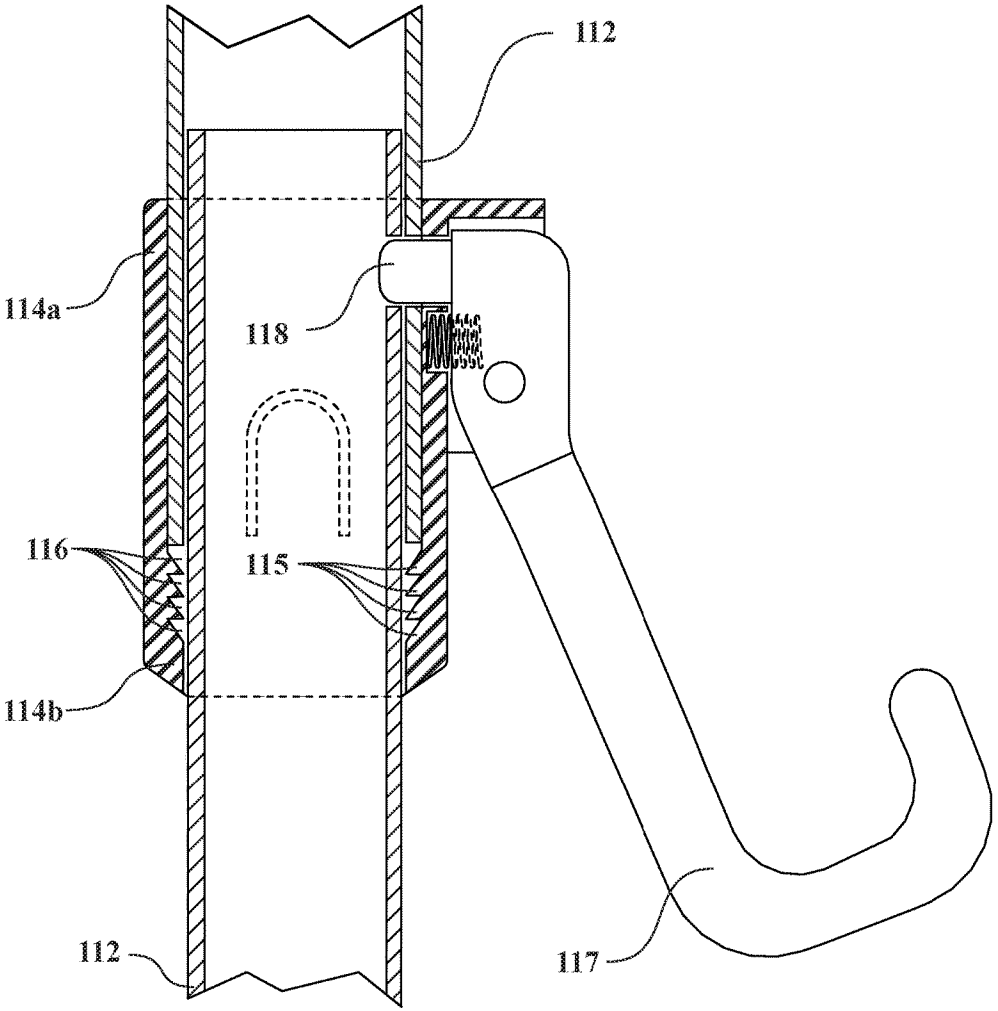

The arthritic-assisting one-person-deploying adjustable-central-canopy adjustable-ring-canopy rollable central-one-push-locking popup, which comprises:

1) Arthritic-assisting post-centering tick-preventing water-discharging wind-and-smoke-redirecting adjustable-ring-canopy system,
2) Arthritic-assisting central-innersurface-locking wind-and-smoke-redirecting adjustable-central-canopy system, and
3) Arthritic-assisting multi-function hook-pulley-axle-wheel caster system.

Component

Referring to FIG. 1A, FIG. 1B, FIG. 1C, FIG. 1D, FIG. 1E, FIG. 1F, FIG. 1G, FIG. 1H, FIG. 1I, FIG. 1J, FIG. 1K, FIG. 1L, FIG. 1M, FIG. 1N, FIG. 2A, FIG. 2B, FIG. 3A, FIG. 3B, FIG. 4, FIG. 5A, FIG. 5B, FIG. 5C, FIG. 6A, FIG. 6B, FIG. 6C, FIG. 7, FIG. 8A, FIG. 8B, FIG. 8C, FIG. 8D, FIG. 8E, FIG. 9A, FIG. 9B, FIG. 9C, FIG. 9D, FIG. 9E, FIG. 10A, FIG. 10B, FIG. 11A, FIG. 11B, and FIG. 11C, the arthritic-assisting one-person-deploying adjustable-central-canopy adjustable-ring-canopy rollable central-one-push-locking popup comprises:

1) Arthritic-assisting post-centering tick-preventing water-discharging wind-and-smoke-redirecting adjustable-ring-canopy system 101, comprising:
2) Adjustable ring canopy 102,
3) Central intersector 103,
4) Intersector holes 104,
5) Bolts 105,
6) Nuts 106,
7) Foldable top trusses 107*a*,
   Top-truss connectors 107*b*,
8) Foldable corner trusses 108,
9) Foldable side trusses 109,
10) Truss holes 110,
11) Four upper corner intersectors 111,
12) Four upper posts 112,
13) Four lower corner intersectors 113,
14) Four sleeves 114*a*
   Post-centering clamps 114*b*,
15) Tick-preventing downward teeth 115,
16) Water-discharging grooves 116,
17) Arthritic-assisting post-height-adjusting spring-loaded rope-loop hooks 117,
18) Four post-height-adjusting nipples 118,
19) Four lower posts 119,
20) Post-height-adjusting holes 120;
21) Arthritic-assisting central-innersurface-locking wind-and-smoke-redirecting adjustable-central-canopy system 121, comprising:
22) Adjustable central canopy 122,
23) Central post 123,
24) Central-post hole 124,
25) Central-innersurface-locking spring 125,
26) Arthritic-assisting self-centering spring-loaded housing-locking hook 126,
27) Arthritic-assisting central-one-push-locking adjustable housing 127,
28) Lead-in funnel 128,
29) Button tunnel 129,
30) Arthritic-assisting tapered wedge button 130,
31) Foldable adjustable central trusses 131; and
32) Arthritic-assisting multi-function locking hook-pulley-axle-wheel caster system 132, comprising:
33) Pivoting threaded caster pins 133
34) Arthritic-assisting wheel-locking spring-loaded rope-loop hooks 134*a*,
   Wheels gears 134*b*,
   Peg gears 134*c*,
   Gear-locking pegs 134*d*, 35) Rope-guiding holes 135,
36) Ropes 136,
37) Rope loop ends 137,
38) Pulley-axle-and-locking-wheel braces 138,
39) Arthritic-assisting pulley-axles 139,
40) Oversized shock-absorbing locking-wheels 140.

Material

Referring to FIG. 1A, FIG. 1B, FIG. 1C, FIG. 1D, FIG. 1E, FIG. 1F, FIG. 1G, FIG. 1H, FIG. 1I, FIG. 1J, FIG. 1K, FIG. 1L, FIG. 1M, FIG. 1N, FIG. 2A, FIG. 2B, FIG. 3A, FIG. 3B, FIG. 4, FIG. 5A, FIG. 5B, FIG. 5C, FIG. 6A, FIG. 6B, FIG. 6C, FIG. 7, FIG. 8A, FIG. 8B, FIG. 8C, FIG. 8D, FIG. 8E, FIG. 9A, FIG. 9B, FIG. 9C, FIG. 9D, FIG. 9E, FIG. 10A, FIG. 10B, FIG. 11A, FIG. 11B, and FIG. 11C:

1) Arthritic-assisting post-centering tick-preventing water-discharging wind-and-smoke-redirecting adjustable-ring-canopy system 101 is made of the combined materials of its components.
2) Adjustable ring canopy 102
   is made of canvas, fabric, nylon, the like, the equivalent, or flexible material.
3) Central intersector 103
   is made of metal or plastic material.
4) Intersector holes 104
   each are made of empty space.
5) Bolts 105
   each are made of metal or plastic material.
6) Nuts 106
   each are made of metal or plastic material.
7) Foldable top trusses 107*a*
   each are made of metal or plastic material.
   Top-truss connectors 107*b*
   each are made of metal or plastic material.
8) Foldable corner trusses 108
   each are made of metal or plastic material.
9) Foldable side trusses 109
   each are made of metal or plastic material.
10) Truss holes 110
   each are made of empty space.
11) Four upper corner intersectors 111
   each are made of metal or plastic material.
12) Four upper posts 112
   each are made of metal or plastic material.
13) Four lower corner intersectors 113
   each are made of metal or plastic material.
14) Four sleeves 114*a*
   each are made of metal or plastic material.
   Post-centering clamps 114*b*
   each are made of metal or plastic material.
15) Tick-preventing downward teeth 115
   each are made of metal or plastic material.
16) Water-discharging grooves 116
   each are made of empty space.
17) Arthritic-assisting post-height-adjusting spring-loaded rope-loop hooks 117
   each are made of metal or plastic material.
18) Four post-height-adjusting nipples 118
   each are made of metal or plastic material.
19) Four lower posts 119
   each are made of metal or plastic material.
20) Post-height-adjusting holes 120
   each are made of empty space.
21) Arthritic-assisting central-innersurface-locking wind-and-smoke-redirecting adjustable-central-canopy system 121 is made of the combined materials of its components.
22) Adjustable central canopy 122
   is made of canvas, fabric, nylon, the like, the equivalent, or flexible material.
23) Central post 123
   is made of metal or plastic material.
24) Central-post hole 124
   is made of empty space.
25) Central-innersurface-locking spring 125
   is made of metal or plastic material.
26) Arthritic-assisting self-centering spring-loaded housing-locking hook 126
   is made of metal or plastic material.
27) Arthritic-assisting central-one-push-locking adjustable housing 127
   is made of metal or plastic material.
28) Lead-in funnel 128
   is made of empty space.
29) Button tunnel 129
   is made of empty space.
30) Arthritic-assisting tapered wedge button 130
   is made of metal or plastic material.
31) Foldable adjustable central trusses 131
   each are made of metal or plastic material.
32) Arthritic-assisting multi-function locking hook-pulley-axle-wheel caster system 132 is made of the combined materials of its components.
33) Pivoting threaded caster pins 133
   each are made of metal or plastic material.
34) Arthritic-assisting wheel-locking spring-loaded rope-loop hooks 134*a*
   each are made of metal or plastic material.
   Wheel gears 134*b*
   each are made of metal or plastic material.
   Peg springs 134*c*
   each are made of metal material.
   Gear-locking pegs 134*d*
   each are made of metal or plastic material.
35) Rope-guiding holes 135
   each are made of empty space.
36) Ropes 136
   each are made of canvas, fabric, nylon, the like, the equivalent, or flexible material.
37) Rope loop ends 137
   each are made of metal or plastic material.
38) Pulley-axle-and-locking-wheel braces 138
   each are made of metal or plastic material.
39) Arthritic-assisting pulley-axles 139
   each are made of metal or plastic material.
40) Oversized shock-absorbing locking-wheels 140
   each are made of metal or plastic material.

Shape

Referring to FIG. 1A, FIG. 1B, FIG. 1C, FIG. 1D, FIG. 1E, FIG. 1F, FIG. 1G, FIG. 1H, FIG. 1I, FIG. 1J, FIG. 1K, FIG. 1L, FIG. 1M, FIG. 1N, FIG. 2A, FIG. 2B, FIG. 3A, FIG. 3B, FIG. 4, FIG. 5A, FIG. 5B, FIG. 5C, FIG. 6A, FIG. 6B, FIG. 6C, FIG. 7, FIG. 8A, FIG. 8B, FIG. 8C, FIG. 8D, FIG. 8E, FIG. 9A, FIG. 9B, FIG. 9C, FIG. 9D, FIG. 9E, FIG. 10A, FIG. 10B, FIG. 11A, FIG. 11B, and FIG. 11C:

1) Arthritic-assisting post-centering tick-preventing water-discharging wind-and-smoke-redirecting adjustable-ring-canopy system 101 has the combined shapes of its components.
2) Adjustable ring canopy 102
   is formed into a square-ring shape.
3) Central intersector 103
   is formed into a round shape with four U-shaped arms.

4) Intersector holes 104
each are formed into a round shape.
5) Bolts 105
each are formed into a bolt shape with a hexagon-shaped head.
6) Nuts 106
each are formed into a hexagonal ring shape.
7) Foldable top trusses 107*a*
each are formed into a rectangular-or-oval-tube shape.
Top-truss connectors 107*b*
each are formed into a U shape.
8) Foldable corner trusses 108
each are formed into a rectangular-or-oval-tube shape.
9) Foldable side trusses 109
each are formed into a rectangular-or-oval-tube shape.
10) Truss holes 110
each are formed into a round shape.
11) Four upper corner intersectors 111
each are formed into a square-tube shape with one closed end, one open end, and three U-shaped arms.
12) Four upper posts 112
each are formed into a tubular shape with a square cross-section.
13) Four lower corner intersectors 113
each are formed into a square-tube shape with open ends and three U-shaped arms.
14) Four sleeves 114*a*
each are formed into a rectangular shape.
Post-centering clamps 114*b*
each are formed into a waning-moon shape.
15) Tick-preventing downward teeth 115
each are formed into a pyramid shape.
16) Water-discharging grooves 116
each are formed into a half-moon shape.
17) Arthritic-assisting post-height-adjusting spring-loaded rope-loop hooks 117
each are formed into a C shape.
18) Four post-height-adjusting nipples 118
each are formed into a half-moon shape.
19) Four lower posts 119
each are formed into a tubular shape with a square cross-section.
20) Post-height-adjusting holes 120
each are formed into a half-moon shape.
21) Arthritic-assisting central-innersurface-locking wind-and-smoke-redirecting adjustable-central-canopy system 121 has the combined shapes of its components.
22) Adjustable central canopy 122
is formed into a square shape.
23) Central post 123
is formed into a tubular shape with a circular cross-section.
24) Central-post hole 124
is formed into a rectangle shape.
25) Central-innersurface-locking spring 125
is formed into a spiral shape.
26) Arthritic-assisting self-centering spring-loaded housing-locking hook 126
is formed into a J shape.
27) Arthritic-assisting central-one-push-locking adjustable housing 127
is formed into a round-ring shape with a round central hole of a cylindrical innersurface and with multiple surrounding U-shaped truss brackets.
28) Lead-in funnel 128
is formed into a funnel shape.
29) Button tunnel 129
is formed into a rounded-cornered trapezoidal shape with a smaller rounded trapezoidal shape within.
30) Arthritic-assisting tapered wedge button 130
each are formed into a rounded-cornered trapezoidal shape with a body section and a smaller rounded trapezoidal shape extending out from the body.
31) Foldable adjustable central trusses 131
each are formed into a rectangular-or-oval-tube shape.
32) Arthritic-assisting multi-function locking hook-pulley-axle-wheel caster system 132 has the combined shapes of its components.
33) Pivoting threaded caster pins 133
each are formed into a threaded cylindrical shape.
34) Arthritic-assisting wheel-locking spring-loaded rope-loop hooks 134*a*
each are formed into a J shape with an perpendicular extending square-shaped tab.
Wheel gears 134*b*
each are formed into a gear shape.
Peg springs 134*c*
each are formed into a spring shape.
Gear-locking pegs 134*d*
each are formed into a Y shape with pointed tips.
35) Rope-guiding holes 135
each are formed into a round shape.
36) Ropes 136
each are formed into a string shape.
37) Rope loop ends 137
each are formed into a hoop shape.
38) Pulley-axle-and-locking-wheel braces 138
each are formed into a generally rectangular shape.
39) Arthritic-assisting pulley-axles 139
each are formed into an hour-glass shape.
40) Oversized shock-absorbing locking-wheels 140
each are formed into a dish shape with a corrugated edge on one side and sprocket teeth orbiting the circumference of the other side.

Connection

Referring to FIG. 1A, FIG. 1B, FIG. 1C, FIG. 1D, FIG. 1E, FIG. 1F, FIG. 1G, FIG. 1H, FIG. 1I, FIG. 1J, FIG. 1K, FIG. 1L, FIG. 1M, FIG. 1N, FIG. 2A, FIG. 2B, FIG. 3A, FIG. 3B, FIG. 4, FIG. 5A, FIG. 5B, FIG. 5C, FIG. 6A, FIG. 6B, FIG. 6C, FIG. 7, FIG. 8A, FIG. 8B, FIG. 8C, FIG. 8D, FIG. 8E, FIG. 9A, FIG. 9B, FIG. 9C, FIG. 9D, FIG. 9E, FIG. 10A, FIG. 10B, FIG. 11A, FIG. 11B, and FIG. 11C:

1) Arthritic-assisting post-centering tick-preventing water-discharging wind-and-smoke-redirecting adjustable-ring-canopy system 101 has the combined connections of its components.
2) Adjustable ring canopy 102
is attached to foldable top trusses 107*a*.
3) Central intersector 103
pivotably is bolted to foldable top trusses 107*a*.
4) Intersector holes 104
respectively are molded in central intersector 103,
respectively are molded in four upper corner intersectors 111, and
respectively are molded in four lower corner intersectors 113.
5) Bolts 105
respectively are inserted through intersector holes 104.
6) Nuts 106
respectively are screwed onto bolts 105.
7) Foldable top trusses 107*a*
respectively and pivotably are bolted to central intersector 103, and respectively are attached to said adjustable ring canopy 102.

Top-truss connectors 107*b* respectively and pivotably are bolted to foldable top trusses 107*a*.

8) Foldable corner trusses 108 respectively and pivotably are bolted to foldable top trusses 107*a*.

9) Foldable side trusses 109 respectively and pivotably are bolted to four upper corner intersectors 111, and respectively and pivotably are bolted to one another.

10) Truss holes 110 respectively are drilled into foldable top trusses 107*a*, foldable corner trusses 108, foldable side trusses 109, and foldable adjustable central trusses 133.

11) Four upper corner intersectors 111 respectively and pivotably are bolted to foldable top trusses 107*a* and respectively and pivotably are bolted to said foldable side trusses 109.

12) Four upper posts 112 respectively are attached to four upper corner intersectors 111.

13) Four lower corner intersectors 113 respectively and pivotably are slid on four upper posts 112, respectively and pivotably are bolted to said foldable corner trusses 108, and respectively and pivotably are bolted to said foldable side trusses 109.

14) Four sleeves 114*a* respectively are slid on the bottom end of four upper posts 112.

Post-centering clamps 114*b* respectively are molded to four sleeves 114*a*.

15) Tick-preventing downward teeth 115 respectively are molded to four sleeves 114*a*.

16) Water-discharging grooves 116 respectively are molded to four sleeves 114*a*.

17) Arthritic-assisting post-height-adjusting spring-loaded rope-loop hooks 117 respectively and pivotably are attached to four sleeves 114*a*.

18) Four post-height-adjusting nipples 118 respectively are molded to arthritic-assisting post-height-adjusting spring-loaded rope-loop hooks 117.

19) Four lower posts 119 respectively and slidably are inserted inside four upper posts 112.

20) Post-height-adjusting holes 120 respectively are formed or drilled in four upper posts 112 and four lower posts 119.

21) Arthritic-assisting central-innersurface-locking wind-and-smoke-redirecting adjustable-central-canopy system 121 has the combined connections of its components.

22) Adjustable central canopy 122 is attached to foldable adjustable central trusses 131.

23) Central post 123 is attached to central intersector 103.

24) Central-post hole 124 is formed in central post 123.

25) Central-innersurface-locking spring 125 is inserted inside central post 123.

26) Arthritic-assisting self-centering spring-loaded housing-locking hook 126 is pivotably riveted inside central post 123.

27) Arthritic-assisting central-one-push-locking adjustable housing 127 adjustably and slidably is locked on and unlocked from central post 123.

28) Lead-in funnel 128 is molded to one end of arthritic-assisting central-one-push-locking adjustable housing 127.

29) Button tunnel 129 is molded from the outer surface to the inner surface of arthritic-assisting central-one-push-locking adjustable housing 127.

30) Arthritic-assisting tapered wedge button 130 is snapped into button tunnel 129.

31) Foldable adjustable central trusses 131 respectively and pivotably are bolted to foldable top trusses 107*a*, respectively and pivotably are bolted to arthritic-assisting central-one-push-locking adjustable housing 127, and respectively are attached to said adjustable central canopy 122.

32) Arthritic-assisting multi-function locking hook-pulley-axle-wheel caster system 132 has the combined connections of its components.

33) Pivoting threaded caster pins 133 respectively and threadedly or otherwise are attached to the bottom end of four lower posts 119 and attached to pulley-axel-and-locking-wheel braces 138.

34) Arthritic-assisting wheel-locking spring-loaded rope-loop hooks 134*a* respectively and pivotably are connected or molded to pulley-axle-and-locking-wheel braces 138.

Wheel gears 134*b* respectively are connected to oversized shock-absorbing locking-wheels 140.

Peg springs 134*c* respectively are springingly inserted within pulley-axle-and-locking-wheel braces 138.

Gear-locking pegs 134*d* respectively are slideably inserted through pulley-axle-and-locking-wheel braces 138.

35) Rope-guiding holes 135 respectively are drilled into pulley-axle-and-locking-wheel braces 138.

36) Ropes 136 respectively are threaded through at least one of rope-guiding holes 135 and respectively are hooked on at least one of arthritic-assisting wheel-locking spring-loaded rope-loop hooks 134*a* or arthritic-assisting post-height-adjusting spring-loaded rope-loop hooks 117.

37) Rope loop ends 137 respectively are woven to one end of ropes 136.

38) Pulley-axle-and-locking-wheel braces 138 respectively are connected to pivoting threaded caster pins 133.

39) Arthritic-assisting pulley-axles 139 respectively are attached to and between pulley-axle-and-locking-wheel braces 138.

40) Oversized shock-absorbing locking-wheels 140 respectively and rotatably are attached to arthritic-assisting pulley-axles 139.

Function

Referring to FIG. 12A, FIG. 12B, FIG. 12C, FIG. 12D, FIG. 13, FIG. 14, FIG. 15A, FIG. 15B, FIG. 16, FIG. 17A, FIG. 17B, FIG. 17C, FIG. 17D, FIG. 17E, FIG. 17F, FIG. 17G, FIG. 18A, FIG. 18B, FIG. 18C, FIG. 18D, FIG. 18E, FIG. 19A, and FIG. 19B:

1) Arthritic-assisting post-centering tick-preventing water-discharging foldable wind-and-smoke-redirecting adjustable-ring-canopy system 101 is for performing the combined functions of its components.

2) Adjustable ring canopy 102 is for:
   a) Providing a cover to protect users from weather elements;
   b) Redirecting wind and smoke above adjustable ring canopy 102 into the inside of the one-person-deploying adjustable-central-canopy adjustable-ring-canopy single-central-innersurface-arthritic-assisting rollable one-touch popup;
   c) Redirecting wind and smoke to flow out and away from under the one-person-deploying adjustable-central-canopy adjustable-ring-canopy single-central-innersurface-arthritic-assisting rollable one-touch popup; and
   d) Allowing light to shine into the inside of the one-person-deploying adjustable-central-canopy adjustable-ring-canopy single-central-innersurface-arthritic-assisting rollable one-touch popup.

3) Central intersector 103 is for:
   Foldably attaching to foldable top trusses 107*a*.

4) Intersector holes 104 respectively are for:
   Screwing bolts 105 therethrough.

5) Bolts 105 respectively are for:
   Attaching central intersector 103, foldable top trusses 107*a*, top-truss connectors 107*b*, foldable corner trusses 108, foldable side trusses 109, four upper corner intersectors 111, four lower corner intersectors 113, arthritic-assisting central-one-push-locking adjustable housing 127, and foldable adjustable central trusses 131 together.

6) Nuts 106 respectively are for:
   Securing bolts 105.

7) Foldable top trusses 107*a* respectively are for:
   Supporting central intersector 103.
   Top-truss connectors 107*b* respectively are for:
   Pivotably coupling foldable top trusses 107*a*.

8) Foldable corner trusses 108 respectively are for:
   Pivotably supporting foldable top trusses 107*a*.

9) Foldable side trusses 109 respectively are for:
   Supporting foldable top trusses 107*a*.

10) Truss holes 110 respectively are for:
   Inserting bolts 105 therethrough.

11) Four upper corner intersectors 111 respectively are for:
   Attaching foldable top trusses 107*a*, foldable corner trusses 108, and foldable side trusses 109 to four upper posts 112.

12) Four upper posts 112 respectively are for:
   Slidably sliding over four lower posts 119.

13) Four lower corner intersectors 113 respectively are for:
   Slidably attaching foldable side trusses 109 to four upper posts 112.

14) Four sleeves 114*a* respectively are for:
   Preventing four upper posts 112 and four lower posts 119 from scratching each other.
   Post-centering clamps 114*b* respectively are for:
   Centering four lower posts 119 inside four upper posts 112
   (see FIG. 8E and FIG. 15B).

15) Tick-preventing downward teeth 115 respectively are for:
   Preventing ticks from getting inside four upper posts 112 and four lower posts 119
   (see FIG. 8E and FIG. 15B).

16) Water-discharging grooves 116 respectively are for:
   Allowing water to discharge out of four upper posts 112 and four lower posts 119 in the directions of arrows 149
   (see FIG. 8E and FIG. 15B).

Figure 15A:
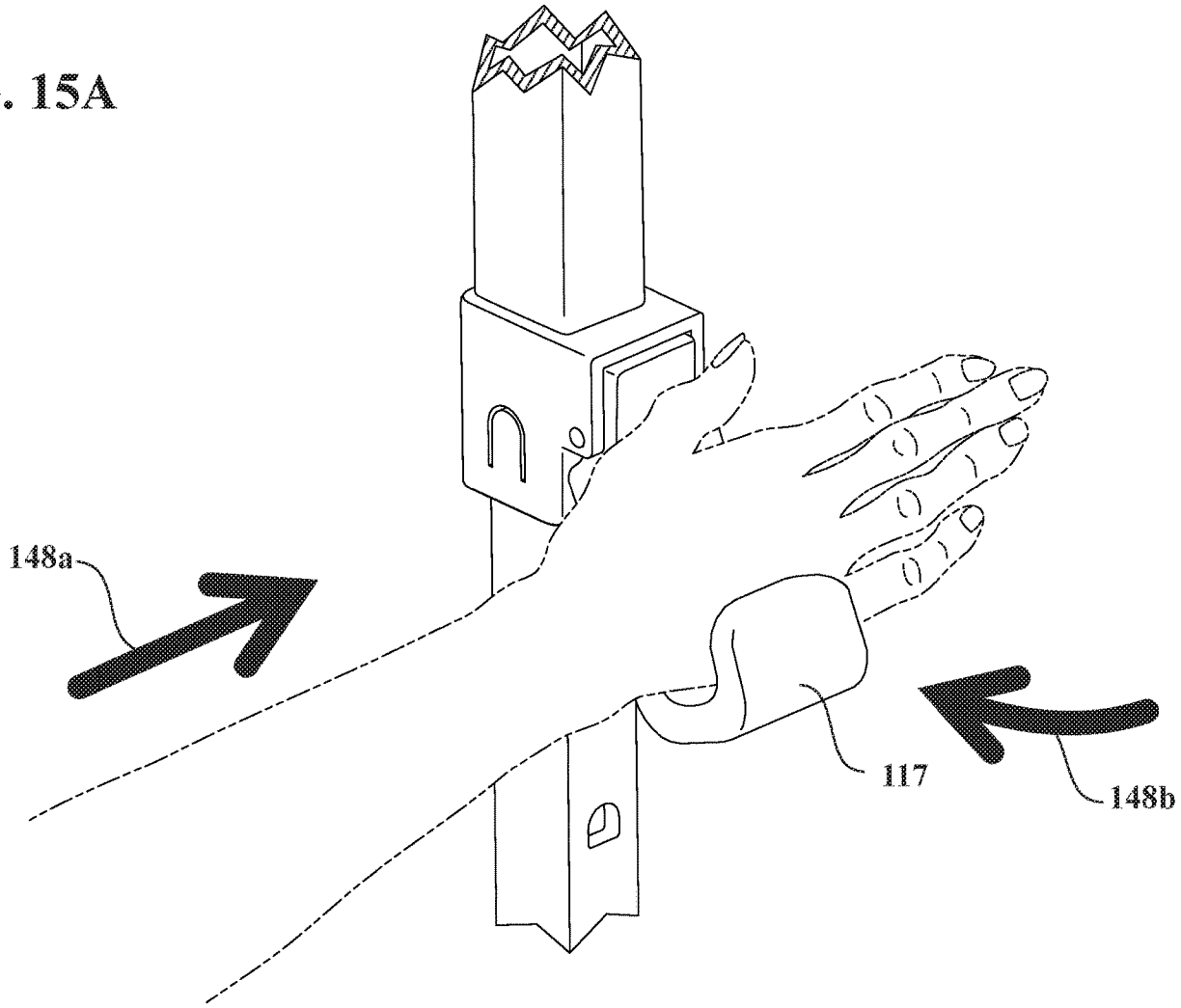
FIG. 15A illustrates a side view of how an individual with arthritis can operate the arthritic-assisting post-height-adjusting spring-loaded rope-loop hooks without bending fingers.
Figure 15B:
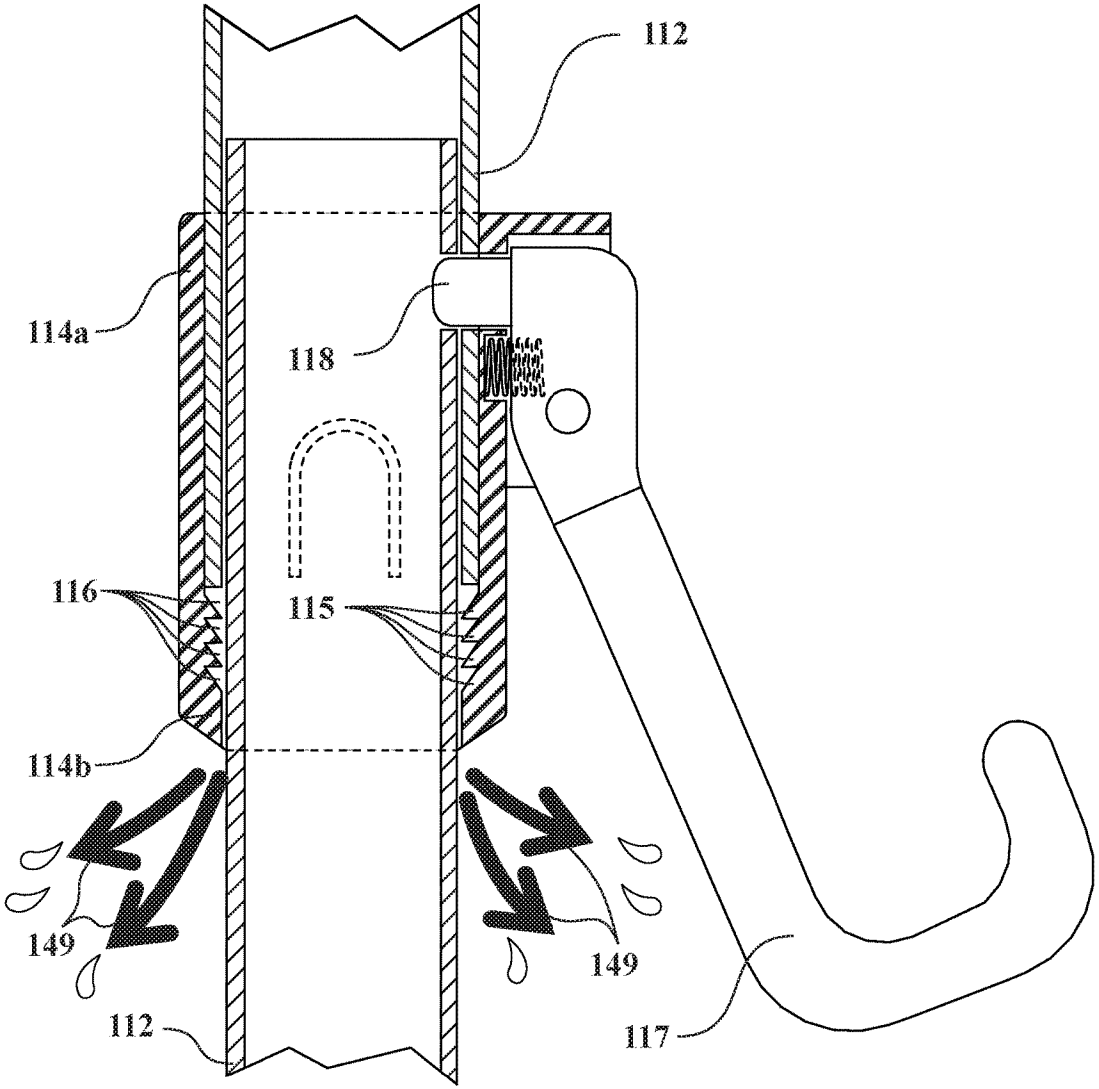
FIG. 15B illustrates a cross-sectional view of how post-centering clamps, tick-preventing downward teeth, and water-discharging grooves function to center post, prevent ticks from entering and to drain water, respectively.

17) Arthritic-assisting post-height-adjusting spring-loaded rope-loop hooks 117 respectively are for:
   a) Pushing four post-height-adjusting nipples 118 into post-height-adjusting holes 122 to secure four upper posts 112 to four lower posts 119; and
   b) Providing additional leverage to allow someone with arthritis the capability to not require the use their fingers to press the arthritic-assisting post-height-adjusting spring-loaded rope-loop hooks 117
   in the directions of arrows 148*a*, and 148*b*
   (see FIG. 15A).

18) Four post-height-adjusting nipples 118 respectively are for:
   Snap-locking into post-height-adjusting holes 120 to secure four upper posts 112 to four lower posts 119.

19) Four lower posts 119 respectively are for:
   Adjusting the height of the adjustable-central-canopy adjustable-surround-canopy adjustable-awning single-central-innersurface-square-lock popup.

20) Post-height-adjusting holes 120 respectively are for:
   Allowing four post-height-adjusting nipples 118 to snap-lock
   therethrough to secure four upper posts 112 to four lower posts 119.

21) Arthritic-assisting central-innersurface-locking wind-and-smoke-redirecting adjustable-central-canopy system 121 is for performing the combined functions of its components.

22) Adjustable central canopy 122 is for:
   a) Covering the center of the one-person-deploying adjustable-central-canopy adjustable-ring-canopy single-central-innersurface-arthritic-assisting rollable one-touch popup;
   b) Redirecting wind and smoke above adjustable ring canopy 102 into the inside of the one-person-deploying adjustable-central-canopy adjustable-ring-canopy single-central-innersurface-arthritic-assisting rollable one-touch popup
   in the directions of arrows 156*a*, 156*b*, 156*c*, 156*d*, 157*a*, 157*b*, 157*c*, and 157*d*
   (see FIG. 19A and FIG. 19B);
   c) Redirecting wind and smoke to flow out and away from under the one-person-deploying adjustable-central-canopy adjustable-ring-canopy single-central-innersurface-arthritic-assisting rollable one-touch popup
   in the directions of arrows 156*a*, 156*b*, 156*c*, 156*d*, 157*a*, 157*b*, 157*c*, and 157*d*
   (see FIG. 19A and FIG. 19B); and
   d) Allowing light to shine into the inside of one-person-deploying adjustable-central-canopy adjustable-ring-canopy single-central-innersurface-arthritic-assisting rollable one-touch popup.

23) Central post 123 is for:
   a) Locking arthritic-assisting central-one-push-locking adjustable housing 127 thereon;
   b) Preventing the one-person-deploying adjustable-central-canopy adjustable-ring-canopy single-central-innersurface-arthritic-assisting rollable one-touch popup from radially twisting clockwise out of its desired shape; and c) Preventing the one-person-deploying adjustable-central-canopy adjustable-ring-canopy single-central-innersurface-arthritic-assisting rollable one-touch popup from radially twisting counterclockwise out of its desired shape.

24) Central-post hole 124 is for:

Allowing arthritic-assisting self-centering spring-loaded housing-locking hook 126 to snap-lock therein to secure central post 123 to central-innersurface-locking adjustable housing 127 and foldable adjustable central trusses 131.

25) Central-innersurface-locking spring 125 is for:

Pushing arthritic-assisting self-centering spring-loaded housing-locking hook 126 into central-post hole 124.

Figure 9A:
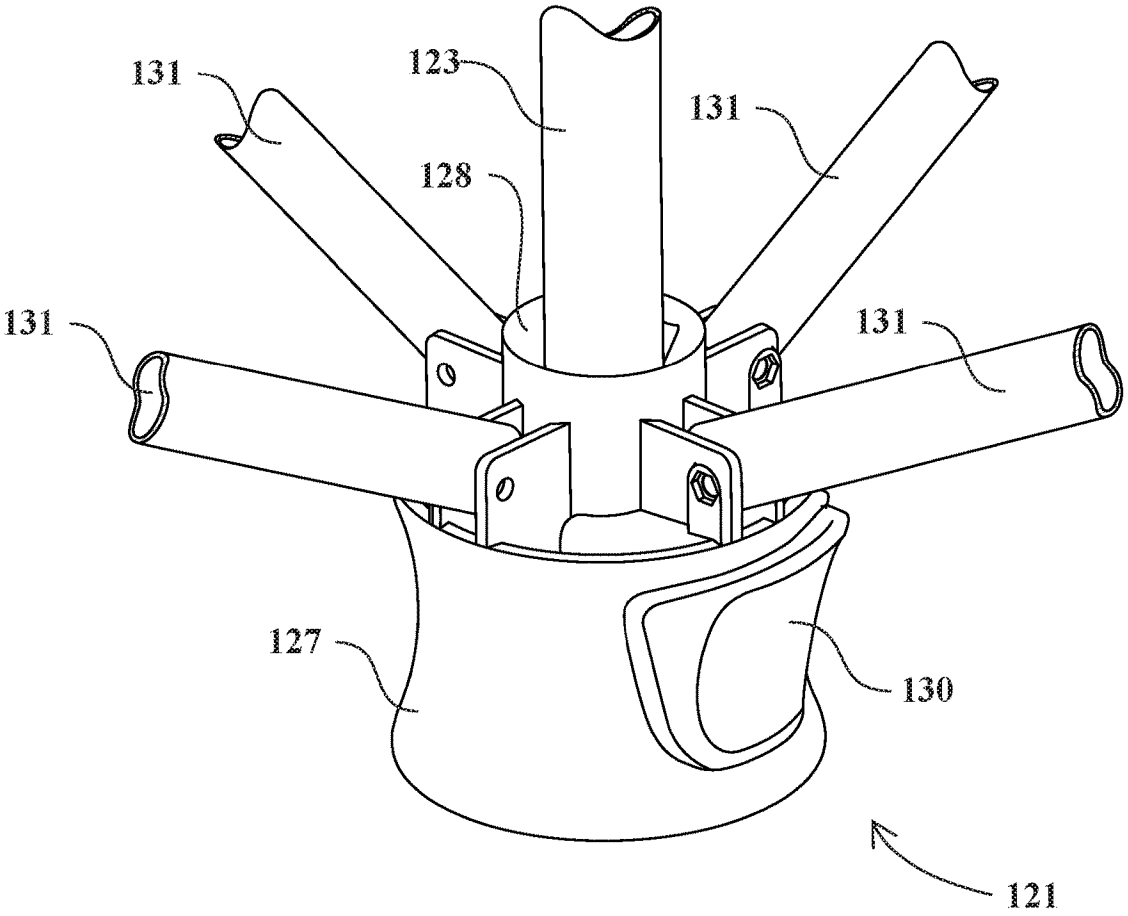
FIG. 9A, FIG. 9B, FIG. 9C, FIG. 9D, and FIG. 9E illustrate perspective, cross-sectional, top, and bottom views of the assembly of central-innersurface-locking spring, arthritic-assisting self-centering spring-loaded housing-locking hook, arthritic-assisting central-one-push-locking adjustable housing, and arthritic-assisting tapered wedge button.
Figure 9B:
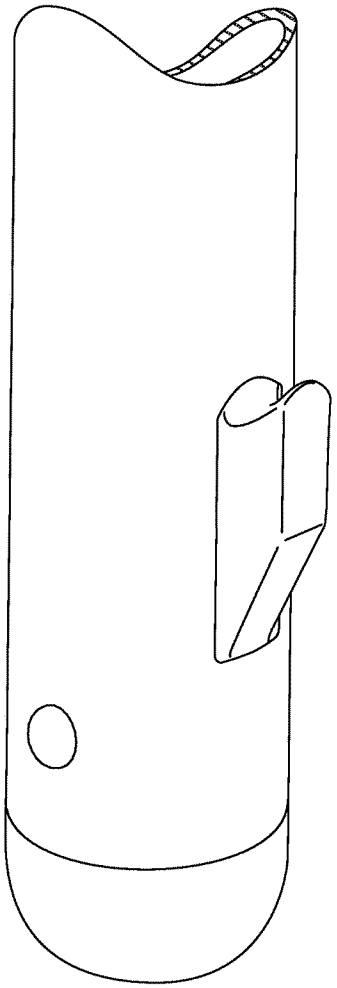
Figure 9C:
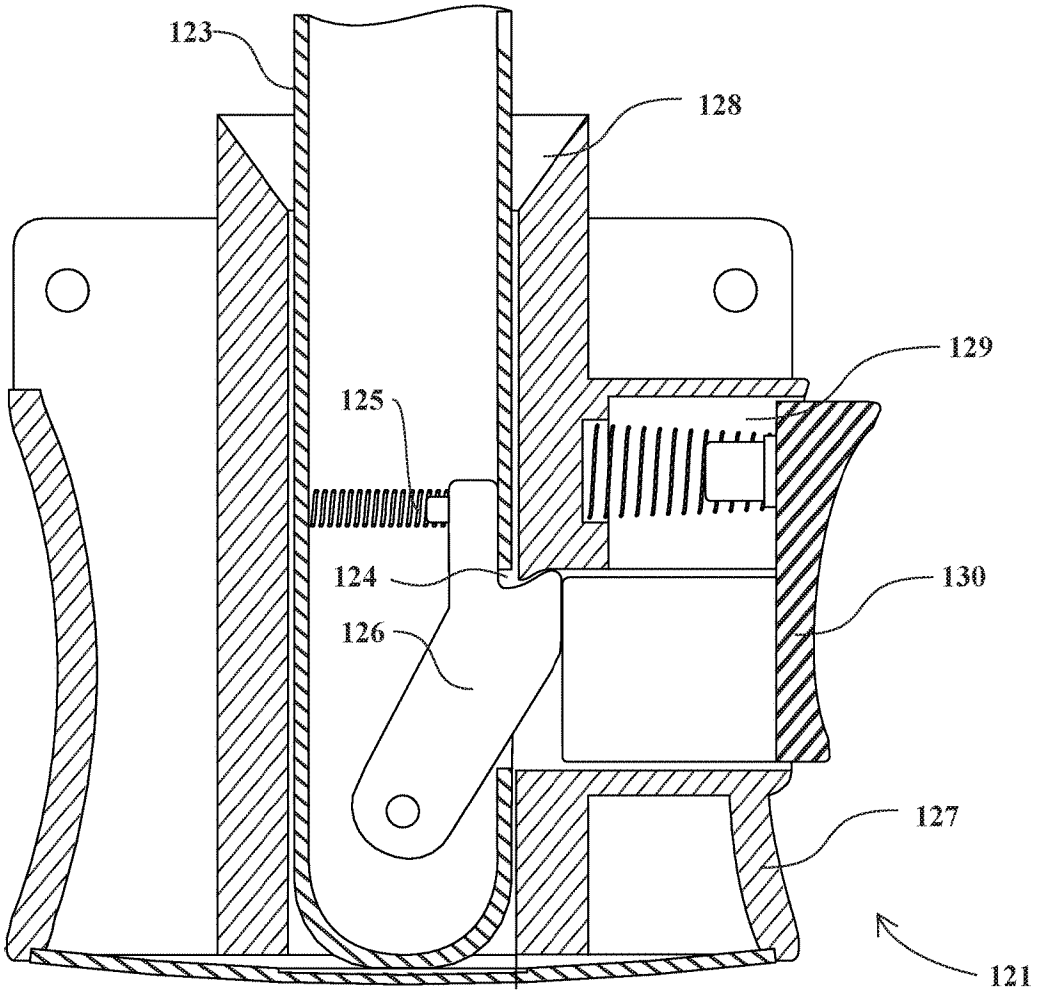
Figure 9E:
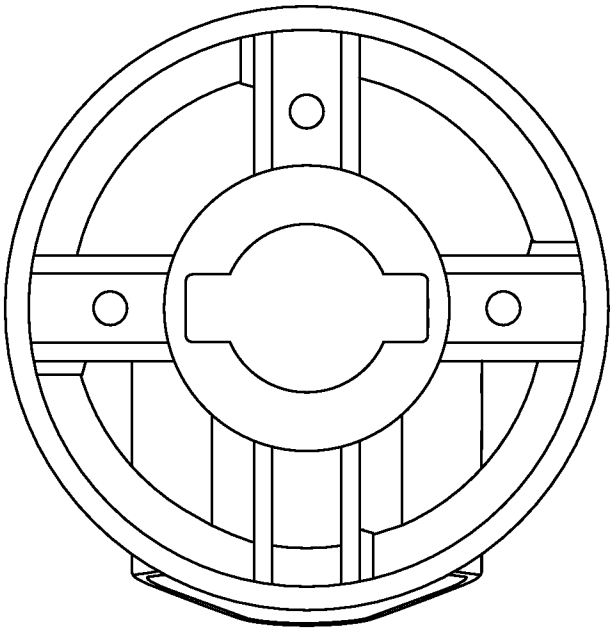
Figure 9D:
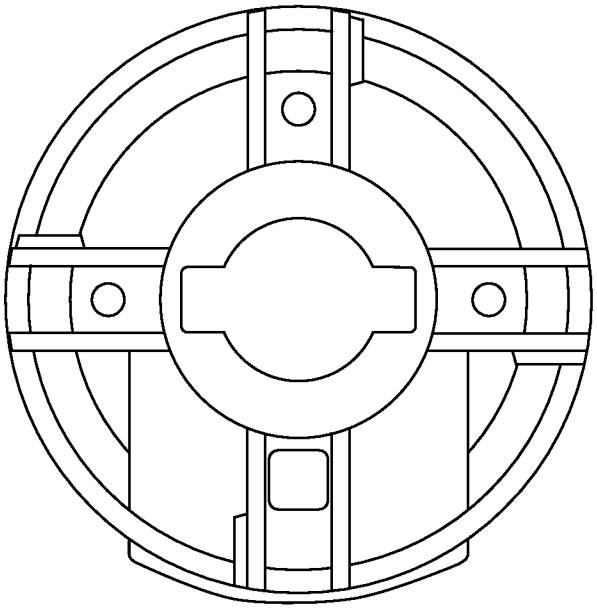
Figure 10A:
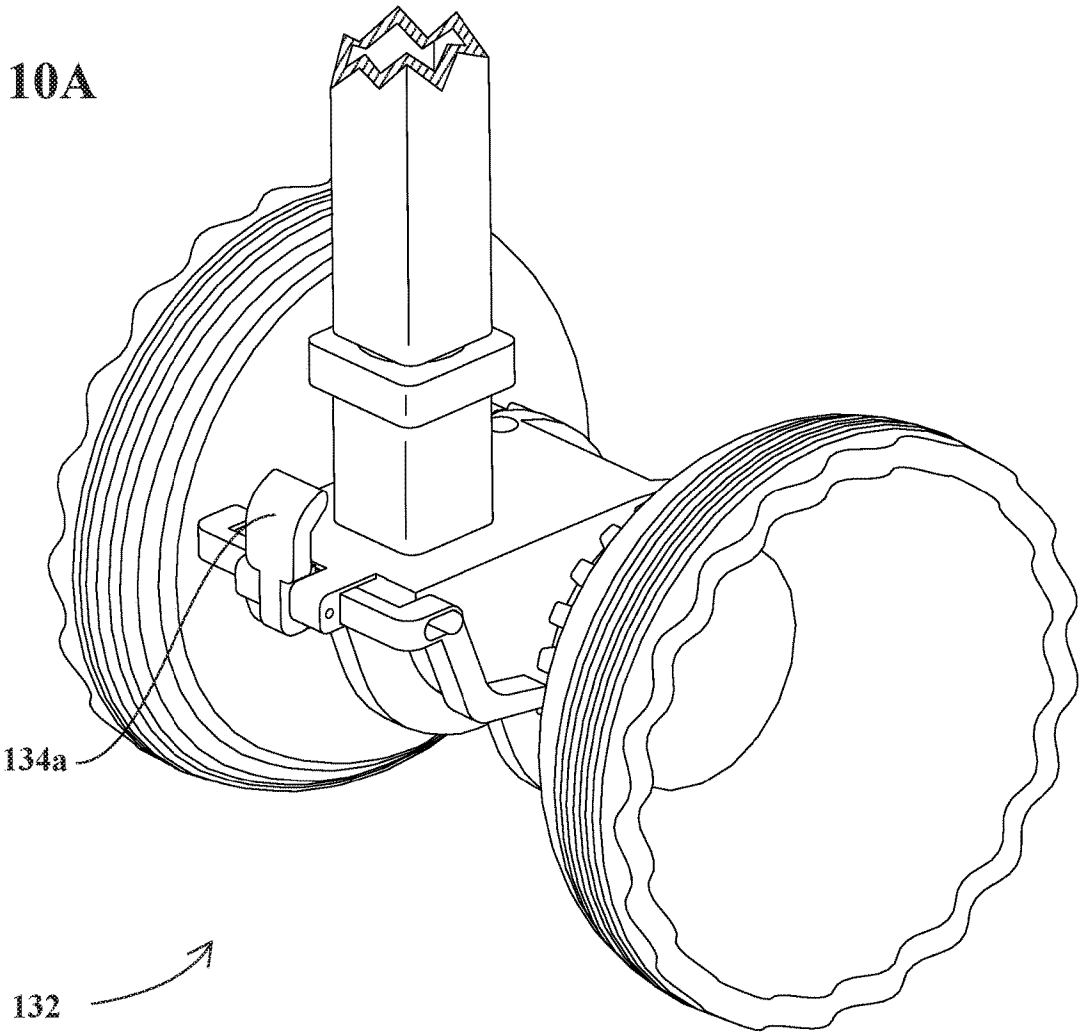
Figure 10B:
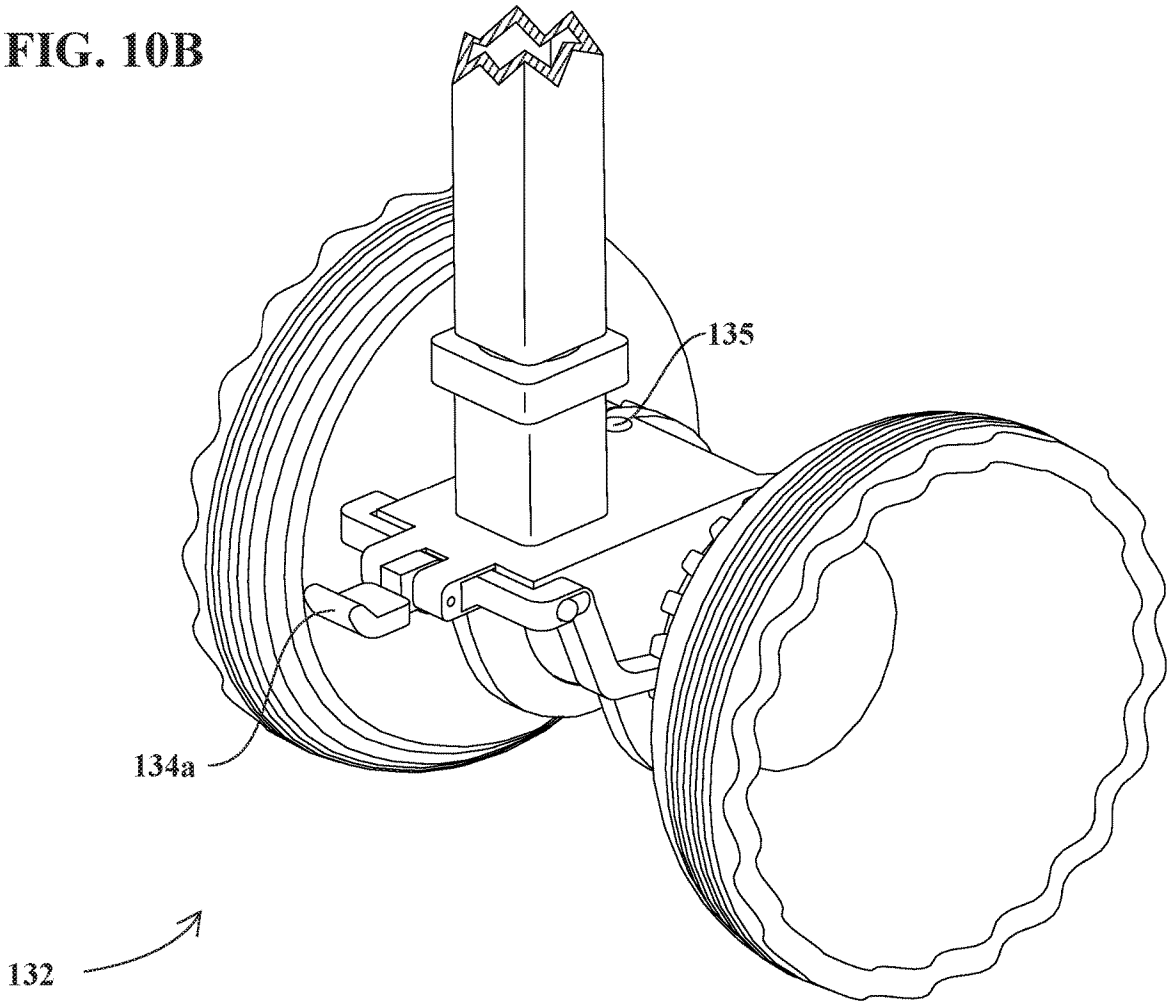
Figure 11B:
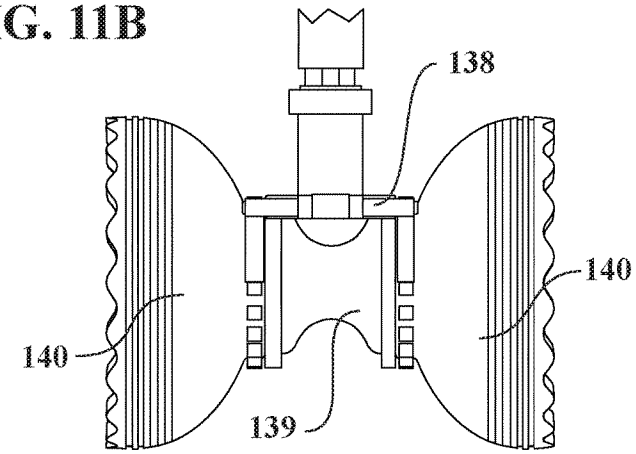
Figure 11A:
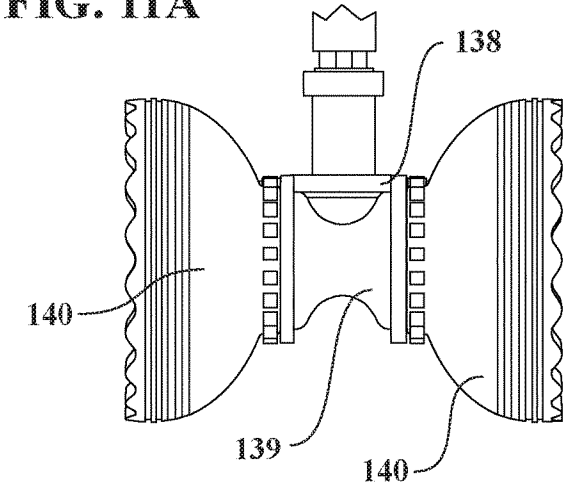
Figure 11C:
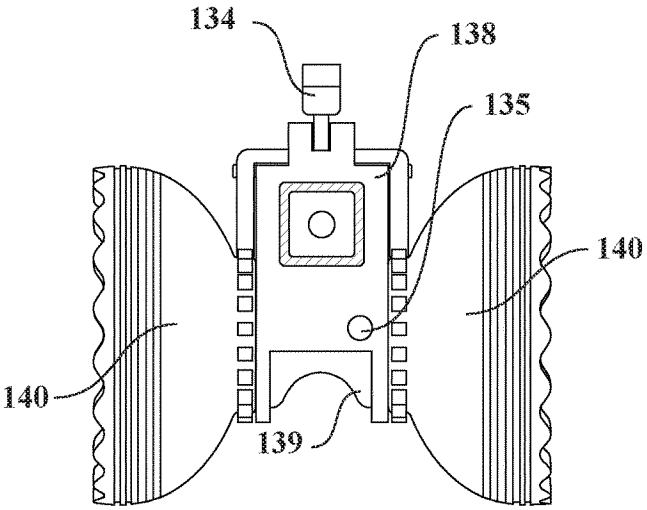

26) Arthritic-assisting self-centering spring-loaded housing-locking hook 126 is for:

Snap-locking into and out of arthritic-assisting central-one-push-locking adjustable housing 127 when arthritic-assisting central-one-push-locking adjustable housing 127 slides up and down central post 123
(see FIG. 9A and FIG. 9B).

27) Arthritic-assisting central-one-push-locking adjustable housing 127 is for:

a) Snap-locking on and off arthritic-assisting self-centering spring-loaded housing-locking hook 126
when arthritic-assisting central-one-push-locking adjustable housing 127 slides up and down central post 123
(see FIG. 9A and FIG. 9B);

b) Locking and unlocking central post 123 to and from arthritic-assisting central-one-push-locking adjustable housing 127 and foldable adjustable central trusses 131
(see FIG. 9A and FIG. 9B);

c) Locking and unlocking the one-person-deploying adjustable-central-canopy adjustable-ring-canopy single-central-innersurface-arthritic-assisting rollable one-touch popup after the rollable one-touch popup is folded or unfolded; and d) Allowing the one-person-deploying adjustable-central-canopy adjustable-ring-canopy single-central-innersurface-arthritic-assisting rollable one-touch popup to be folded and unfolded by a single person when pushed upward which, in turn, pushes the four upper posts 112 outward to lock them in position
in the directions of arrows 151 and 152
(see FIG. 17A, FIG. 17B, FIG. 17C, FIG. 17D, and FIG. 17E).

28) Lead-in funnel 128 is for:

Leading arthritic-assisting self-centering spring-loaded housing-locking hook 126 onto the inner surface of arthritic-assisting central-one-push-locking adjustable housing 127.

29) Button tunnel 129 is for:

Housing arthritic-assisting tapered wedge button 130.

Figure 16:
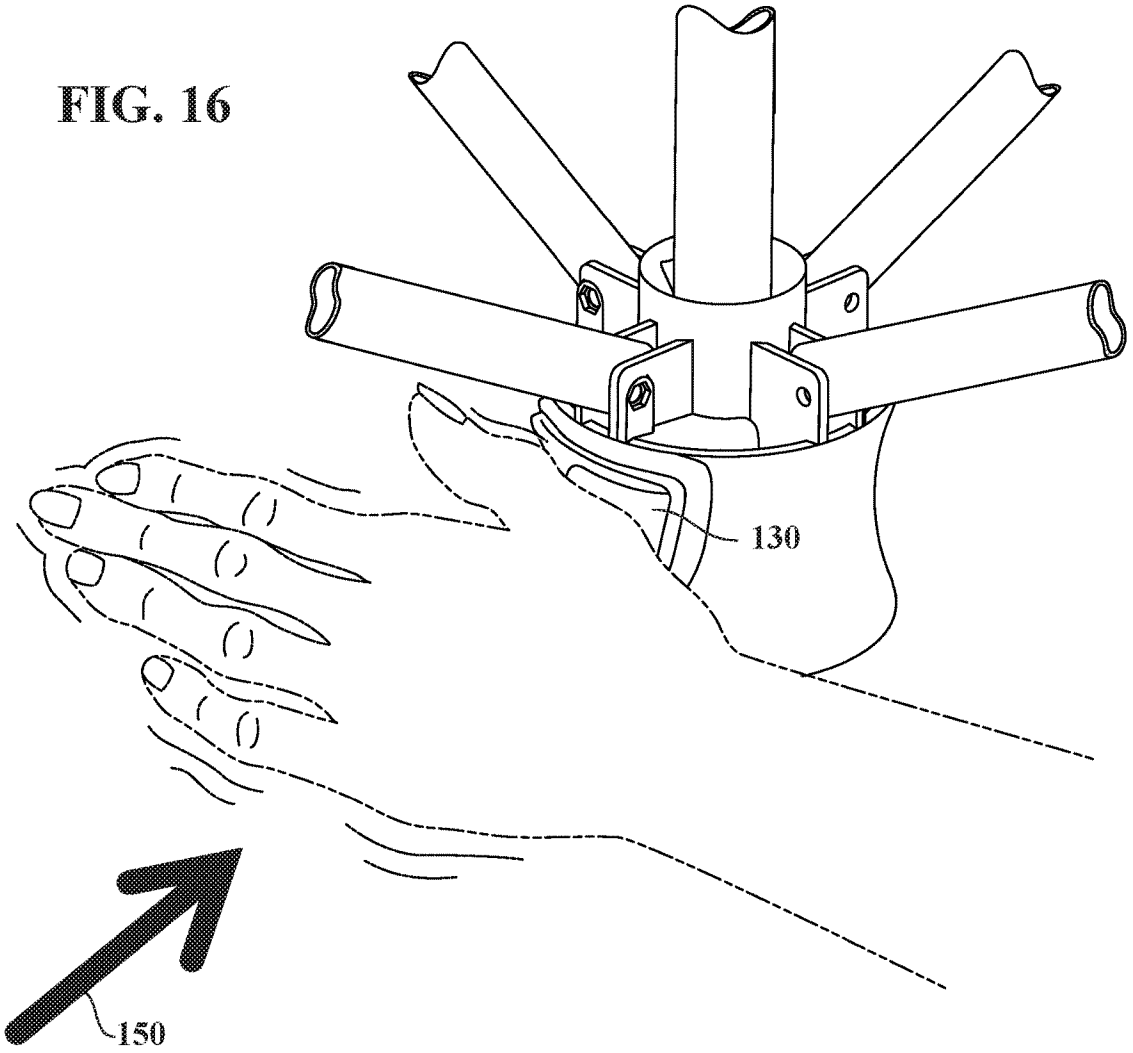
FIG. 16 illustrates a perspective view of how an individual with arthritis can push the arthritic-assisting tapered wedge button without the use of their fingers.
Figure 17A:
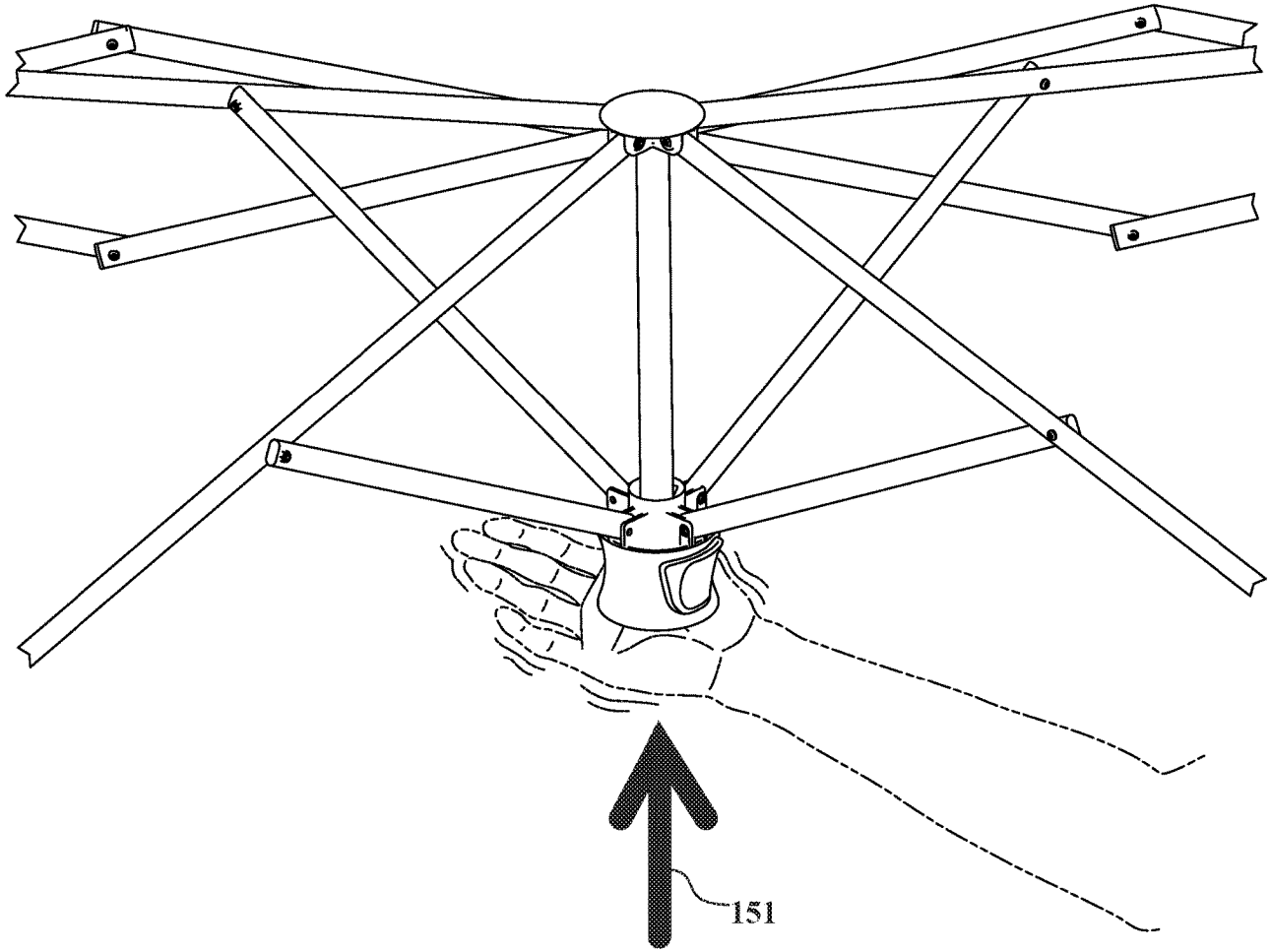
FIG. 17A, FIG. 17B, FIG. 17C, FIG. 17D, and FIG. 17E illustrate side, perspective, and top views of how one person can erect the arthritic-assisting one-person-deploying adjustable-central-canopy adjustable-ring-canopy rollable central-one-push-locking popup by pushing up on the arthritic-assisting central-one-push-locking adjustable housing to automatically engage the arthritic-assisting self-centering spring-loaded housing-locking hook into central-post hole, which simultaneously pushes the four corner posts out diagonally from the center by using the arthritic-assisting multi-function hook-pulley-axel-wheel caster systems, which are connected to the bottom of each corner post.
Figure 17B:
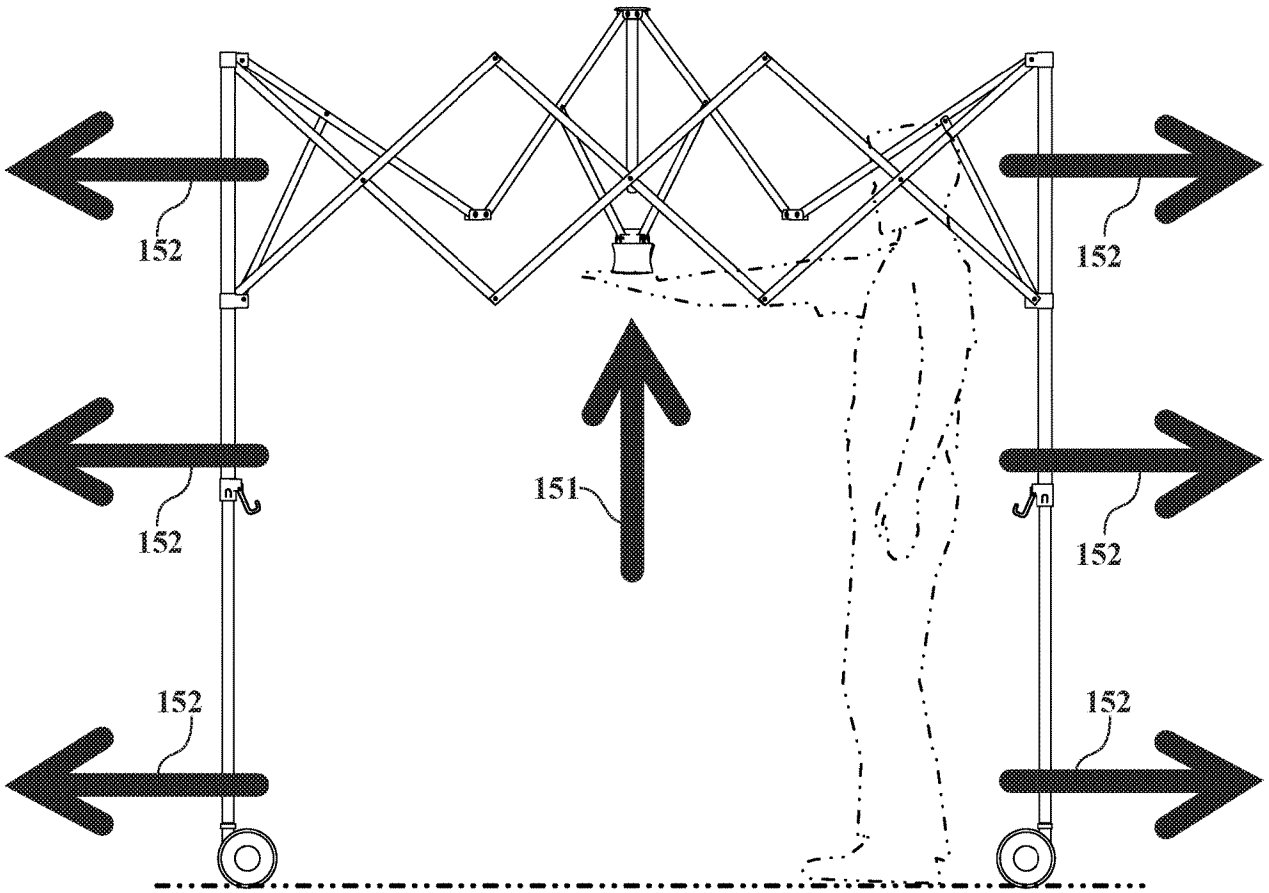
Figure 17C:
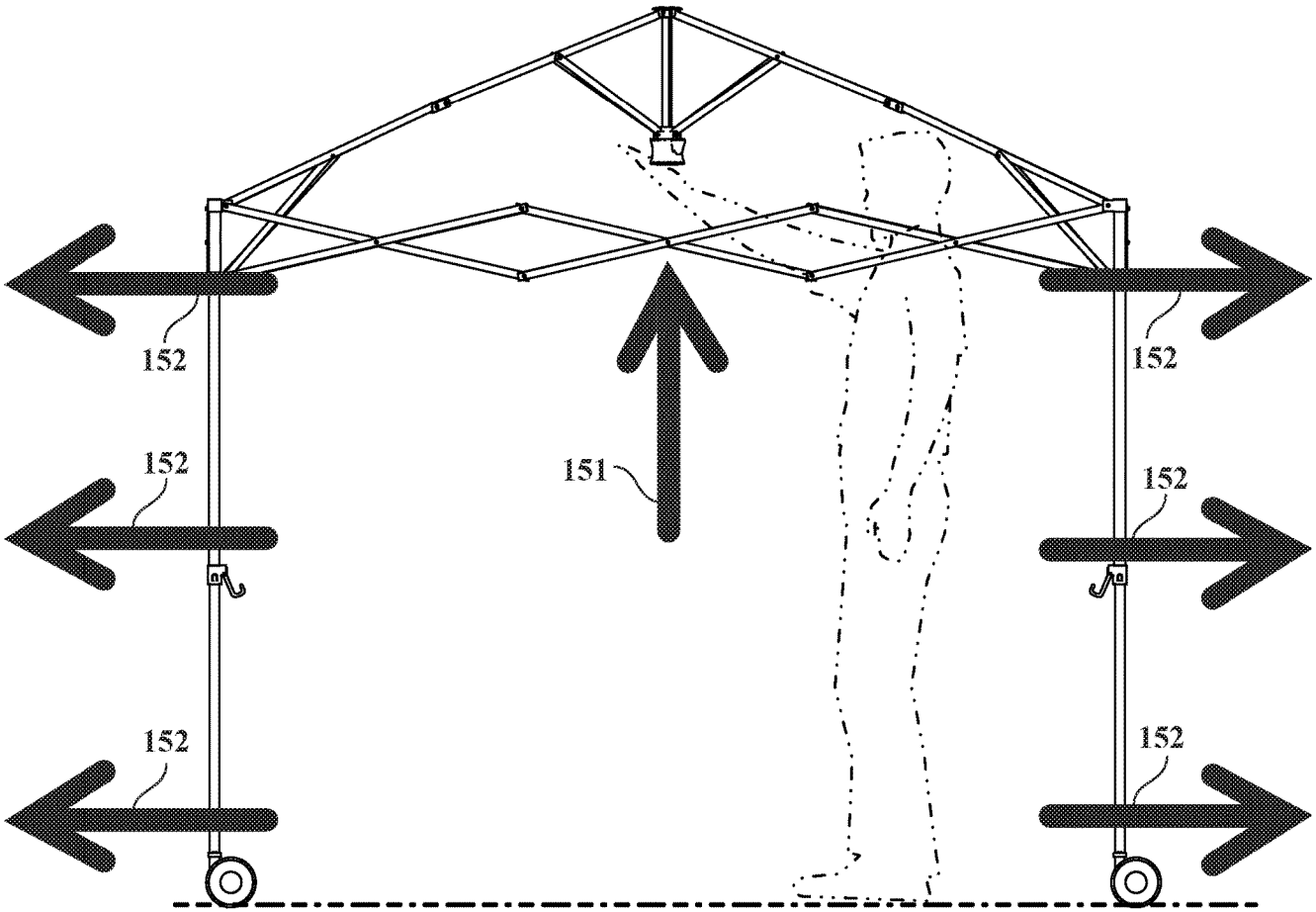
Figure 17D:
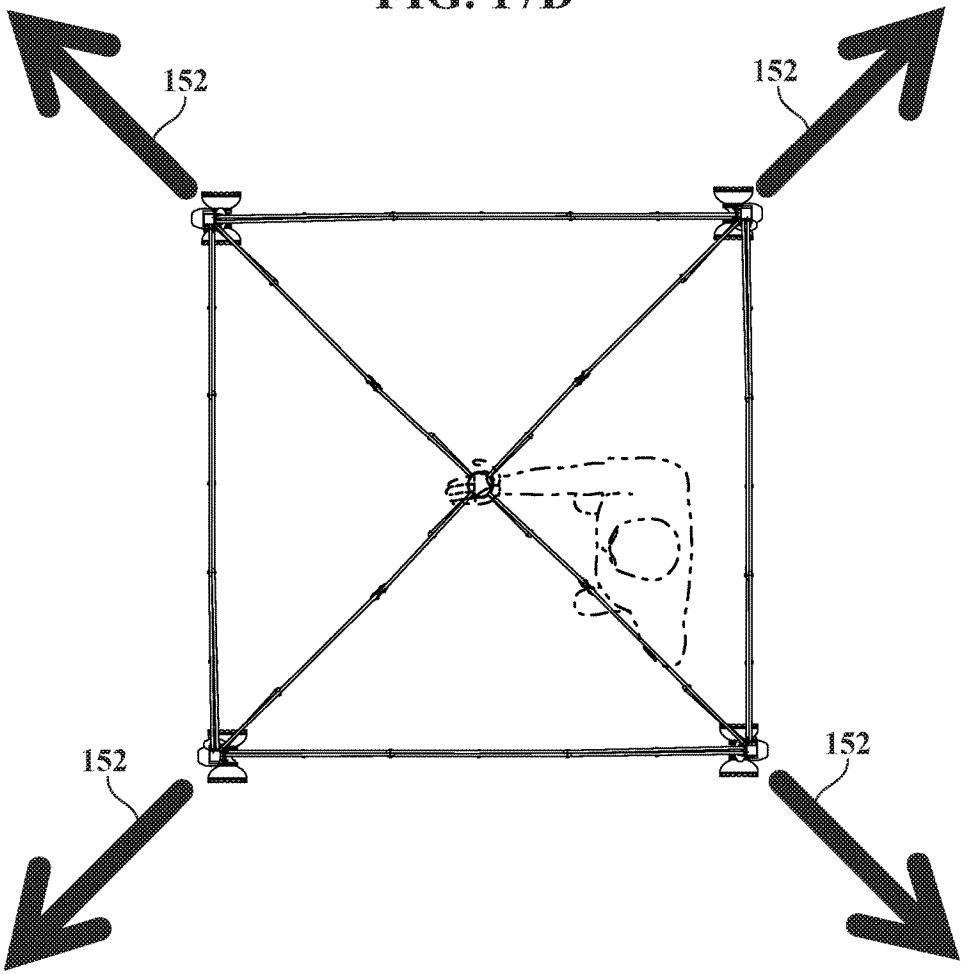
Figure 17E:
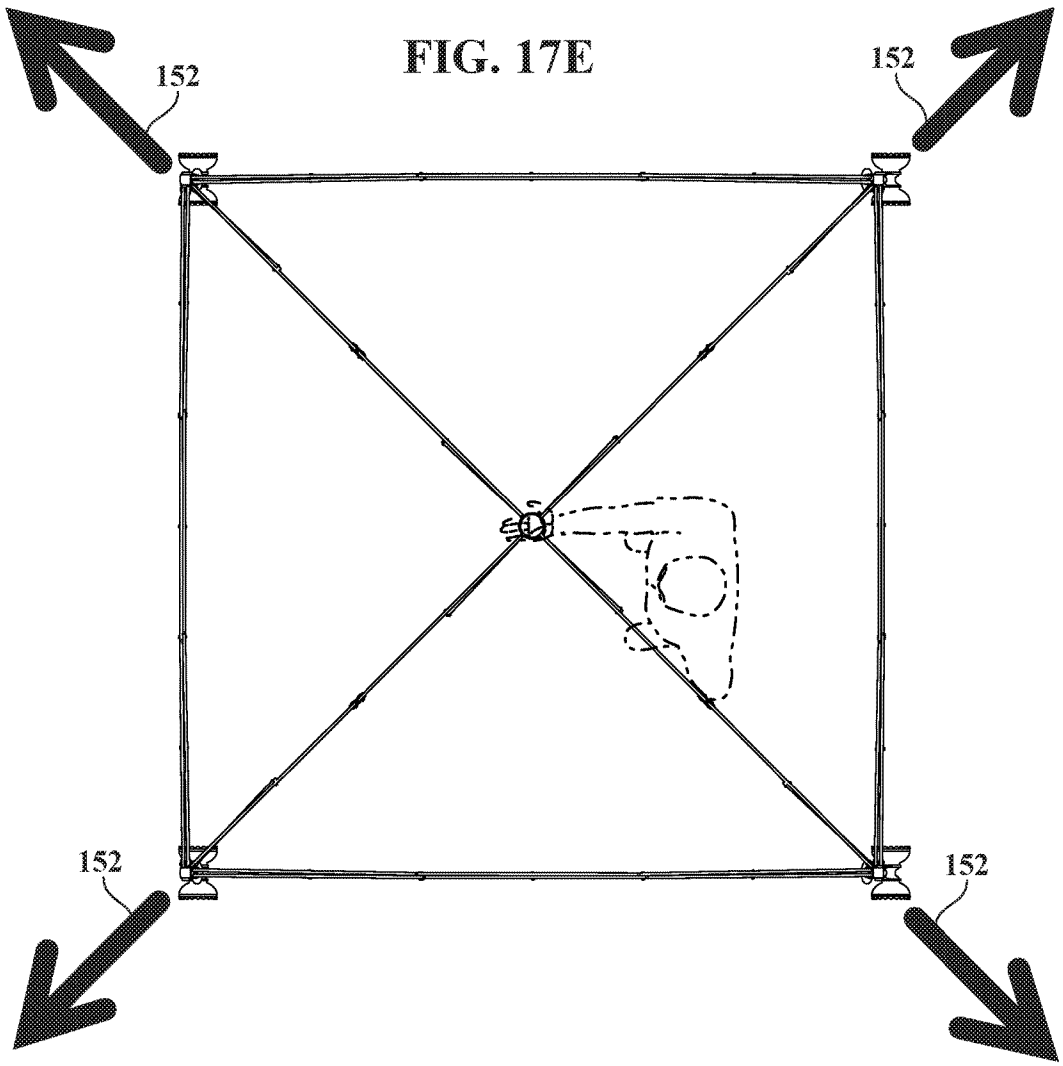
Figure 17F:
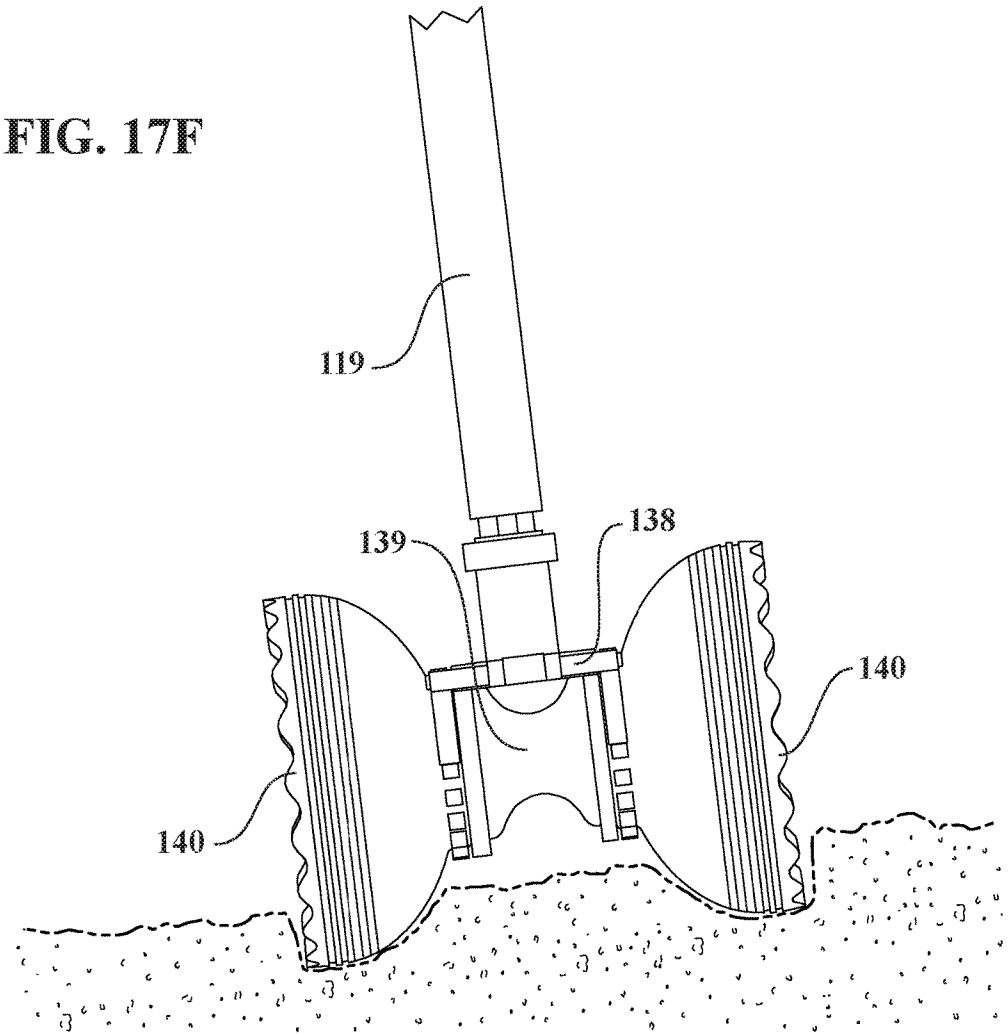
FIG. 17F and FIG. 17G illustrates a front views front views demonstrating the assembly of the arthritic-assisting one-person-deploying adjustable-central-canopy adjustable-ring-canopy rollable central-one-push-locking popup can be used on uneven or rough terrain.
Figure 17G:
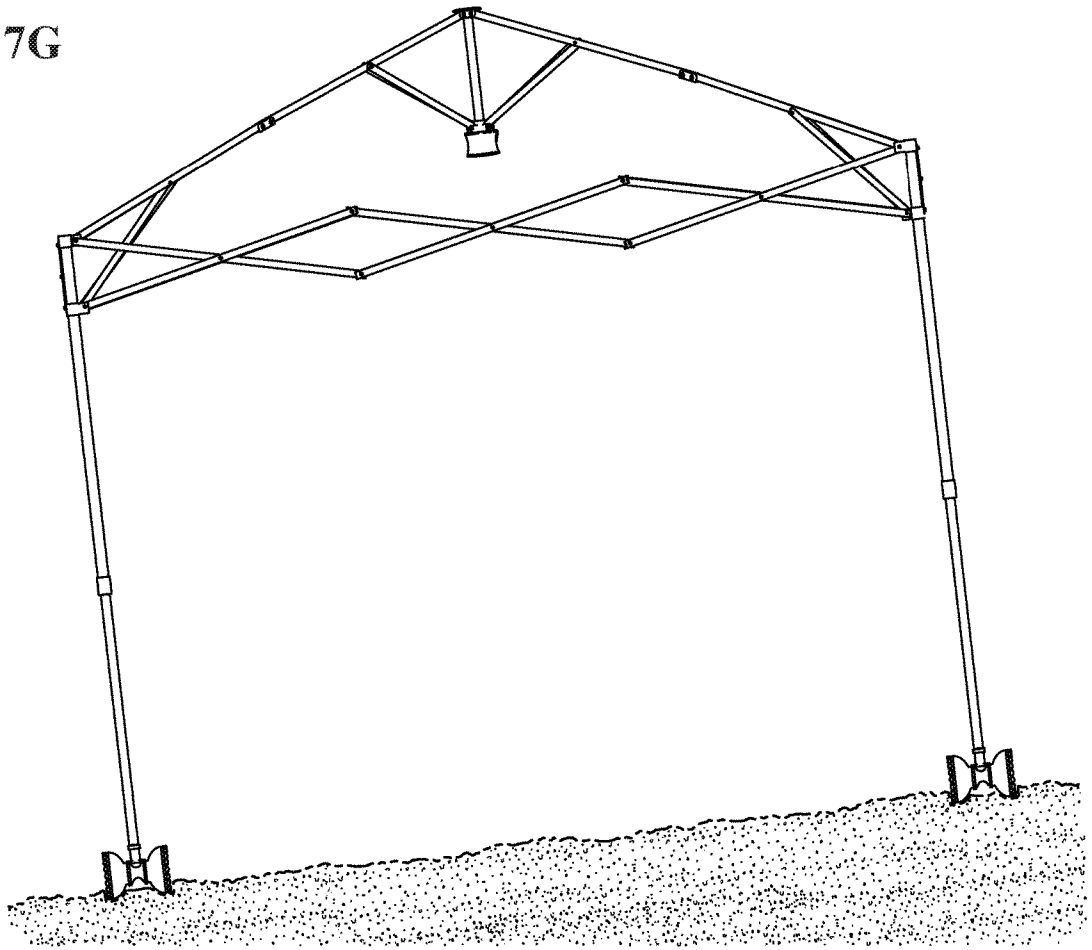

30) Arthritic-assisting tapered wedge button is for:

a) Pushing arthritic-assisting self-centering spring-loaded housing-locking hook 126 out of button tunnel 129; and b) Allowing a person with arthritis to ability to disengage the arthritic-assisting self-centering spring-loaded housing-locking hook 126 without the need to use their fingers
in the direction of arrow 150
(see FIG. 16).

31) Foldable adjustable central trusses 131 respectively are for:

a) Adjusting the height of adjustable central canopy 122 to raise and lower adjustable central canopy 122;

b) Opening and closing the opening between adjustable central canopy 122 adjustable ring canopy 102; and c) Folding and unfolding adjustable central canopy 122.

32) Arthritic-assisting multi-function locking hook-pulley-axle-wheel caster system 132 is for performing the combined functions of its components.

Figure 14:
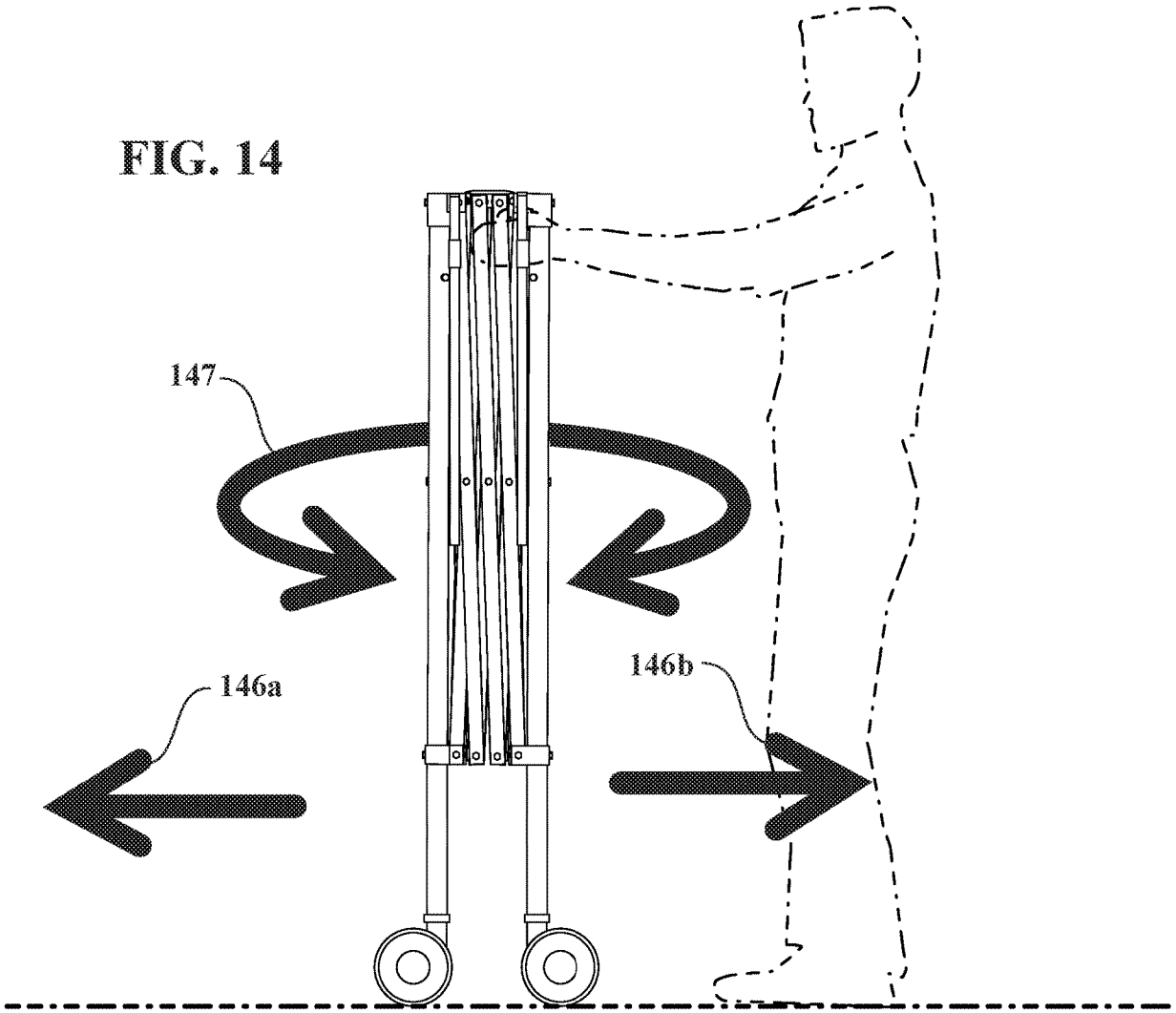

33) Pivoting threaded caster pins 133 respectively are for:

a) Lockingly, threadidly, and pivotably attaching pulley-axle-and-locking-wheel braces 138 to the bottom end of at least one of four lower posts 119; and b) Allowing the one-person-deploying adjustable-central-canopy adjustable-ring-canopy single-central-innersurface-arthritic-assisting rollable one-touch popup to freely move in any direction when collapsed or fully deployed
in the directions of arrows 146*a*, 146*b*, and 147
(see FIG. 14).

Figure 18A:
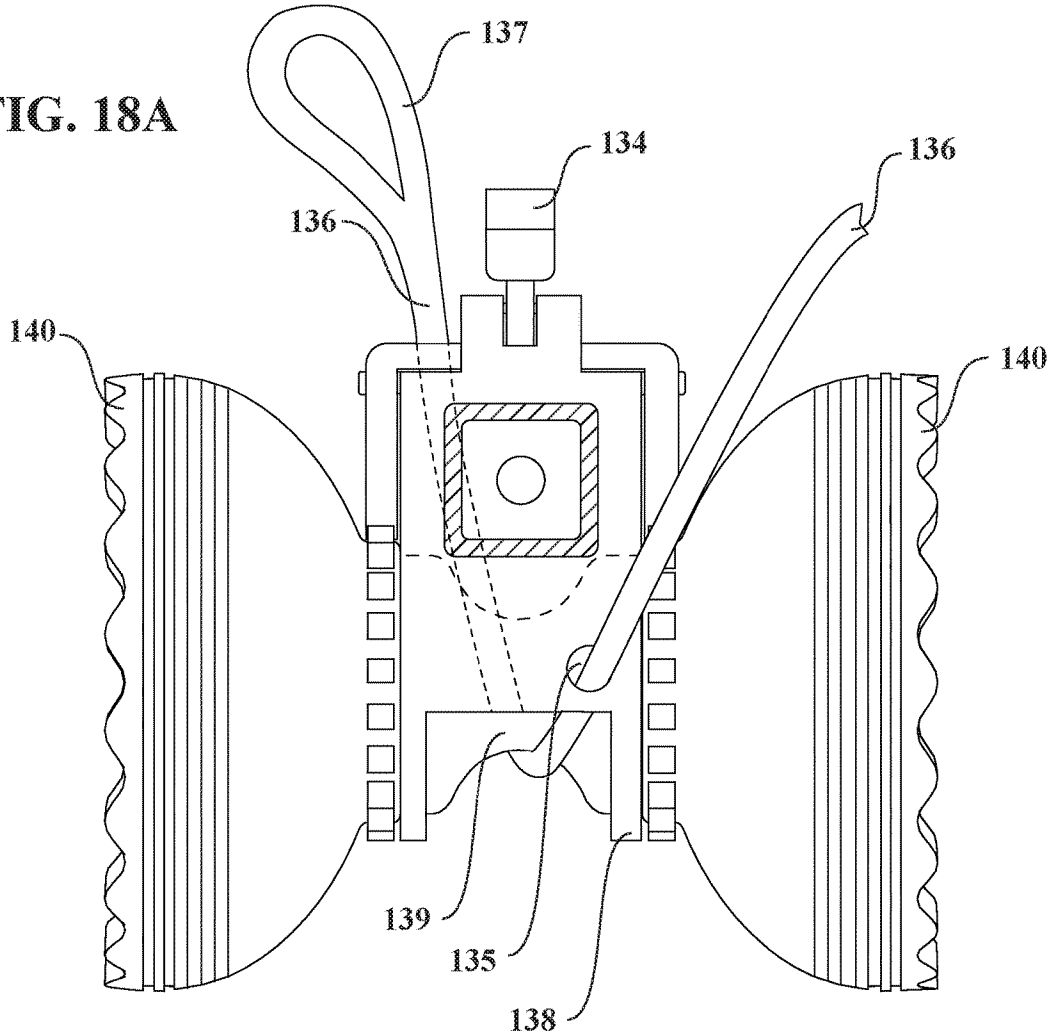
FIG. 18A, FIG. 18B, FIG. 18C, FIG. 18D, and FIG. 18E illustrate perspective and top views of how ropes and rope loop ends hook on and interact with wheel-locking hooks, four post-height-adjusting arthritis-assisting spring-loaded rope-hook rockers, pulley-axle-and-locking-wheel braces, rope-guiding holes and pulley-axles, respectively, to tighten adjustable ring canopy and adjustable central canopy.
Figure 18B:
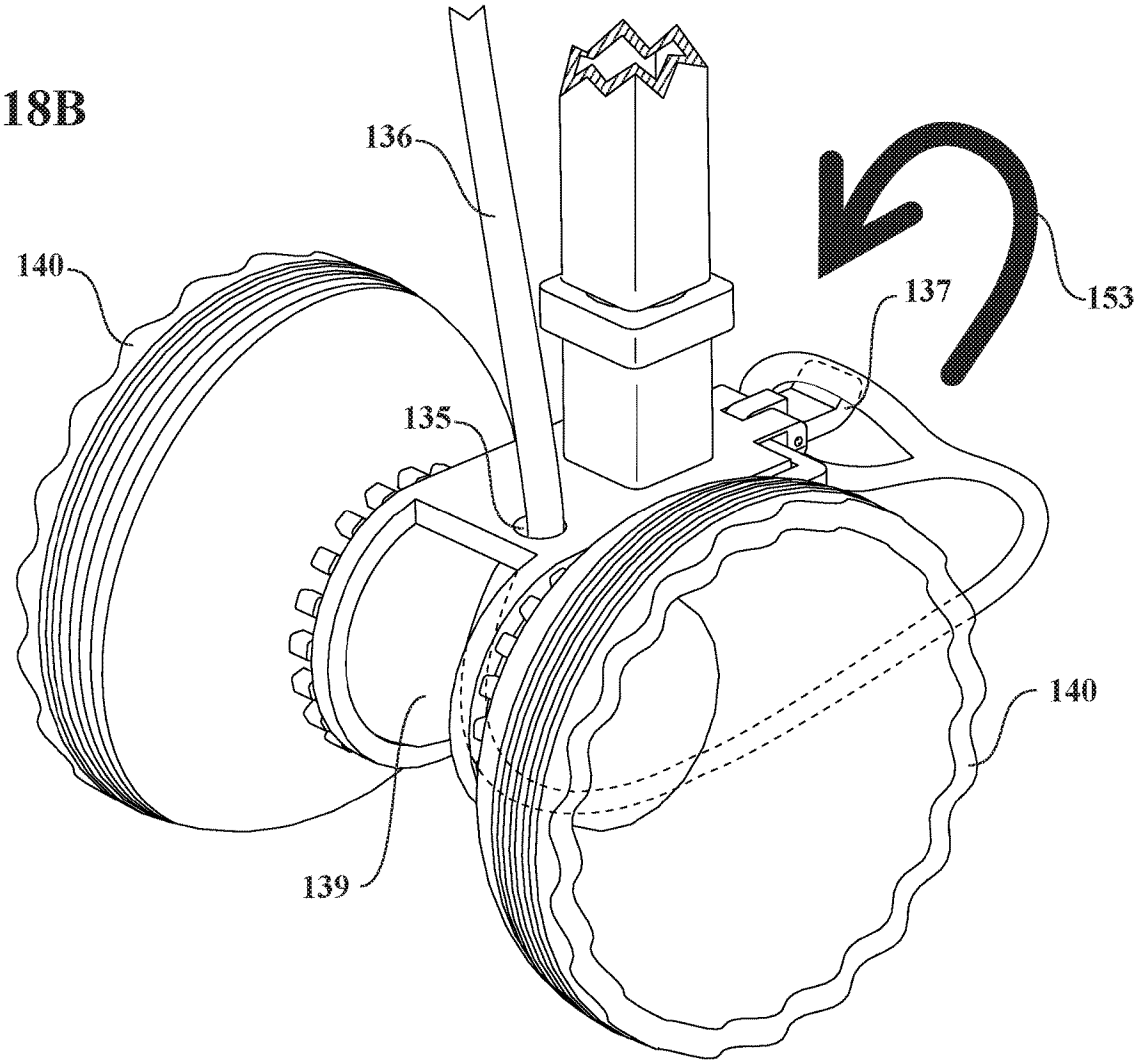

34) Arthritic-assisting wheel-locking spring-loaded rope-loop hooks 134*a* respectively are for:

a) Locking oversized shock-absorbing locking-wheels 140 to prevent them from rolling when desired
in the directions of arrows 141 and 142
(see FIG. 12A, FIG. 12B, FIG. 12C, and FIG. 12D); and b) Hooking ropes 136 thereon
in the direction of arrow 153
(see FIG. 18B).

Figure 12A:
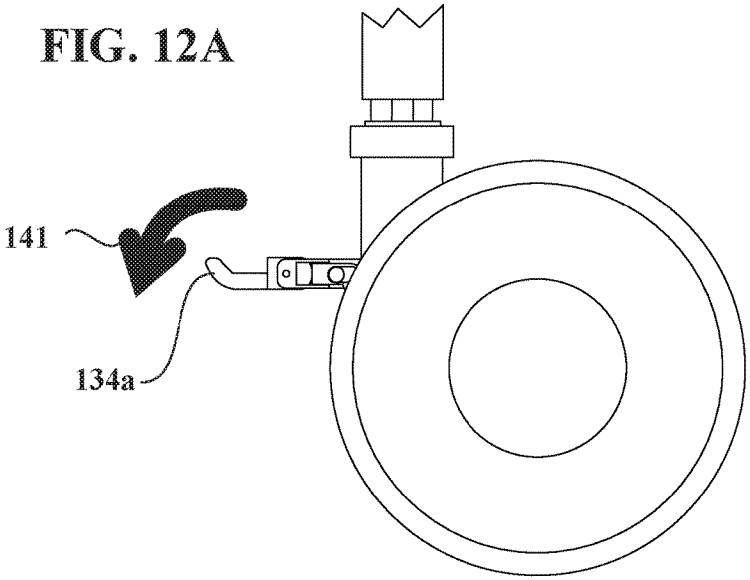
FIG. 12A, FIG. 12B, FIG. 12C, and FIG. 12D illustrate side views demonstrating the function of the arthritic-assisting multi-function locking hook-pulley-axle-wheel caster system locking and unlocking the oversized shock-absorbing locking-wheels.
Figure 12B:
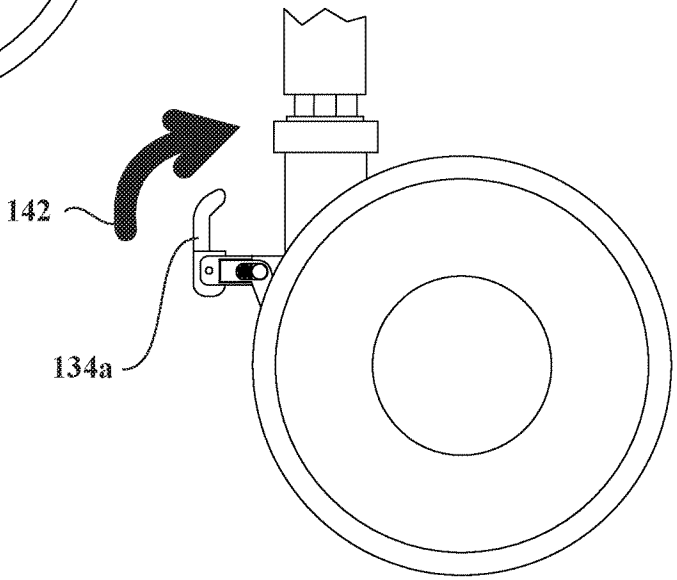
Figures 12C, 12D:
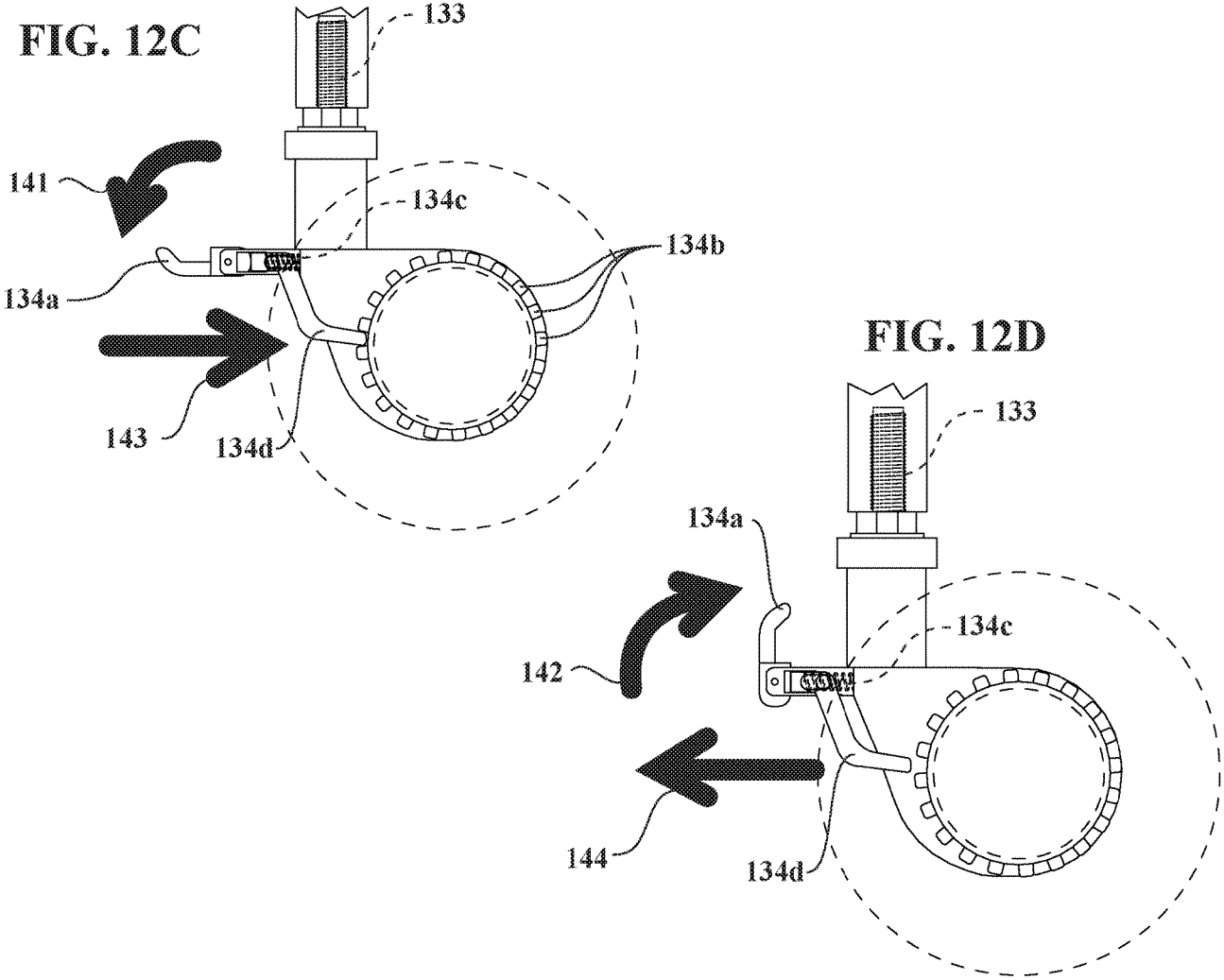

Wheel gears 134*b* respectively are for:

Locking oversized shock-absorbing locking-wheels 140 in place
to prevent rolling
(see FIG. 12C and FIG. 12D).

Peg springs 134*c* respectively are for:

Spingingly and slidedly moving gear-locking pegs 134*d*
to automatically disengage gear-locking pegs 134*d* to unlock oversized shock-absorbing locking-wheels 140
(see FIG. 12C and FIG. 12D).

Gear-locking pegs 134*d* respectively are for:

Slidedly engaging wheel gears 134*b*
to lock and unlock oversized shock-absorbing locking-wheels 140 in the direction of arrows 143 and 144
(see FIG. 12C and FIG. 12D).

35) Rope-guiding holes 135 respectively are for:

a) Threading ropes 136 therethrough
(see FIG. 18A, and FIG. 18B); and b) Guiding ropes 136 diagonally across pulley-axles 139.

Figure 18C:
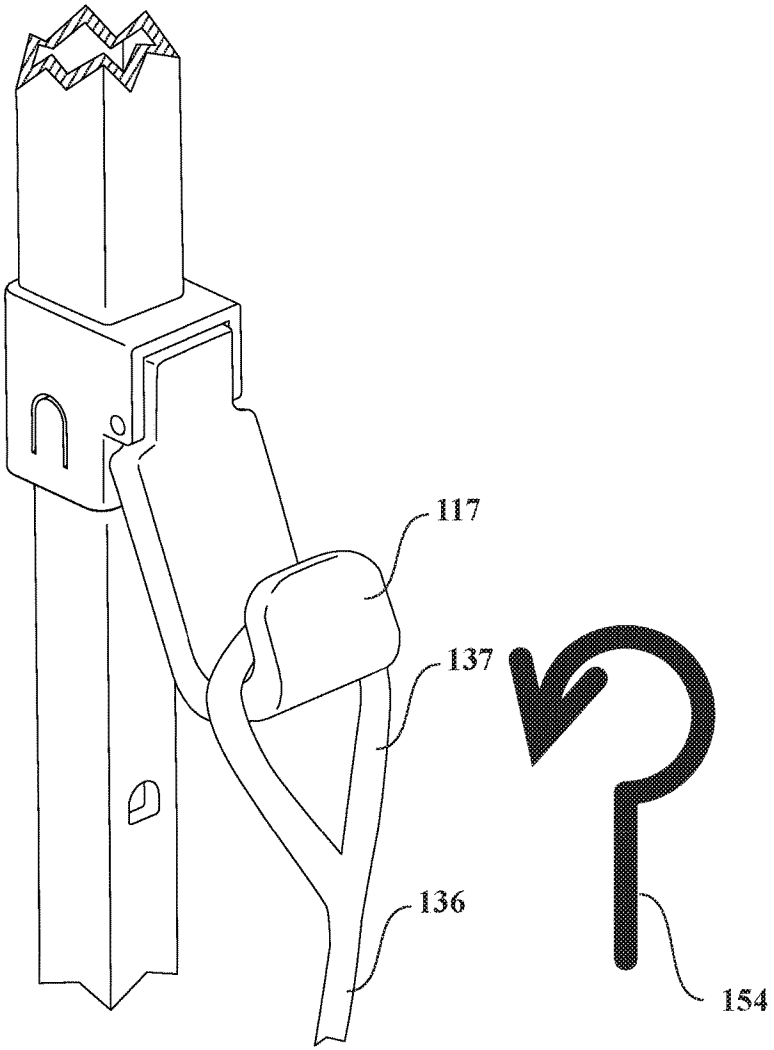
Figure 18D:
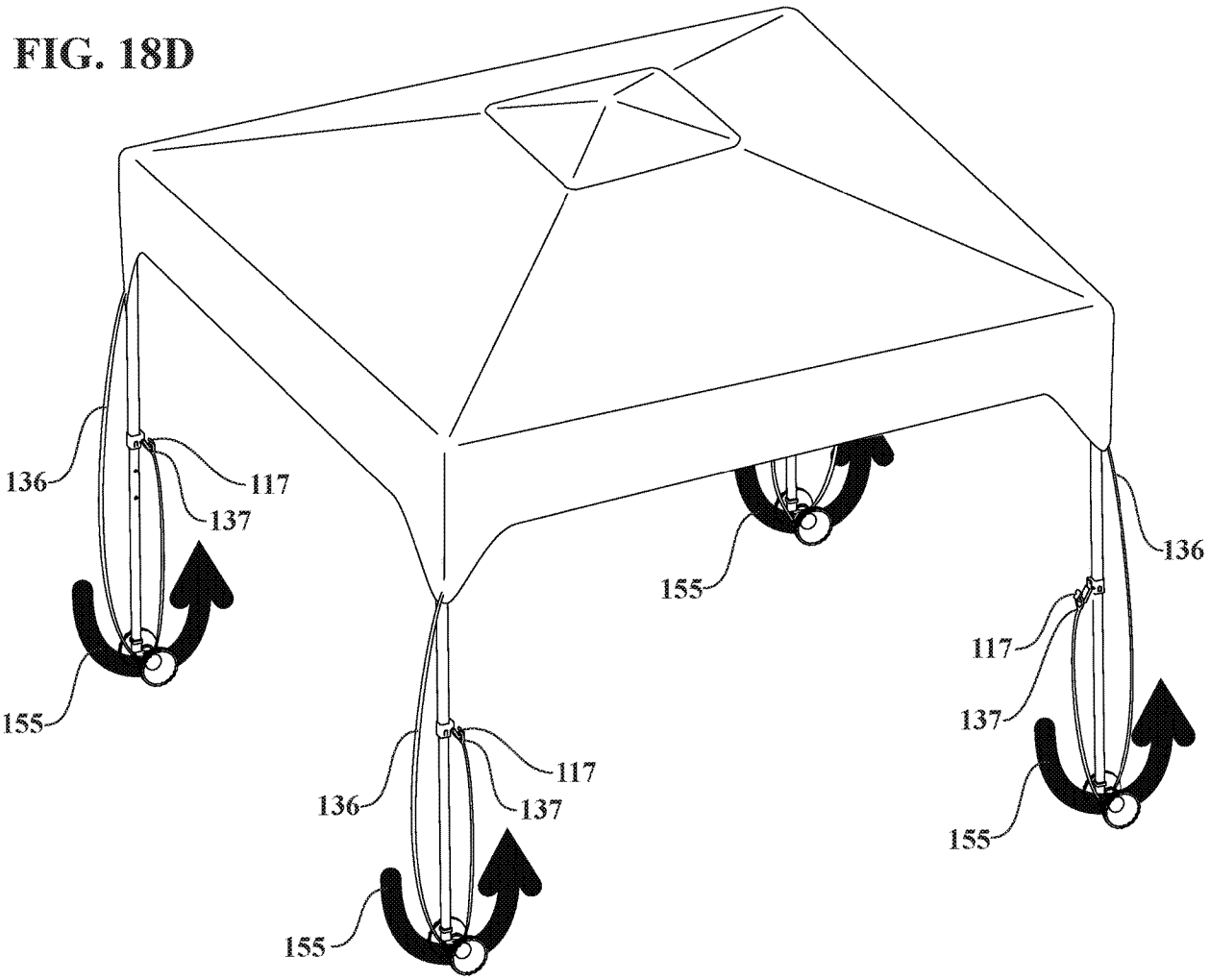
Figure 18E:
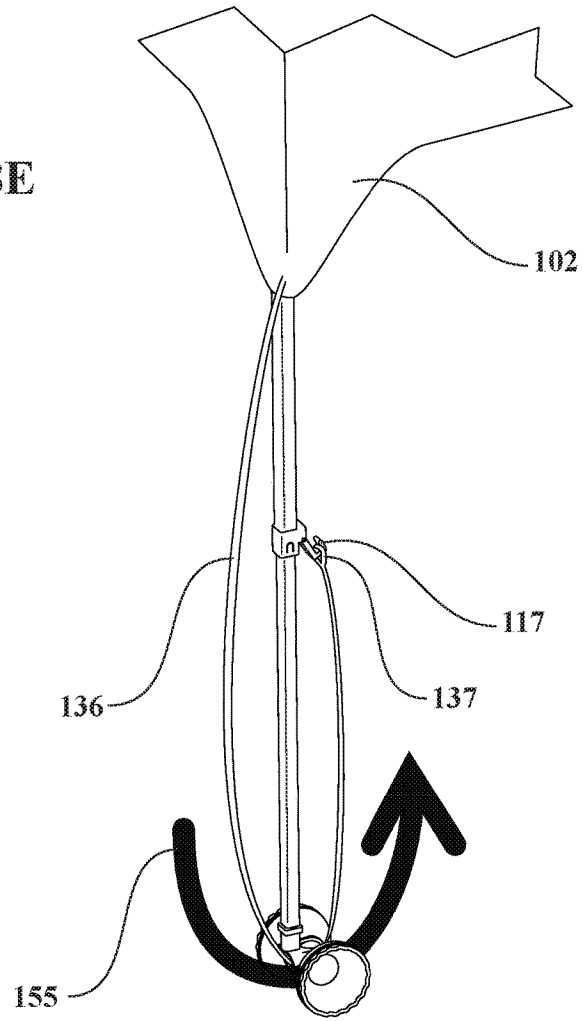
Figure 19A:
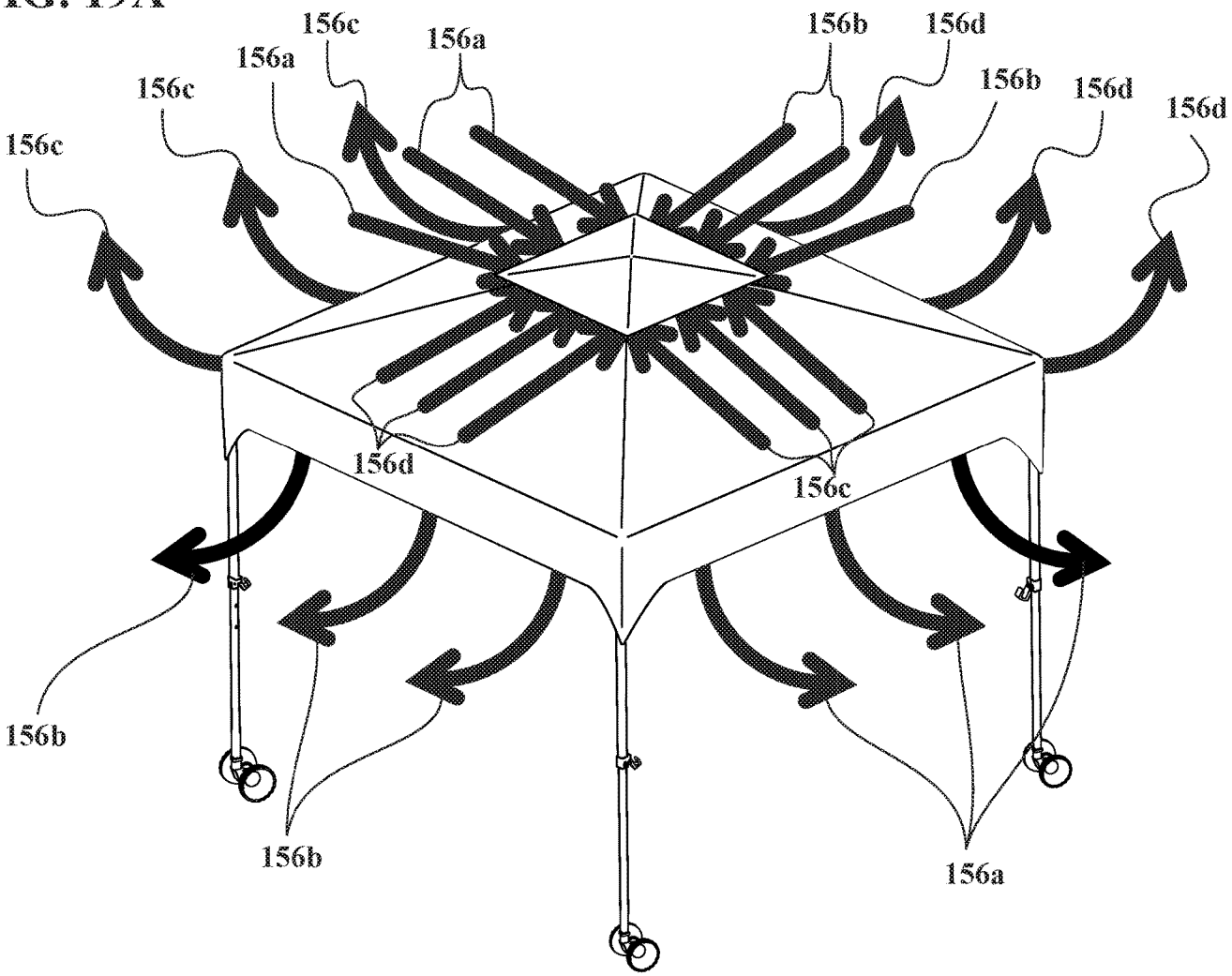
FIG. 19A, and FIG. 19B illustrate perspective views of how adjustable ring canopy and adjustable central canopy can circulate airflow and drive smoke out of the arthritic-assisting one-person-deploying adjustable-central-canopy adjustable-ring-canopy rollable central-one-push-locking popup.
Figure 19B:
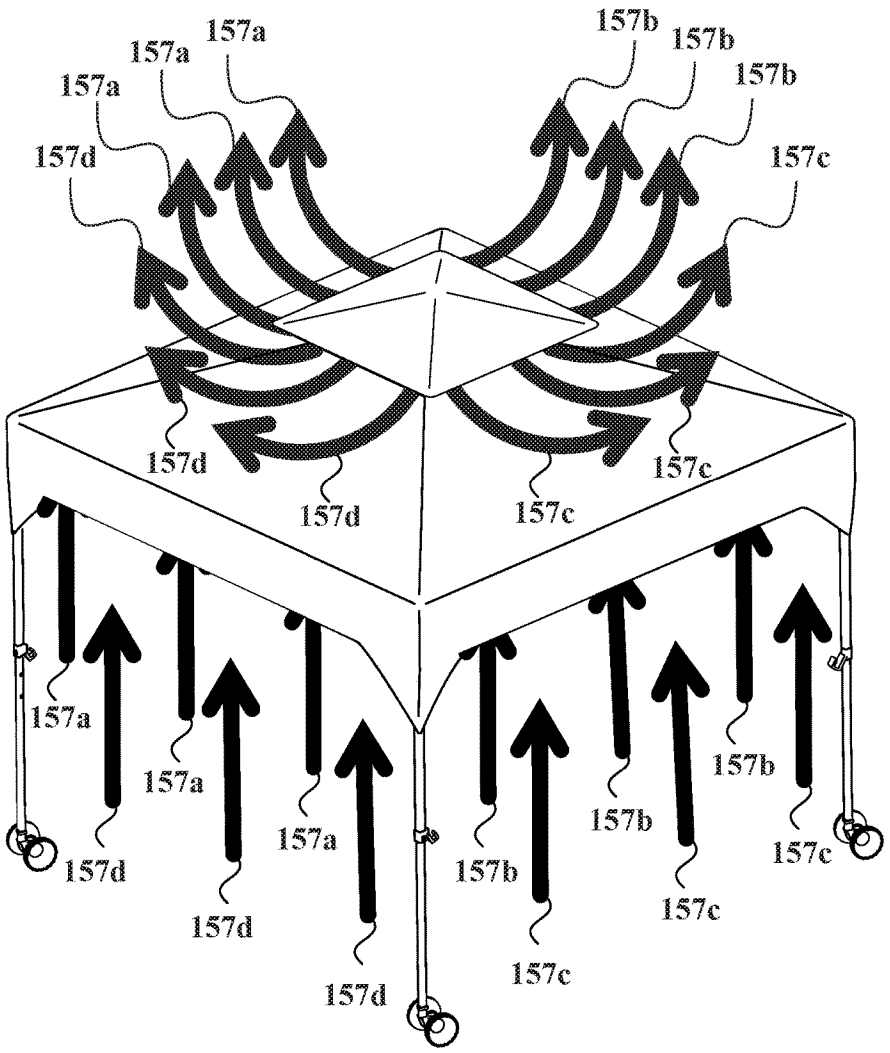

36) Ropes 136 respectively are for:

a) Being hooked on at least one of arthritic-assisting wheel-locking spring-loaded rope-loop hooks 134*a*
in the direction of arrow 153
(see FIG. 18B);

b) Being hooked on at least one of arthritic-assisting post-height-adjusting spring-loaded rope-loop hooks 117
in the direction of arrow 154
(see FIG. 18C); and c) Being threaded around pulley-axles 139 in the direction of arrow 155
(see FIG. 18D).

37) Rope loop ends 137 respectively are for:

a) Being hooked on at least one of arthritic-assisting wheel-locking spring-loaded rope-loop hooks 134*a*
in the direction of arrow 153
(see FIG. 18B); and b) Being hooked on at least one of arthritic-assisting post-height-adjusting spring-loaded rope-loop hooks 117
in the direction of arrow 154
(see FIG. 18C).

38) Pulley-axle-and-locking-wheel braces 138 respectively are for:
Attaching pulley-axles 139 to pivoting threaded caster pins 133.

39) Pulley-axles 139 respectively are for:
a) Functioning as pulley to wrap ropes 136 thereon
to reduce rope-pulling forces needed to pull on ropes 136 to stretch adjustable ring canopy 102
(see FIG. 18D); and
b) Functioning as axle to wrap to rotatably attach oversized shock-absorbing locking-wheels 140 thereon.

Figure 13:
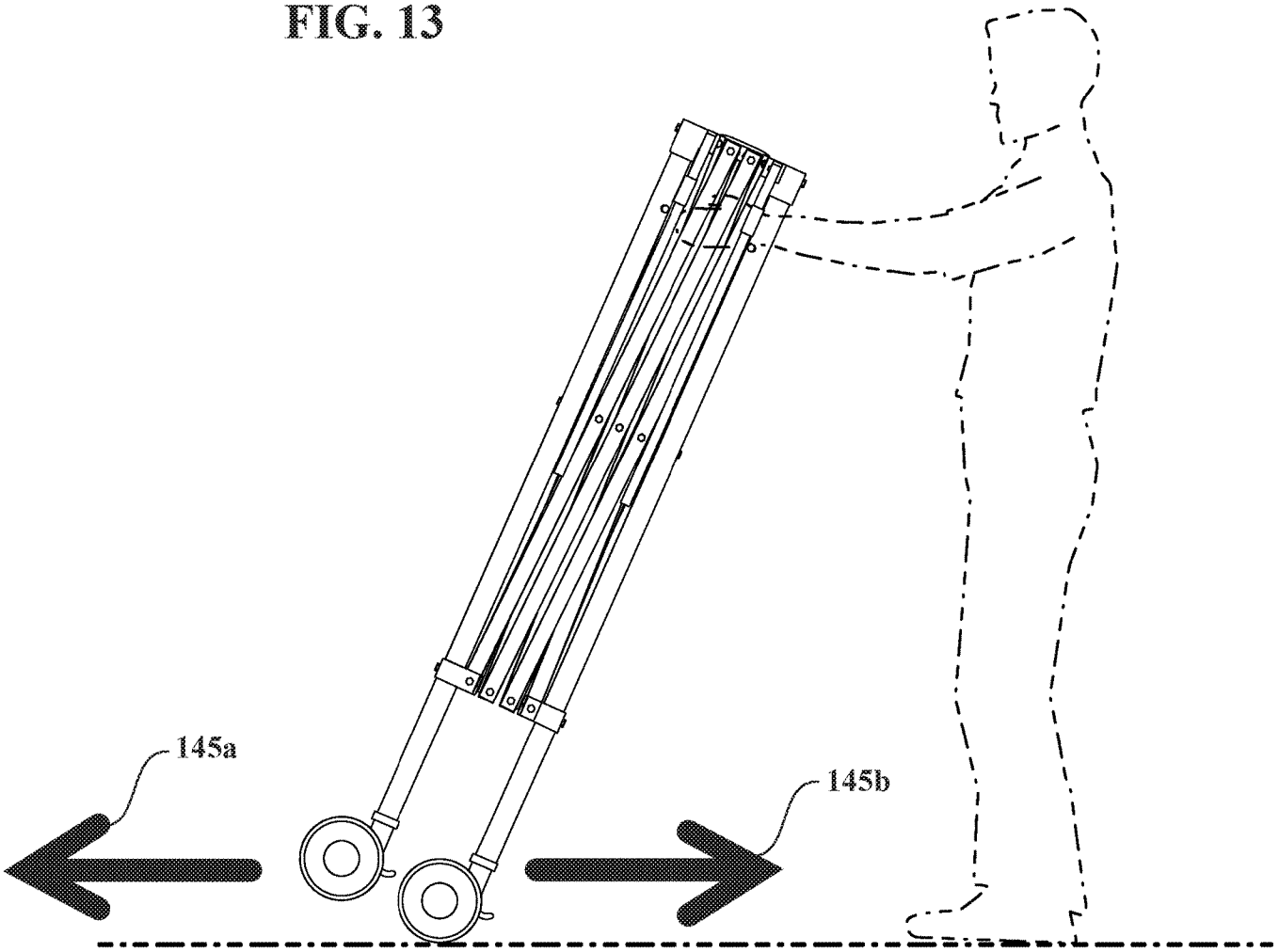
FIG. 13, and FIG. 14 illustrate side views of how one person can easily move the arthritic-assisting one-person-deploying adjustable-central-canopy adjustable-ring-canopy rollable central-one-push-locking popup using the arthritic-assisting multi-function locking hook-pulley-axle-wheel caster systems.

40) Oversized shock-absorbing locking-wheels 140 respectively are for:
a) Functioning as wheel
to allow the arthritic-assisting one-person-deploying adjustable-central-canopy adjustable-ring-canopy rollable central-one-push-locking popup to be rolled along the ground or a hard surface for transportation and storage
(see FIG. 14);
b) Functioning as wheel
to allow the arthritic-assisting one-person-deploying adjustable-central-canopy adjustable-ring-canopy rollable central-one-push-locking popup to be rolled along a sandy terrain
(see FIG. 14); and
c) Functioning as wheel
to allow the arthritic-assisting one-person-deploying adjustable-central-canopy adjustable-ring-canopy rollable central-one-push-locking popup to be rolled upon rough and/or uneven terrain
(see FIG. 1F, FIG. 1G, FIG. 17F and FIG. 17G).
d) Functioning as wheel
to allow the arthritic-assisting one-person-deploying adjustable-central-canopy adjustable-ring-canopy rollable central-one-push-locking popup to be leaned backward on two oversized shock-absorbing locking-wheels 140 and rolled upon the ground
in the directions of arrows 145*a* and 145*b*
(see FIG. 13).

Variation

Figure 20B:
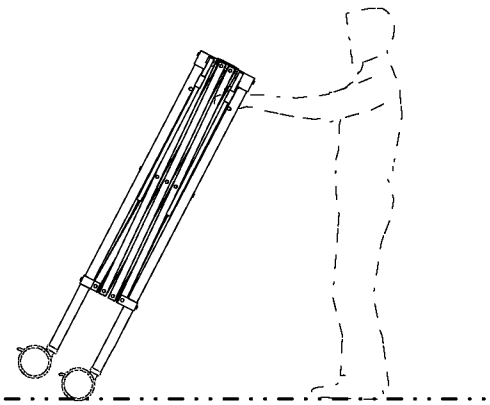
FIG. 20A, and FIG. 20B illustrate side views of equivalent variations of arthritic-assisting one-person-deploying adjustable-central-canopy adjustable-ring-canopy rollable central-one-push-locking popup in its collapsed state.
Figure 20A:
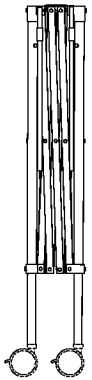
Figure 21B:
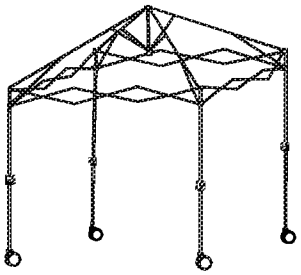
FIG. 21A, FIG. 21B, FIG. 21C, and FIG. 21D illustrate perspective views of equivalent variations arthritic-assisting one-person-deploying adjustable-central-canopy adjustable-ring-canopy rollable central-one-push-locking popup.
Figure 21D:
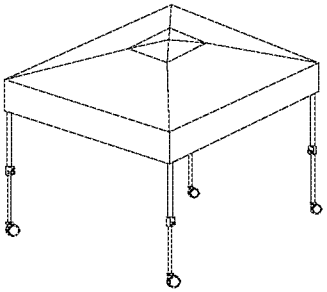
Figure 21A:
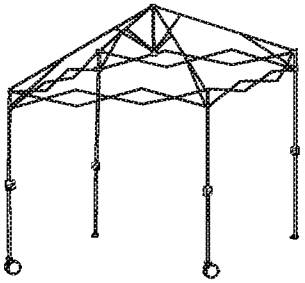
Figure 21C:
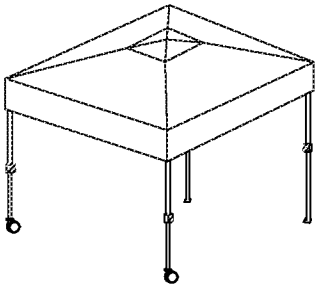
Figure 22B:
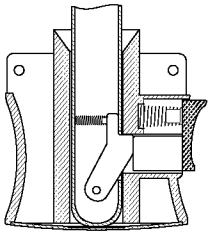
FIG. 22A, FIG. 22B, FIG. 22C, and FIG. 22D illustrates perspective, cross-sectional, side, and exploded views of equivalent variations of central-innersurface-locking spring, arthritic-assisting self-centering spring-loaded housing-locking hook, arthritic-assisting central-one-push-locking adjustable housing, and arthritic-assisting tapered wedge button.
Figure 22D:
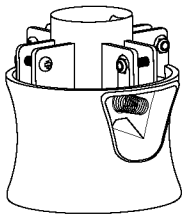
Figure 22A:
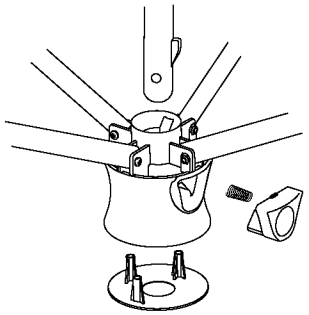
Figure 22C:
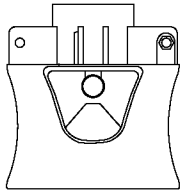
Figure 23A:
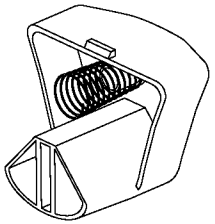
FIG. 23A, FIG. 23B, FIG. 23C, FIG. 23D, FIG. 23E, and FIG. 23F illustrates perspective, front, back, top, and side views of equivalent variations of the arthritic-assisting tapered wedge button.
Figure 23B:
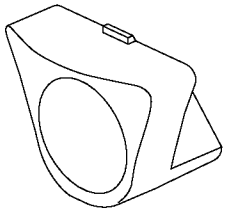
Figure 23C:
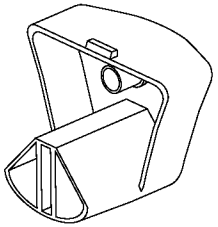
Figure 23D:
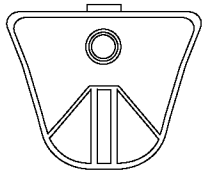
Figure 23E:
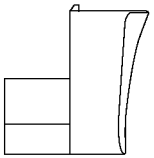
Figure 23F:
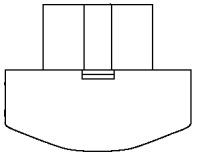
Figure 24A:
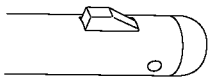
FIG. 24A, FIG. 24B, FIG. 24C, and FIG. 24D illustrate perspective, cross-sectional, and side views of equivalent variations of central post, central-innersurface-locking spring, and arthritic-assisting self-centering spring-loaded housing-locking hook.
Figure 24B:
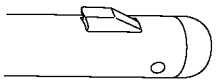
Figure 24C:
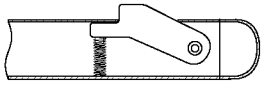
Figure 24D:
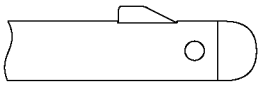
Figure 25:
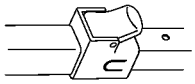
FIG. 25 illustrate a perspective view of equivalent variation of arthritic-assisting post-height-adjusting spring-loaded rope-loop hooks.
Figure 26:
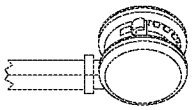
FIG. 26 illustrates a perspective view of equivalent variation of Arthritic-assisting multi-function hook-pulley-axel-wheel caster system.

Any component of the arthritic-assisting one-person-deploying adjustable-central-canopy adjustable-ring-canopy rollable central-one-push-locking popup can have any shape and size. Any component of the arthritic-assisting one-person-deploying adjustable-central-canopy adjustable-ring-canopy rollable central-one-push-locking popup can be replaced with an equivalent component. Any component of arthritic-assisting one-person-deploying adjustable-central-canopy adjustable-ring-canopy rollable central-one-push-locking popup can be made of any material(s) or any combination of any materials. Any component of the arthritic-assisting one-person-deploying adjustable-central-canopy adjustable-ring-canopy rollable central-one-push-locking popup can be made of any flexible, semi-flexible, bendable, semi-bendable, stretchable, semi-stretchable, rigid, or semi-rigid material(s). Any component-attaching method of the arthritic-assisting one-person-deploying adjustable-central-canopy adjustable-ring-canopy rollable central-one-push-locking popup can be replaced with an equivalent method. For example, FIG. 20A and FIG. 20B illustrate side views of equivalent variations of the arthritic-assisting one-person-deploying adjustable-central-canopy adjustable-ring-canopy rollable central-one-push-locking popup in its folded position. For example, FIG. 21A, FIG. 21B, FIG. 21C, and FIG. 21D illustrate side and perspective views of equivalent variations of the arthritic-assisting one-person-deploying adjustable-central-canopy adjustable-ring-canopy rollable central-one-push-locking popup having 2 and or 4 multi-function arthritic-assisting locking hook-pulley-axle-wheel caster systems 132. For example, FIG. 22A, FIG. 22B, FIG. 22C, and FIG. 22D illustrate side, cross-sectional and perspective views of equivalent variations of the arthritic-assisting central-one-push-locking adjustable housing 127 with its included elements. For example, FIG. 23A, FIG. 23B, FIG. 23C, FIG. 23D, FIG. 23E, and FIG. 23F illustrate side, top, back, front and perspective views of equivalent variations of the arthritic-assisting tapered wedge button 130. For example, FIG. 24A, FIG. 24B, FIG. 24C, and FIG. 24D illustrate perspective, cross-sectional, and side views of equivalent variations of central post 123 and arthritic-assisting self-centering spring-loaded housing-locking hook 126. For example, FIG. 25 illustrates a perspective view of equivalent variations of arthritic-assisting post-height-adjusting spring-loaded rope-loop hooks 117. For example, FIG. 26 illustrates a perspective view of equivalent variations of multi-function arthritic-assisting locking hook-pulley-axle-wheel caster system 132.

MAJOR ADVANTAGES OF THE INVENTION

The present invention substantially departs from the conventional concepts and designs of the prior art. In doing so, the present invention provides an arthritic-assisting one-person-deploying adjustable-central-canopy adjustable-ring-canopy rollable central-one-push-locking popup, having many unique and significant features, functions, and advantages, which overcome all the disadvantages of the prior art, as follows:

1) It is an object of the new invention to provide an arthritic-assisting one-person-deploying adjustable-central-canopy adjustable-ring-canopy rollable central-one-push-locking popup, having
adjustable ring canopy 102 and
adjustable central canopy 122.
Therefore, the arthritic-assisting one-person-deploying adjustable-central-canopy adjustable-ring-canopy rollable central-one-push-locking popup:
a) Can provide shade to occupants,
to prevent sunburn;
b) Can be adjusted up and down to increase airflow into and out of the arthritic-assisting one-person-deploying adjustable-central-canopy adjustable-ring-canopy rollable central-one-push-locking popup,
to keep occupants cool;
c) Can help with airflow out of the arthritic-assisting one-person-deploying adjustable-central-canopy adjustable-ring-canopy rollable central-one-push-locking popup,
to assist in smoke exiting the arthritic-assisting one-person-deploying adjustable-central-canopy adjustable-ring-canopy rollable central-one-push-locking popup; and
d) Can provide rain protection,
to keep occupants dry.

2) It is another object of the new invention to provide an arthritic-assisting one-person-deploying adjustable-central-canopy adjustable-ring-canopy rollable central-one-push-locking popup, having arthritic-assisting central-one-push-locking adjustable housing 127.

Therefore, the one-person-deploying adjustable-central-canopy adjustable-ring-canopy single-central-innersurface-arthritic-assisting rollable one-touch popup:

a) Can snap lock central post 123 to the rest of the canopy structure,
to increase overall strength of the arthritic-assisting one-person-deploying adjustable-central-canopy adjustable-ring-canopy rollable central-one-push-locking popup;

b) Can lock canopy together,
to prevent the arthritic-assisting one-person-deploying adjustable-central-canopy adjustable-ring-canopy rollable central-one-push-locking popup from collapsing; and c) Can decrease the total number of locking points,
to make setup easier.

3) It is another object of the new invention to provide an arthritic-assisting one-person-deploying adjustable-central-canopy adjustable-ring-canopy rollable central-one-push-locking popup, having
oversized shock-absorbing locking-wheels 140.

Therefore, the arthritic-assisting one-person-deploying adjustable-central-canopy adjustable-ring-canopy rollable central-one-push-locking popup:

a) Can be used as pulleys to thread ropes 136,
to tighten canopies;

b) Can be used to roll the arthritic-assisting one-person-deploying adjustable-central-canopy adjustable-ring-canopy rollable central-one-push-locking popup along the ground when in collapsed configuration,
to make transportation easier;

c) Can be used to assist in moving arthritic-assisting one-person-deploying adjustable-central-canopy adjustable-ring-canopy rollable central-one-push-locking popup when fully erected,
to help with relocating the arthritic-assisting one-person-deploying adjustable-central-canopy adjustable-ring-canopy rollable central-one-push-locking popup; and d) Can be used to roll the arthritic-assisting one-person-deploying adjustable-central-canopy adjustable-ring-canopy rollable central-one-push-locking popup on rough and/or uneven terrain
to help with relocating the arthritic-assisting one-person-deploying adjustable-central-canopy adjustable-ring-canopy rollable central-one-push-locking popup in more locations.

4) It is a further object of the new invention to provide an arthritic-assisting one-person-deploying adjustable-central-canopy adjustable-ring-canopy rollable central-one-push-locking popup, having
tick-preventing downward teeth 115.

Therefore, the arthritic-assisting one-person-deploying adjustable-central-canopy adjustable-ring-canopy rollable central-one-push-locking popup:

a) Can prevent ticks from getting inside four upper posts 112 and four lower posts 119,
to protect occupants from disease;

b) Can help protect from weather elements getting up inside four upper posts 112 and four lower posts 119,
to help prevent against rust and increase the lifetime of the arthritic-assisting one-person-deploying adjustable-central-canopy adjustable-ring-canopy rollable central-one-push-locking popup;

c) Can assist in water drainage,
to help prevent rusting; and d) Can provide additional structure to four sleeves 114*a*,
to increase strength of four upper posts 112 and four lower posts 119.

5) It is an even further object of the new invention to provide an arthritic-assisting one-person-deploying adjustable-central-canopy adjustable-ring-canopy rollable central-one-push-locking popup, having
post-centering clamps 114*b*.

Therefore, the arthritic-assisting one-person-deploying adjustable-central-canopy adjustable-ring-canopy rollable central-one-push-locking popup:

a) Can center four lower posts 119 within four upper posts 112,
to help with assembly and disassembly;

b) Can help keep ticks from entering into four upper posts 112 and four lower posts 119,
to protect occupants;

c) Can provide addition strength and stability to four upper posts 112 and four lower posts 119,
to keep occupants safe and increase the arthritic-assisting one-person-deploying adjustable-central-canopy adjustable-ring-canopy rollable central-one-push-locking popup's lifetime; and d) Can keep four upper posts 112 and four lower posts 119 from binding
to help with adjusting the arthritic-assisting one-person-deploying adjustable-central-canopy adjustable-ring-canopy rollable central-one-push-locking popup up and down.

6) It is another object of the new invention to provide an arthritic-assisting one-person-deploying adjustable-central-canopy adjustable-ring-canopy rollable central-one-push-locking popup, having
central post 123.

Therefore, the arthritic-assisting one-person-deploying adjustable-central-canopy adjustable-ring-canopy rollable central-one-push-locking popup:

a) Can provide lateral strength to the arthritic-assisting one-person-deploying adjustable-central-canopy adjustable-ring-canopy rollable central-one-push-locking popup,
to keep arthritic-assisting one-person-deploying adjustable-central-canopy adjustable-ring-canopy rollable central-one-push-locking popup from radially twisting;

b) Can lock canopy structure together,
to prevent canopy from collapsing; and c) Can decrease the total number of overall locking points,
to make setup easier.

7) It is yet another object of the new invention to provide an arthritic-assisting one-person-deploying adjustable-central-canopy adjustable-ring-canopy rollable central-one-push-locking popup, having
arthritic-assisting self-centering spring-loaded housing-locking hook 126.

Therefore, the arthritic-assisting one-person-deploying adjustable-central-canopy adjustable-ring-canopy rollable central-one-push-locking popup:

a) Can automatically guide central post 123 into arthritic-assisting central-one-push-locking adjustable housing 127,
to help with setup;

b) Can automatically lock and center arthritic-assisting self-centering spring-loaded housing-locking hook 126 to arthritic-assisting central-one-push-locking adjustable housing 127,
to help strengthen popup to withstand twisting and accidental collapsing;

c) Can automatically depress arthritic-assisting self-centering spring-loaded housing-locking hook 126,
to make locking central post 123 easier; and d) Can automatically provide less friction between arthritic-assisting central-one-push-locking adjustable housing 127 and central post 123,
to make setup and adjustment easier.

8) It is still yet another object of the new invention to provide an arthritic-assisting one-person-deploying adjustable-central-canopy adjustable-ring-canopy rollable central-one-push-locking popup, having
water-discharging grooves 116.

Therefore, the arthritic-assisting one-person-deploying adjustable-central-canopy adjustable-ring-canopy rollable central-one-push-locking popup:

a) Can allow water to drain from four upper posts 112 and four lower posts 119,
to prevent four upper posts 112 and four lower posts 119 from rusting;

b) Can prevent water from getting into posts,
to help prolong the life of the arthritic-assisting one-person-deploying adjustable-central-canopy adjustable-ring-canopy rollable central-one-push-locking popup;

c) Can help protect against insects,
to help protect occupants; and d) Can provide addition structure to four sleeves 114*a*,
to increase strength of four upper posts 112 and four lower posts 119.

9) It is still yet an even further object of the new invention to provide an arthritic-assisting one-person-deploying adjustable-central-canopy adjustable-ring-canopy rollable central-one-push-locking popup, having
arthritic-assisting post-height-adjusting spring-loaded rope-loop hooks 117.

Therefore, the arthritic-assisting one-person-deploying adjustable-central-canopy adjustable-ring-canopy rollable central-one-push-locking popup:

a) Can lock and release four post-height-adjusting nipples 118,
to adjust height of the arthritic-assisting one-person-deploying adjustable-central-canopy adjustable-ring-canopy rollable central-one-push-locking popup;

b) Can be used as a hook for rope loop ends 137,
to provide options of setup; and c) Can be used with those who have arthritis to allow pressing without the need to bend fingers,
to make setup for those with arthritis less painful.

10) It is still yet an even further object of the new invention to provide an arthritic-assisting one-person-deploying adjustable-central-canopy adjustable-ring-canopy rollable central-one-push-locking popup, having
four sleeves 114*a*.

Therefore, the arthritic-assisting one-person-deploying adjustable-central-canopy adjustable-ring-canopy rollable central-one-push-locking popup:

a) Can prevent four upper posts 112 and four lower posts 119 from scratching each other
to prevent premature wear or rusting;

b) Can minimize friction between four upper posts 112 and four lower posts 119,
to make raising and lowing easier;

c) Can protect exposed joints of four upper posts 112 and four lower posts 119,
to prevent rusting and increase lifetime; and d) Can join four upper posts 112 and four lower posts 119 together
to provide additional strength and support for posts.

11) It is still yet an even further object of the new invention to provide an arthritic-assisting one-person-deploying adjustable-central-canopy adjustable-ring-canopy rollable central-on e-push-locking popup, having
rope-guiding holes 135.

Therefore, the arthritic-assisting one-person-deploying adjustable-central-canopy adjustable-ring-canopy rollable central-one-push-locking popup:

a) Can be used to thread ropes 136 through,
to use with either pulley axle or hooks;

b) Can be used to guide ropes 136 diagonally across arthritic-assisting pulley-axles 139,
to prevent tangling;

c) Can be used as a rope pulley,
to be used with arthritic-assisting pulley-axles 139 and ropes 136; and d) Can be used as a tie-off location for ropes 136,
to increase customization options for ropes 136 and arthritic-assisting pulley-axles 139.

12) It is still yet an even further object of the new invention to provide an arthritic-assisting one-person-deploying adjustable-central-canopy adjustable-ring-canopy rollable central-one-push-locking popup, having
arthritic-assisting wheel-locking spring-loaded rope-loop hooks.

Therefore, the arthritic-assisting one-person-deploying adjustable-central-canopy adjustable-ring-canopy rollable central-one-push-locking popup:

a) Can hook canopy ropes 136 on arthritic-assisting wheel-locking spring-loaded rope-loop hooks 134*a*
to lock ropes 136 and all canopies to keep them from slipping when the popup is set up on a slope;

b) Can lock oversized shock-absorbing locking-wheels 140,
to help keep canopy from moving
when the popup is set up on a slope;

c) Can unlock oversized shock-absorbing locking-wheels 140,
to help with moving the canopy when desired; and d) Can unlock oversized shock-absorbing locking-wheels 140,
to help with moving the canopy when the canopy is collapsed.

13) It is still yet an even further object of the new invention to provide an arthritic-assisting one-person-deploying adjustable-central-canopy adjustable-ring-canopy rollable central-one-push-locking popup, having
arthritic-assisting pulley-axles 139.

Therefore, the arthritic-assisting one-person-deploying adjustable-central-canopy adjustable-ring-canopy rollable central-one-push-locking popup:

a) Can act as a pulley for rope
to lock ropes 136 and all canopies to keep them from slipping;

b) Can act as a pulley for rope 136,
to decrease the amount of strength needed to erect the canopy; and c) Can be used as an axle for oversized shock-absorbing locking-wheels 140,
to allow the oversized shock-absorbing locking-wheels 140 to roll.

14) It is still yet an even further object of the new invention to provide an arthritic-assisting one-person-deploying adjustable-central-canopy adjustable-ring-canopy rollable central-one-push-locking popup, having
pivoting threaded caster pins 133.
Therefore, the arthritic-assisting one-person-deploying adjustable-central-canopy adjustable-ring-canopy rollable central-one-push-locking popup:
a) Can allow arthritic-assisting multi-function locking hook-pulley-axle-wheel caster system 132 to rotate on a horizontal axis
to allow moving the canopy on its oversized shock-absorbing locking-wheels 140;
b) Can allow arthritic-assisting multi-function locking hook-pulley-axle-wheel caster system 132 to rotate freely,
to help with erecting the popup;
c) Can be used as a foot step,
to help with setup and to drive four lower posts 119 into the ground; and
d) Can hook ropes 136 on arthritic-assisting wheel-locking spring-loaded rope-loop hooks 134*a* from four lower posts 119,
to strengthen structure and keep four lower posts 119 from bending out.

15) It is still yet an even further object of the new invention to provide an arthritic-assisting one-person-deploying adjustable-central-canopy adjustable-ring-canopy rollable central-one-push-locking popup, having
arthritic-assisting tapered wedge button 130.
Therefore, the arthritic-assisting one-person-deploying adjustable-central-canopy adjustable-ring-canopy rollable central-one-push-locking popup:
a) Can release arthritic-assisting self-centering spring-loaded housing-locking hook 126
to unlock arthritic-assisting central-one-push-locking adjustable housing 127
to allow the canopy to be collapsed; and
b) Can allow persons with arthritis the ability to disengage the arthritic-assisting self-centering spring-loaded housing-locking hook 126 without the use of fingers
to help those with arthritis to collapse canopy with less pain.

16) It is still yet an even further object of the new invention to provide an arthritic-assisting one-person-deploying adjustable-central-canopy adjustable-ring-canopy rollable central-one-push-locking popup
Therefore, the arthritic-assisting one-person-deploying adjustable-central-canopy adjustable-ring-canopy rollable central-one-push-locking popup:
a) Can be quick and easy to move just like a luggage with four swiveling wheels;
b) Can have a quick and easy one-push-lock set up;
c) Can be securely locked by four wheel locks on four swiveling wheels, respectively;
d) Can quickly and easily be erected up by one person;
e) Can quickly and easily be folded down by one person; and
f) Can quickly and easily be rolled away in any direction by one person
g) Can quickly and easily be rotated 360 degrees by one person.

What is claimed is:

1. An arthritic-assisting one-person-deploying adjustable-central-canopy adjustable-ring-canopy rollable central-one-push-locking popup comprising:
an adjustable ring canopy
for providing a cover to protect users from weather elements,
for redirecting wind and smoke above said adjustable ring canopy into said popup,
for redirecting wind and smoke to flow out and away from under said popup, and
for allowing light to shine into said popup;
a central intersector;
a plurality of foldable top trusses
respectively and pivotably bolted to said central intersector, and
respectively attached to said adjustable ring canopy;
a plurality of top-truss connectors
respectively and pivotably bolted to said foldable top trusses;
a plurality of foldable corner trusses
respectively and pivotably bolted to said foldable top trusses;
a plurality of foldable side trusses;
four upper corner intersectors
respectively and pivotably bolted to said foldable top trusses, and
respectively and pivotably bolted to said foldable side trusses;
four upper posts
each having an upper-post bottom end,
said four upper posts
respectively attached to said four upper corner intersectors;
four lower corner intersectors
respectively slid on said four upper posts,
respectively bolted to said foldable corner trusses, and
respectively bolted to said foldable side trusses,
said four lower corner intersectors having a plurality of intersector holes,
said intersector holes respectively molded in said four lower corner intersectors;
four sleeves
respectively slid on said upper-post bottom ends of said four upper posts;
four arthritic-assisting post-height-adjusting spring-loaded rope-loop hooks
respectively and pivotably attached to said four sleeves;
four post-height-adjusting nipples
respectively molded to said arthritic-assisting post-height-adjusting spring-loaded rope-loop hooks;
four lower posts
each having a lower-post bottom end,
said four lower posts
respectively and slidably inserted inside said four upper posts
said four sleeves
for preventing said four upper posts and said four lower posts from scratching each other;
a plurality of post-height-adjusting holes
respectively drilled in said four upper posts and said four lower posts,
said arthritic-assisting post-height-adjusting spring-loaded rope-loop hooks for pushing said four post-height-adjusting nipples into said post-height-adjusting holes to secure said four upper posts to said four lower posts, and for providing additional leverage to allow an arthritic the capability to press to operate said arthritic-assisting post-height-adjusting spring-loaded rope-loop hooks without the need to fold his fingers;

an adjustable central canopy
for covering the center of said popup,
for redirecting wind and smoke above said adjustable ring canopy into said popup,
for redirecting wind and smoke to flow out and away from under said popup, and
for allowing light to shine into said popup;

a central post
attached to said central intersector;

a central-post hole
formed in said central post;

a central-innersurface-locking spring
inserted inside said central post an arthritic-assisting self-centering spring-loaded housing-locking hook
pivotably riveted inside said central post
said central-innersurface-locking spring
for pushing said arthritic-assisting self-centering spring-loaded housing-locking hook into said central-post hole;

an arthritic-assisting central-one-push-locking adjustable housing
having an outer surface, an inner surface, and a housing end,
said arthritic-assisting self-centering spring-loaded housing-locking hook for snap-locking into and self-centering in said arthritic-assisting central-one-push-locking adjustable housing when said arthritic-assisting central-one-push-locking adjustable housing slides up and down said central post,
said arthritic-assisting central-one-push-locking adjustable housing adjustably and slidably locked on and unlocked from said central post for snap-locking on and off said arthritic-assisting self-centering spring-loaded housing-locking hook when said arthritic-assisting central-one-push-locking adjustable housing slides up and down said central post,
for locking and unlocking said central post to and from said arthritic-assisting central-one-push-locking adjustable housing,
for locking and unlocking said popup after said popup is folded or unfolded, and
for allowing said popup to be folded and unfolded by a single person when said arthritic-assisting central-one-push-locking adjustable housing is pushed upward to push said four upper posts outward to lock said four upper posts in position;

a lead-in funnel
molded to said housing end of said arthritic-assisting central-one-push-locking adjustable housing;

a button tunnel
molded from said outer surface to said inner surface of said arthritic-assisting central-one-push-locking adjustable housing;

an arthritic-assisting tapered wedge button
snapped into said button tunnel
for pushing said arthritic-assisting self-centering spring-loaded housing-locking hook out of said button tunnel, and
for allowing an arthritic the ability to push to disengage said arthritic-assisting self-centering spring-loaded housing-locking hook from said central post without the need to fold his fingers;

a plurality of foldable adjustable central trusses
respectively and pivotably bolted to said foldable top trusses,
respectively and pivotably bolted to said arthritic-assisting central-one-push-locking adjustable housing, and
respectively attached to said adjustable central canopy;

a plurality of pivoting threaded caster pins
respectively and threadedly attached into said lower-post bottom ends of said four lower posts;

a plurality of wheel-locking hooks a plurality of pulley-axel-and-locking-wheel braces,
said wheel-locking hooks
respectively and pivotably connected to said pulley-axel-and-locking-wheel braces,
said pulley-axel-and-locking-wheel braces
respectively attached to said pivoting threaded caster pins
for allowing an arthritic to move said popup in any direction when said popup is collapsed or deployed without the need to fold his fingers;

a plurality of wheel gears;

a plurality of peg springs;

a plurality of gear-locking pegs;

a plurality of arthritic-assisting pulley-axles
respectively and rotatably attached to and between said pulley-axel-and-locking-wheel braces
for functioning as pulley to wrap said ropes thereon
to reduce rope-pulling forces needed to pull on said ropes to stretch
said adjustable ring canopy and
for functioning as an axle to rotatably attach said shock-absorbing locking-wheels thereon;

a plurality of shock-absorbing locking-wheels
respectively and rotatably attached to said arthritic-assisting pulley-axles
for functioning as wheel
to allow said popup to be rolled along the ground or a surface for transportation and storage,
for functioning as wheel
to allow said popup to be rolled along a sandy surface, and
for functioning as wheel
to allow said popup to be rolled upon rough or uneven terrain,
said wheel gears
respectively molded to said shock-absorbing locking-wheels
for locking said gear-locking pegs in between,
said peg springs;
respectively slid on said gear-locking pegs
for pushing said gear-locking pegs away from said wheel gears,
said gear-locking pegs
respectively and pivotably attached to said pulley-axle-and-locking-wheel braces for pushing in between said wheel gears
to lock said wheel gears in place,
said arthritic-assisting wheel-locking spring-loaded rope-loop hooks
for locking said shock-absorbing locking-wheels
to prevent said shock-absorbing locking-wheels from rolling when desired.

2. The arthritic-assisting one-person-deploying adjustable-central-canopy adjustable-ring-canopy rollable central-one-push-locking popup of claim 1, further comprising:
a plurality of ropes
respectively sewn to said adjustable ring canopy,
respectively threaded under and around said arthritic-assisting pulley-axles, and
respectively hooked on said arthritic-assisting wheel-locking spring-loaded rope-loop hooks or said arthritic-assisting post-height-adjusting spring-loaded rope-loop hooks.

3. The arthritic-assisting one-person-deploying adjustable-central-canopy adjustable-ring-canopy rollable central-one-push-locking popup of claim 2,
wherein
said ropes are made of canvas, fabric, nylon, or flexible material.

4. The arthritic-assisting one-person-deploying adjustable-central-canopy adjustable-ring-canopy rollable central-one-push-locking popup of claim 1,
further comprising:
a plurality of post-centering clamps
respectively molded to said four sleeves
for centering said four lower posts inside said four upper posts;
a plurality of tick-preventing downward teeth
respectively molded to said four sleeves
for preventing ticks from getting inside said four upper posts and said four lower posts; and
a plurality of water-discharging grooves
respectively molded to said four sleeves for allowing water to discharge out of said four upper posts and said four lower posts.

5. The arthritic-assisting one-person-deploying adjustable-central-canopy adjustable-ring-canopy rollable central-one-push-locking popup of claim 1,
wherein
said shock-absorbing locking-wheels are made of metal, plastic, or a combination of said materials.

6. The arthritic-assisting one-person-deploying adjustable-central-canopy adjustable-ring-canopy rollable central-one-push-locking popup of claim 1,
wherein
said shock-absorbing locking-wheels are made of shock-absorbing materials.

7. The arthritic-assisting one-person-deploying adjustable-central-canopy adjustable-ring-canopy rollable central-one-push-locking popup of claim 1,
wherein
said arthritic-assisting one-person-deploying adjustable-central-canopy adjustable-ring-canopy rollable central-one-push-locking popup is made of metal, plastic, canvas, fabric, nylon, or a combination of said materials.

8. An arthritic-assisting one-person-deploying rollable central-one-push-locking popup comprising:
an adjustable ring canopy
for providing a cover to protect users from weather elements,
for redirecting wind and smoke above said adjustable ring canopy into said popup,
for redirecting wind and smoke to flow out and away from under said popup, and
for allowing light to shine into said popup;
a central intersector;
a plurality of foldable top trusses
respectively and pivotably bolted to said central intersector, and
respectively attached to said adjustable ring canopy;
a plurality of top-truss connectors
respectively and pivotably bolted to said foldable top trusses;
a plurality of foldable corner trusses
respectively and pivotably bolted to said foldable top trusses;
a plurality of foldable side trusses;
four upper corner intersectors
respectively and pivotably bolted to said foldable top trusses, and
respectively and pivotably bolted to said foldable side trusses;
four upper posts
each having an upper-post bottom end,
said four upper posts
respectively attached to said four upper corner intersectors;
four lower corner intersectors
respectively slid on said four upper posts,
respectively bolted to said foldable corner trusses, and
respectively bolted to said foldable side trusses,
said four lower corner intersectors having a plurality of intersector holes,
said intersector holes respectively molded in said four lower corner intersectors;
four sleeves
respectively slid on said upper-post bottom ends of said four upper posts;
four post-height-adjusting nipples
respectively and pivotably attached to said four sleeves;
four lower posts
each having a lower-post bottom end,
said four lower posts
respectively and slidably inserted inside said four upper posts,
said four sleeves
for preventing said four upper posts and said four lower posts from scratching each other;
a plurality of post-height-adjusting holes
respectively drilled in said four upper posts and said four lower posts
for pushing said four post-height-adjusting nipples into said post-height-adjusting holes to secure said four upper posts to said four lower posts;
an adjustable central canopy
for covering the center of said popup,
for redirecting wind and smoke above said adjustable ring canopy into said popup,
for redirecting wind and smoke to flow out and away from under said popup, and
for allowing light to shine into said popup;
a central post
attached to said central intersector;
a central-post hole
formed in said central post;
a central-innersurface-locking spring
inserted inside said central post;
an arthritic-assisting self-centering spring-loaded housing-locking hook
pivotably riveted inside said central post
said central-innersurface-locking spring
for pushing said arthritic-assisting self-centering spring-loaded housing-locking hook into said central-post hole;
an arthritic-assisting central-one-push-locking adjustable housing having an outer surface, an inner surface, and a housing end, said arthritic-assisting self-centering spring-loaded housing-locking hook for snap-locking into and self-centering in said arthritic-assisting central-one-push-locking adjustable housing when said arthritic-assisting central-one-push-locking adjustable housing slides up and down said central post, said arthritic-assisting central-one-push-locking adjustable housing adjustably and slidably locked on and unlocked from said central post for snap-locking on and off said arthritic-assisting self-centering spring-loaded housing-locking hook when said arthritic-assisting central-one-push-locking adjustable housing slides up and down said central post, for locking and unlocking said central post to and from said arthritic-assisting central-one-push-locking adjustable housing, for locking and unlocking said popup after said popup is folded or unfolded, and for allowing said popup to be folded and unfolded by a single person when said arthritic-assisting central-one-push-locking adjustable housing is pushed upward to push said four upper posts outward to lock said four upper posts in position;

a lead-in funnel molded to said housing end of said arthritic-assisting central-one-push-locking adjustable housing;

a button tunnel molded from said outer surface to said inner surface of said arthritic-assisting central-one-push-locking adjustable housing;

an arthritic-assisting tapered wedge button snapped into said button tunnel for pushing said arthritic-assisting self-centering spring-loaded housing-locking hook out of said button tunnel, and for allowing an arthritic the ability to push to disengage said arthritic-assisting self-centering spring-loaded housing-locking hook from said central post without the need to fold his fingers;

a plurality of foldable adjustable central trusses respectively and pivotably bolted to said foldable top trusses, respectively and pivotably bolted to said arthritic-assisting central-one-push-locking adjustable housing, and respectively attached to said adjustable central canopy;

a plurality of pivoting threaded caster pins respectively and threadedly attached into said lower-post bottom ends of said four lower posts;

a plurality of wheel-locking hooks a plurality of pulley-axel-and-locking-wheel braces, said wheel-locking hooks respectively and pivotably connected to said pulley-axel-and-locking-wheel braces, said pulley-axel-and-locking-wheel braces respectively attached to said pivoting threaded caster pins for allowing an arthritic to move said popup in any direction when said popup is collapsed or deployed without the need to fold his fingers;

a plurality of wheel gears;

a plurality of peg springs;

a plurality of gear-locking pegs;

a plurality of arthritic-assisting pulley-axles respectively and rotatably attached to and between said pulley-axel-and-locking-wheel braces for functioning as pulley to wrap said ropes thereon to reduce rope-pulling forces needed to pull on said ropes to stretch said adjustable ring canopy and for functioning as an axle to rotatably attach said shock-absorbing locking-wheels thereon;

a plurality of shock-absorbing locking-wheels respectively and rotatably attached to said arthritic-assisting pulley-axles for functioning as wheel to allow said popup to be rolled along the ground or a surface for transportation and storage, for functioning as wheel to allow said popup to be rolled along a sandy surface, and for functioning as wheel to allow said popup to be rolled upon rough or uneven terrain, said wheel gears respectively molded to said shock-absorbing locking-wheels for locking said gear-locking pegs in between, said peg springs;

respectively slid on said gear-locking pegs for pushing said gear-locking pegs away from said wheel gears, said gear-locking pegs respectively and pivotably attached to said pulley-axle-and-locking-wheel braces for pushing in between said wheel gears to lock said wheel gears in place, said arthritic-assisting wheel-locking spring-loaded rope-loop hooks for locking said shock-absorbing locking-wheels to prevent said shock-absorbing locking-wheels from rolling when desired.

9. The arthritic-assisting one-person-deploying rollable central-one-push-locking popup of claim 8, further comprising:

a plurality of ropes respectively sewn to said adjustable ring canopy, respectively threaded under and around said arthritic-assisting pulley-axles, and respectively hooked on said arthritic-assisting wheel-locking spring-loaded rope-loop hooks.

10. The arthritic-assisting one-person-deploying rollable central-one-push-locking popup of claim 9, wherein said ropes are made of canvas, fabric, nylon, or flexible material.

11. The arthritic-assisting one-person-deploying rollable central-one-push-locking popup of claim 8, further comprising:

a plurality of post-centering clamps respectively molded to said four sleeves for centering said four lower posts inside said four upper posts;

a plurality of tick-preventing downward teeth respectively molded to said four sleeves for preventing ticks from getting inside said four upper posts and said four lower posts; and a plurality of water-discharging grooves respectively molded to said four sleeves for allowing water to discharge out of said four upper posts and said four lower posts.

12. The arthritic-assisting one-person-deploying rollable central-one-push-locking popup of claim 8, wherein said shock-absorbing locking-wheels are made of metal, plastic, or a combination of said materials.

13. The arthritic-assisting one-person-deploying rollable central-one-push-locking popup of claim 8, wherein said shock-absorbing locking-wheels are made of shock-absorbing materials.

14. The arthritic-assisting one-person-deploying rollable central-one-push-locking popup of claim 8, wherein said arthritic-assisting one-person-deploying rollable central-one-push-locking popup is made of metal, plastic, canvas, fabric, nylon, or a combination of said materials.

15. An arthritic-assisting central-one-push-locking popup comprising:

an adjustable ring canopy for providing a cover to protect users from weather elements, for redirecting wind and smoke above said adjustable ring canopy into said popup, for redirecting wind and smoke to flow out and away from under said popup, and for allowing light to shine into said popup;

a central intersector;

a plurality of foldable top trusses respectively and pivotably bolted to said central intersector, and respectively attached to said adjustable ring canopy;

a plurality of top-truss connectors respectively and pivotably bolted to said foldable top trusses;

a plurality of foldable corner trusses respectively and pivotably bolted to said foldable top trusses;

a plurality of foldable side trusses;

four upper corner intersectors respectively and pivotably bolted to said foldable top trusses, and respectively and pivotably bolted to said foldable side trusses;

four upper posts each having an upper-post bottom end, said four upper posts respectively attached to said four upper corner intersectors;

four lower corner intersectors respectively slid on said four upper posts, respectively bolted to said foldable corner trusses, and respectively bolted to said foldable side trusses, said four lower corner intersectors having a plurality of intersector holes, said intersector holes respectively molded in said four lower corner intersectors;

four sleeves respectively slid on said upper-post bottom ends of said four upper posts four post-height-adjusting nipples respectively and pivotably attached to said four sleeves;

four lower posts each having a lower-post bottom end, said four lower posts respectively and slidably inserted inside said four upper posts, said four sleeves for preventing said four upper posts and said four lower posts from scratching each other;

a plurality of post-height-adjusting holes respectively drilled in said four upper posts and said four lower posts for pushing said four post-height-adjusting nipples into said post-height-adjusting holes to secure said four upper posts to said four lower posts;

an adjustable central canopy for covering the center of said popup, for redirecting wind and smoke above said adjustable ring canopy into said popup, for redirecting wind and smoke to flow out and away from under said popup, and for allowing light to shine into said popup;

a central post attached to said central intersector;

a central-post hole formed in said central post;

a central-innersurface-locking spring inserted inside said central post an arthritic-assisting self-centering spring-loaded housing-locking hook pivotably riveted inside said central post, said central-innersurface-locking spring for pushing said arthritic-assisting self-centering spring-loaded housing-locking hook into said central-post hole;

an arthritic-assisting central-one-push-locking adjustable housing having an outer surface, an inner surface, and a housing end, said arthritic-assisting self-centering spring-loaded housing-locking hook for snap-locking into and self-centering in said arthritic-assisting central-one-push-locking adjustable housing when said arthritic-assisting central-one-push-locking adjustable housing slides up and down said central post, said arthritic-assisting central-one-push-locking adjustable housing adjustably and slidably locked on and unlocked from said central post for snap-locking on and off said arthritic-assisting self-centering spring-loaded housing-locking hook when said arthritic-assisting central-one-push-locking adjustable housing slides up and down said central post, for locking and unlocking said central post to and from said arthritic-assisting central-one-push-locking adjustable housing, for locking and unlocking said popup after said popup is folded or unfolded, and for allowing said popup to be folded and unfolded by a single person when said arthritic-assisting central-one-push-locking adjustable housing is pushed upward to push said four upper posts outward to lock said four upper posts in position;

a button tunnel molded from said outer surface to said inner surface of said arthritic-assisting central-one-push-locking adjustable housing;

an arthritic-assisting tapered wedge button snapped into said button tunnel for pushing said arthritic-assisting self-centering spring-loaded housing-locking hook out of said button tunnel, and for allowing an arthritic the ability to push to disengage said arthritic-assisting self-centering spring-loaded housing-locking hook from said central post without the need to fold his fingers;

a plurality of foldable adjustable central trusses
respectively and pivotably bolted to said foldable top trusses,
respectively and pivotably bolted to said arthritic-assisting central-one-push-locking adjustable housing, and
respectively attached to said adjustable central canopy;

a plurality of pivoting threaded caster pins
respectively and threadedly attached into said lower-post bottom ends of said four lower posts;

a plurality of wheel-locking hooks a plurality of pulley-axel-and-locking-wheel braces,
said wheel-locking hooks
respectively and pivotably connected to said pulley-axel-and-locking-wheel braces,
said pulley-axel-and-locking-wheel braces
respectively attached to said pivoting threaded caster pins
for allowing an arthritic to move said popup in any direction when said popup is collapsed or deployed without the need to fold his fingers;

a plurality of wheel gears;

a plurality of peg springs;

a plurality of gear-locking pegs;

a plurality of arthritic-assisting pulley-axles
respectively and rotatably attached to and between said pulley-axel-and-locking-wheel braces
for functioning as pulley to wrap said ropes thereon
to reduce rope-pulling forces needed to pull on said ropes to stretch said adjustable ring canopy and
for functioning as an axle to rotatably attach said shock-absorbing locking-wheels thereon;

a plurality of shock-absorbing locking-wheels
respectively and rotatably attached to said arthritic-assisting pulley-axles
for functioning as wheel
to allow said popup to be rolled along the ground or a surface for transportation and storage,
for functioning as wheel
to allow said popup to be rolled along a sandy surface, and
for functioning as wheel
to allow said popup to be rolled upon rough or uneven terrain,
said wheel gears
respectively molded to said shock-absorbing locking-wheels
for locking said gear-locking pegs in between,
said peg springs;
respectively slid on said gear-locking pegs
for pushing said gear-locking pegs away from said wheel gears,
said gear-locking pegs
respectively and pivotably attached to said pulley-axle-and-locking-wheel braces
for pushing in between said wheel gears
to lock said wheel gears in place, said arthritic-assisting wheel-locking spring-loaded rope-loop hooks
for locking said shock-absorbing locking-wheels
to prevent said shock-absorbing locking-wheels from rolling when desired.

16. The arthritic-assisting central-one-push-locking popup of claim 15,
further comprising:
a plurality of ropes
respectively sewn to said adjustable ring canopy,
respectively threaded under and around said arthritic-assisting pulley-axles, and
respectively hooked on said arthritic-assisting wheel-locking spring-loaded rope-loop hooks.

17. The arthritic-assisting central-one-push-locking popup of claim 16,
wherein
said ropes are made of canvas, fabric, nylon, or flexible material.

18. The arthritic-assisting central-one-push-locking popup of claim 15, further comprising:
a plurality of post-centering clamps
respectively molded to said four sleeves
for centering said four lower posts inside said four upper posts;
a plurality of tick-preventing downward teeth
respectively molded to said four sleeves
for preventing ticks from getting inside said four upper posts and said four lower posts; and
a plurality of water-discharging grooves
respectively molded to said four sleeves
for allowing water to discharge out of said four upper posts and said four lower posts.

19. The arthritic-assisting central-one-push-locking popup of claim 15,
wherein
said shock-absorbing locking-wheels are made of metal, plastic, or a combination of said materials.

20. The arthritic-assisting central-one-push-locking popup of claim 15,
wherein
said shock-absorbing locking-wheels are made of shock-absorbing materials.

* * * * *